US011096491B2

(12) United States Patent
Pyle et al.

(10) Patent No.: US 11,096,491 B2
(45) Date of Patent: Aug. 24, 2021

(54) SYSTEM AND METHOD FOR HANGING AN ARTICLE FROM A SUPPORT SURFACE

(71) Applicant: MCS Industries, Inc., Easton, PA (US)

(72) Inventors: Michael Lee Pyle, Sugar Grove, IL (US); Steven Patrick McGowan, Perkasie, PA (US); Matthew Scott Kressin, Allentown, PA (US); Richard Joseph Ehrhardt, Easton, PA (US); Robert Terry Coyle, Jr., Palmer, PA (US)

(73) Assignee: MCS INDUSTRIES, INC.

( * ) Notice: Subject to any disclaimer, the term of this patent is extended or adjusted under 35 U.S.C. 154(b) by 341 days.

(21) Appl. No.: 15/903,131

(22) Filed: Feb. 23, 2018

(65) Prior Publication Data

US 2018/0235366 A1 Aug. 23, 2018

Related U.S. Application Data

(60) Provisional application No. 62/462,534, filed on Feb. 23, 2017, provisional application No. 62/462,538, filed on Feb. 23, 2017.

(51) Int. Cl.

| | |
|---|---|
| ***A47B 95/00*** | (2006.01) |
| ***A47B 67/02*** | (2006.01) |
| ***A47B 96/06*** | (2006.01) |

(52) U.S. Cl.

CPC ..... *A47B 95/008* (2013.01); *A47B 67/02* (2013.01); *A47B 96/06* (2013.01); *A47B 2230/07* (2013.01)

(58) Field of Classification Search

CPC ..... A47B 95/008; A47B 96/06; A47B 67/02; A47B 2230/07; A47G 1/1606;

(Continued)

(56) References Cited

U.S. PATENT DOCUMENTS 1,278,790 A * 9/1918 Thunell ..... A47B 96/067 312/324
1,796,502 A * 3/1931 Boucher ..... E05G 1/005 109/52

(Continued)

FOREIGN PATENT DOCUMENTS

DE 202010013164 3/2011

OTHER PUBLICATIONS

Home-Dzine. What are Cam or Locking Screws? Sep. 13, 2016. (May 29, 2018). Retrieved from Internet: <URL: https://web.archive.org/web/20160913065128/https://www.home-dzine.co.za/diy/diy-camscrews.htm. ZA.

(Continued)

*Primary Examiner* — Jonathan Liu
*Assistant Examiner* — Guang H Guan
(74) *Attorney, Agent, or Firm* — Belles Katz LLC

(57) ABSTRACT

A system and a method for hanging an article from a support surface. The article may be a cabinet, such as a medicine cabinet or the like, although the system described herein may be used for hanging any type of article from a support surface such as a wall. The system uses a surface mounting element that is coupled to the support surface and a cam lock that is slidably coupled to the article to hang the article from the support surface by coupling the surface mounting element to the cam lock. Because the cam lock is slidably coupled to the article, the article can move horizontally along the support surface without separating the article from the support surface.

12 Claims, 43 Drawing Sheets

(58) Field of Classification Search
CPC .... A47G 1/1613; A47G 1/162; A47G 1/1626; A47G 1/1633; A47G 1/164; F16B 12/2036; Y10S 403/12
USPC ..... 312/245, 246
See application file for complete search history.

(56) References Cited

U.S. PATENT DOCUMENTS

| | | | | |
|---|---|---|---|---|
| 2,499,240 | A * | 2/1950 | Aiken | B43L 1/06 434/416 |
| 2,708,147 | A | 5/1955 | Duggan et al. | |
| 3,791,709 | A | 2/1974 | Cross | |
| 3,879,096 | A | 4/1975 | Blodee | |
| 3,914,892 | A | 10/1975 | Mohr | |
| D241,008 | S | 8/1976 | Di Loreto | |
| 4,131,376 | A | 12/1978 | Busse | |
| D264,680 | S | 6/1982 | Widen | |
| D272,718 | S | 2/1984 | Knudson | |
| 4,599,011 | A | 7/1986 | Tashiro et al. | |
| 4,728,215 | A | 3/1988 | Martincic et al. | |
| 4,804,161 | A * | 2/1989 | Wallo | A47G 1/164 248/489 |
| 4,899,974 | A * | 2/1990 | Wear | A47G 1/21 211/45 |
| 4,927,215 | A * | 5/1990 | Katz | A47B 67/005 312/224 |
| 5,099,589 | A * | 3/1992 | Lai | A47G 1/143 40/746 |
| 5,222,611 | A | 6/1993 | Wood et al. | |
| 5,392,934 | A | 2/1995 | Fox | |
| 5,590,975 | A | 1/1997 | Homtvedt | |
| 5,624,168 | A | 8/1997 | Licciardello, Sr. | |
| 5,667,327 | A | 9/1997 | Salice | |
| 5,718,493 | A * | 2/1998 | Nikolai | A47B 95/008 312/245 |
| D391,844 | S | 3/1998 | Ropponen et al. | |
| 5,762,442 | A | 6/1998 | Salice | |
| 5,788,395 | A | 8/1998 | Grieser et al. | |
| 5,927,671 | A | 7/1999 | Pynenburg | |
| D422,200 | S | 4/2000 | Maruyama | |
| 6,076,295 | A * | 6/2000 | Garfinkle | G09F 7/18 40/605 |
| 6,478,518 | B1 | 11/2002 | Hwang | |
| 6,637,716 | B2 * | 10/2003 | Wear | A47G 1/0611 24/563 |
| 6,848,855 | B2 * | 2/2005 | Hasler | F16B 12/2036 403/409.1 |
| 6,945,414 | B1 * | 9/2005 | Stevens | A47F 5/0846 211/183 |
| D573,453 | S | 7/2008 | Buckley | |
| D583,224 | S | 12/2008 | Holdsworth | |
| 7,624,479 | B1 | 12/2009 | Lin | |
| D622,582 | S | 8/2010 | Lottner et al. | |
| D627,490 | S | 11/2010 | Janish | |
| 7,886,496 | B1 | 2/2011 | Spransy | |
| D633,782 | S | 3/2011 | Tompkins | |
| 7,954,914 | B2 | 6/2011 | Kendall et al. | |
| 8,434,835 | B2 | 5/2013 | Hardy et al. | |
| 8,840,080 | B1 | 9/2014 | Gordon | |
| 8,882,065 | B2 * | 11/2014 | Henriott | A47B 96/067 248/205.1 |
| D719,820 | S | 12/2014 | McGrath | |
| D721,266 | S | 1/2015 | Sun | |
| 8,955,266 | B2 | 2/2015 | Zhang | |
| D727,138 | S | 4/2015 | Cross | |
| 9,010,033 | B2 * | 4/2015 | Woods | A47B 5/00 52/36.5 |
| D730,717 | S | 6/2015 | Moreau et al. | |
| D746,461 | S | 12/2015 | Butler | |
| 9,211,004 | B2 | 12/2015 | Diemel, Jr. et al. | |
| 9,345,327 | B2 * | 5/2016 | Pierce | A47B 96/07 |
| 9,511,334 | B2 * | 12/2016 | Kral | B01F 15/00746 |
| 9,668,576 | B2 | 6/2017 | Trunkle | |
| D793,840 | S | 8/2017 | Richardson | |
| D799,949 | S | 10/2017 | Stevenson et al. | |
| D805,367 | S | 12/2017 | Winslow | |
| 9,944,217 | B2 * | 4/2018 | Schroeder | B60P 7/0815 |
| D818,806 | S | 5/2018 | Copeland | |
| D832,094 | S | 10/2018 | Omori | |
| D835,978 | S | 12/2018 | Ikeda | |
| D843,197 | S | 3/2019 | Dempsey et al. | |
| D844,421 | S | 4/2019 | McClure | |
| D859,134 | S | 9/2019 | Iacono | |
| D864,702 | S | 10/2019 | Hagspiel | |
| D866,309 | S | 11/2019 | McGrath | |
| D867,117 | S | 11/2019 | McGrath | |
| D874,257 | S | 2/2020 | Cheng | |
| D875,517 | S | 2/2020 | Cheng | |
| D883,769 | S | 5/2020 | Siegel | |
| D885,880 | S | 6/2020 | Li | |
| D911,813 | S * | 3/2021 | Pyle | A47G 1/143 D8/343 |
| 2004/0016080 | A1 | 1/2004 | De Oliveira | |
| 2008/0069631 | A1 | 3/2008 | Zillmann | |
| 2008/0084143 | A1 | 4/2008 | Ho | |
| 2010/0004693 | A1 | 1/2010 | Miller et al. | |
| 2010/0322740 | A1 | 12/2010 | Vestergaard-Jensen | |
| 2013/0020920 | A1 | 1/2013 | Weber | |
| 2013/0096618 | A1 | 4/2013 | Chandanson et al. | |
| 2013/0131734 | A1 | 5/2013 | Longtain et al. | |
| 2013/0180202 | A1 | 7/2013 | Woods et al. | |
| 2013/0345754 | A1 | 12/2013 | Doubler et al. | |
| 2014/0140758 | A1 | 5/2014 | Liu et al. | |
| 2015/0112390 | A1 | 4/2015 | Fang | |
| 2015/0230829 | A1 | 8/2015 | Harris et al. | |
| 2016/0245321 | A1 | 8/2016 | Yu et al. | |
| 2017/0023042 | A1 | 1/2017 | Grabher et al. | |
| 2018/0135677 | A1 | 5/2018 | Catteneo | |
| 2018/0235366 | A1 * | 8/2018 | Pyle | A47B 96/06 |
| 2018/0238366 | A1 | 8/2018 | Catteneo | |
| 2019/0142175 | A1 | 5/2019 | Cantrell | |

OTHER PUBLICATIONS

International Search Report for corresponding Application No. PCT/US2018/019336, dated Jun. 22, 2018. WO.

Supplementary Partial European Search Report for European Appln. No. 18708321 dated Nov. 18, 2019.

Ikea CAM, https://www.ebay.co.uk/itm/Ikea-CAM-LOCK-BOLT-Screw-Nut-Flat-Pack-Furniture-Connector-Pax-Billy-Cupboard/223345655604?_trkparms=aid%3D1110006%26algo%3DHOMESPLICE.SIM%26ao%3D1 %26asc%3D225114%26meid%3 Deb89a8f86e504b52b093fd26f27 c8f3f%26pid%3D100623%26rk%3 04 %26rkt%3 D5%26mehot%3 Dpp%26sd%30223 (Year: 2020).

Hafele Cam Lock, https://www.screwfix.ie/c/screws-nails-fixings/cam-dowels-locks/cat7280104 (Year: 2020).

* cited by examiner

SYSTEM AND METHOD FOR HANGING AN ARTICLE FROM A SUPPORT SURFACE

CROSS-REFERENCE TO RELATED APPLICATIONS

The present application claims priority to U.S. Provisional Patent Application Ser. No. 62/462,534, filed Feb. 23, 2017, and U.S. Provisional Patent Application Ser. No. 62/462,538, filed Feb. 23, 2017, the entireties of which are incorporated herein by reference.

BACKGROUND

Hanging articles from a wall in a home can be an arduous task requiring multiple people to work together in order to ensure that the item is hung in a level and secure manner. Even using the utmost care, such articles are frequently hung in a non-level manner, which is unappealing. This is true of hanging cabinetry such as kitchen cabinets and medicine-style cabinets and other heavy items. Furthermore, improvements in hanging even lightweight items such as frames and the like is desirable to ensure ease of installation and to ensure that the item is hung in a level manner and at the desired located on the wall surface. Using current systems, once an article is hung from a wall it can only be moved by physically taking the article down from the wall and reattaching it to a different part of the wall. This is undesirable as it results in additional holes in the wall that require patching and is time consuming. Thus, a need exists for an improved system for hanging such items.

BRIEF SUMMARY

The present invention is directed to a system and method for hanging an article from a support surface. The article may be a cabinet, such as a medicine cabinet or the like, although the system described herein may be used for hanging any type of article from a support surface such as a wall. The system uses a cam screw that is coupled to the support surface and a cam lock that is slidably coupled to the article to enable the article to move horizontally along the support surface. This allows for the article to be moved without separating it from the support surface if it is desired to move it slightly leftward or rightward for any purpose.

In one aspect, the invention may be a system for hanging an article from a support surface, the system comprising: an article comprising a top end having an elongated mounting element; at least one surface mounting element comprising a first portion and a second portion, the surface mounting element configured to be coupled to a support surface so that the second portion of the surface mounting element protrudes from the support surface; and at least one cam lock comprising a first portion that is slidably mounted to the elongated mounting element and a second portion, the cam lock alterable between: (1) a receiving state in which the second portion of the surface mounting element can be inserted into and removed from the second portion of the cam lock; and (2) a locked state in which the second portion of the surface mounting element is prohibited from being removed from the second portion of the cam lock.

In another aspect, the invention may be a system for hanging an article from a support surface, the system comprising: an article comprising a top end having a mounting channel extending along a channel axis; and at least one cam lock slidably coupled to the article, the cam lock comprising a first portion that is slidably mounted to the mounting channel of the article and a second portion that protrudes from the mounting channel of the article, the cam lock being movable within the mounting channel in a direction of the channel axis while remaining coupled to the article.

In yet another aspect, the invention may be a method of hanging an article from a support surface, the method comprising: a) providing an article comprising an elongated mounting element; b) coupling at least one surface mounting element to a support surface so that a portion of the surface mounting element protrudes from the support surface; c) slidably coupling a first portion of at least one cam lock to the elongated mounting element of the article; d) inserting the portion of the surface mounting element into a second portion of the cam lock; and e) rotating the cam lock into a locked state so that the portion of the surface mounting element is prohibited from being separated from the second portion of the cam lock.

In still another aspect, the invention may be a method of hanging an article from a support surface, the method comprising: a) providing an article comprising a mounting channel, the article extending from a bottom end to a top end along a longitudinal axis; b) coupling first and second cam screws to a support surface at the same elevation and in a horizontally spaced apart manner; c) positioning a first portion of a first cam lock and a first portion of a second cam lock in the mounting channel of the article on opposite sides of the longitudinal axis of the article, second portions of the first and second cam locks protruding from the mounting channel; and d) coupling portions of the first and second cam screws that protrude from the support surface to the second portions of the first and second cam locks, respectively, thereby mounting the article to the support surface.

In a further aspect, the invention may be a cam lock comprising: a main body comprising a top portion, a bottom portion, and a receiving cavity between the top and bottom portions; a stem extending from a bottom surface of the bottom portion of the main body; and a flange extending radially from the stem and being spaced apart from the bottom surface of the bottom portion of the main body by a gap.

In a still further aspect, the invention may be a cam lock comprising: a first portion having a top surface; a second portion having a bottom surface, the second portion comprising a cavity that is configured to receive a head portion and a neck portion of a surface mounting element to couple the cam lock to the surface mounting element; and a stem extending from the top surface of the first portion to the bottom surface of the second portion, the top surface of the first portion and the bottom surface of the second portion being spaced apart by a gap.

In another aspect, the invention may be a cam lock comprising: a main body extending along a longitudinal axis and comprising a lower cam surface and an upper cam surface, a cam slot defined between the lower and upper cam surfaces; the lower cam surface comprising a first portion, a second portion, and a ramp between the first and second portions, the second portion being raised relative to the first portion; and the upper cam surface comprising a protuberance extending into the cam slot, the protuberance being axially aligned with the first portion of the lower cam surface.

In still another aspect, the invention may be a cabinet comprising: a housing comprising a rear wall and a plurality of sidewalls extending from the rear wall, the rear wall and the plurality of sidewalls collectively defining a cavity having an opening; the plurality of sidewalls comprising a first inner sidewall and a second inner sidewall opposite the first inner sidewall, each of the first and second inner sidewalls having openings configured to receive shelf supports to support one or more shelves between the first and second inner sidewalls; a first outer sidewall adjacent to and spaced apart from the first inner sidewall; and a second outer sidewall adjacent to and spaced apart from the second inner sidewall.

In a further aspect, the invention may be a cabinet comprising: a housing comprising a rear wall and a plurality of sidewalls extending from the rear wall, the rear wall and the plurality of sidewalls collectively defining a cavity having an opening; the plurality of sidewalls comprising a first inner sidewall having an inner surface and an outer surface and a second inner sidewall having an inner surface and an outer surface, each of the first and second inner sidewalls having openings extending from the inner surface to the outer surface; a first outer sidewall spaced apart from the first inner sidewall so that a gap is formed between the outer surface of the first inner sidewall and an inner surface of the first outer sidewall, the first outer sidewall concealing the openings in the first inner sidewall; and a second outer sidewall spaced apart from the second inner sidewall so that a gap is formed between the outer surface of the second inner sidewall and an inner surface of the second outer sidewall, the second outer sidewall concealing the openings in the second inner sidewall.

In a still further aspect, the invention may be a cabinet comprising: a housing defining a cavity having an opening, the housing comprising a first sidewall and a second sidewall opposite the first sidewall; a first support member coupled to the first sidewall and a second support member coupled to the second sidewall, each of the first and second support members comprising a receiving slot; a support rod extending from a first end to a second end, the first end of the support rod positioned within the receiving slot of the first support member and the second end of the support rod positioned within the receiving slot of the second support member; at least one storage receptacle having a mounting element; and wherein the at least one storage receptacle is slidably mounted to the support rod by the mounting element of the storage receptacle.

In another aspect, the invention may be a cabinet comprising: a housing defining a cavity having an opening, the housing extending from a bottom end to a top end along a longitudinal axis; at least one support member coupled to the housing and at least partially positioned within the cavity; a support rod supported within the cavity by the at least one support member; and at least one storage receptacle slidably mounted to the support rod.

In yet another aspect, the invention may be a cabinet comprising: a housing defining a cavity having an opening, the housing comprising a first sidewall and a second sidewall opposite the first sidewall; a first shelf support coupled to the first sidewall, the first shelf support comprising a first ledge extending from the first sidewall into the cavity, the first ledge comprising a top surface and a bottom surface, a first engagement feature located on the bottom surface of the first ledge; a second shelf support coupled to the second sidewall, the second shelf support comprising a second ledge extending from the second sidewall into the cavity, the second ledge comprising a top surface and a bottom surface, a second engagement feature located on the bottom surface of the second ledge; a shelf comprising first and second tabs, a first receiving slot being formed between the bottom surface of the shelf and the first tab and a second receiving slot being formed between the bottom surface of the shelf of the second tab; and wherein the shelf is supported in the cavity by the first and second shelf supports so that: (1) the bottom surface of the shelf rests atop the top surface of the first and second ledges; (2) a portion of the first ledge that comprises the first engagement feature extends into the first receiving slot such that the first engagement feature of the first shelf support mates with a first engagement feature of the shelf; and (3) a portion of the second ledge that comprises the second engagement feature extends into the second receiving slot such that the second engagement feature of the second shelf support mates with a second engagement feature of the shelf.

In a further aspect, the invention may be a cabinet comprising: a housing defining a cavity; at least one shelf support coupled to the housing, the at least one shelf support comprising a ledge extending from the housing into the cavity, the ledge comprising a top surface and a bottom surface, at least one protrusion extending from the bottom surface of the ledge; a shelf comprising at least one tab such that a receiving slot is formed between a bottom surface of the shelf and the at least one tab; and wherein the shelf is supported in the cavity, at least in part, by the top surface of the ledge of the at least one shelf support, and wherein a portion of the ledge that comprises the at least one protrusion nests within the receiving slot of the shelf.

In another aspect, the invention may be a cabinet comprising: a housing defining a cavity; at least one shelf support coupled to the housing, the at least one shelf support comprising a ledge extending from the housing into the cavity; a shelf comprising a bottom surface and at least one tab, a receiving slot formed between the at least one tab and the bottom surface of the shelf; and wherein the shelf is supported in the cavity, at least in part, by the ledge of the at least one shelf support with a portion of the ledge nesting within the receiving slot of the shelf.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
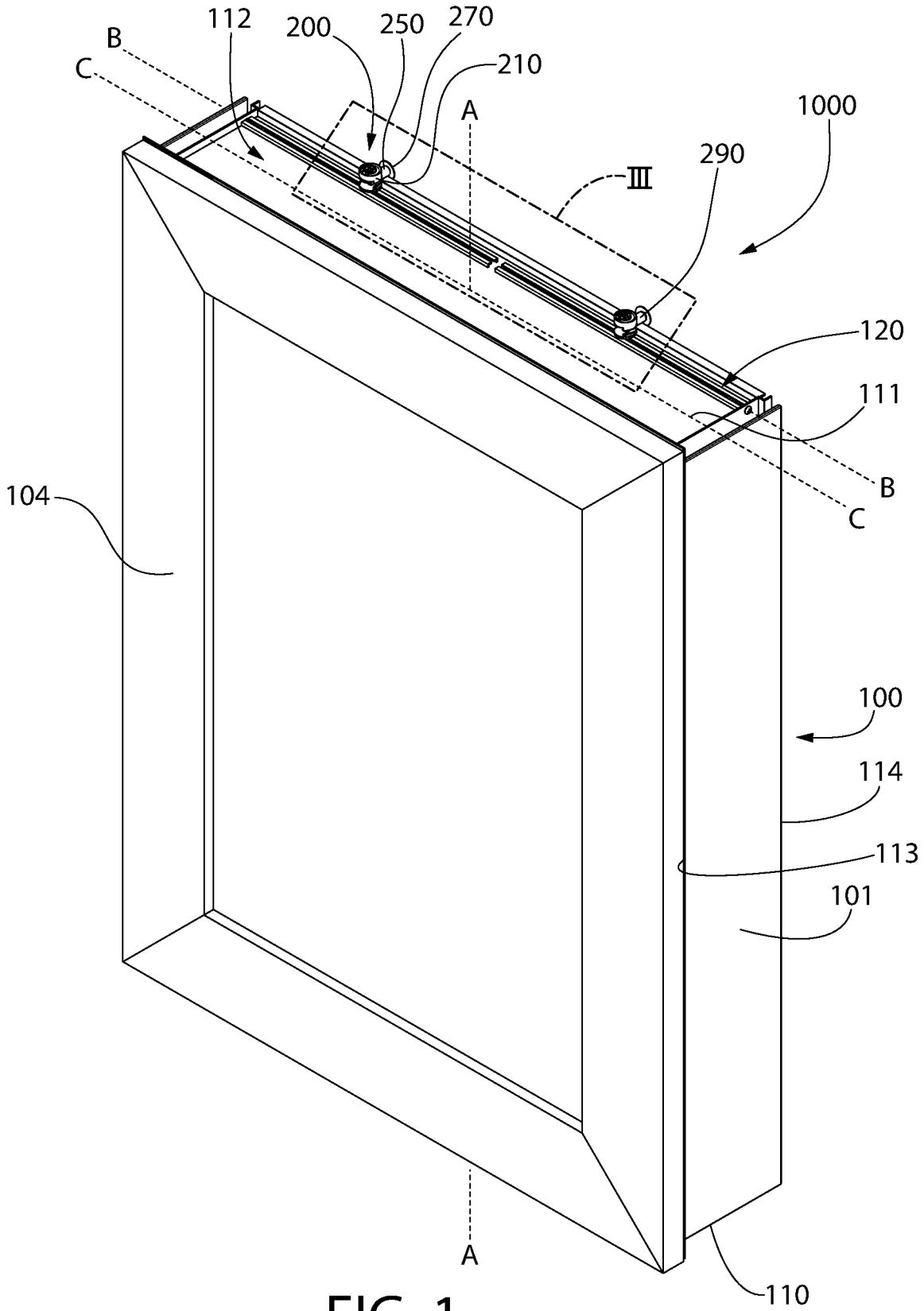
FIG. 1 is a front perspective view of system for hanging an article from a support surface in accordance with an embodiment of the present invention, the system including an article, at least one cam screw, and at least one cam lock.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Figure 2:
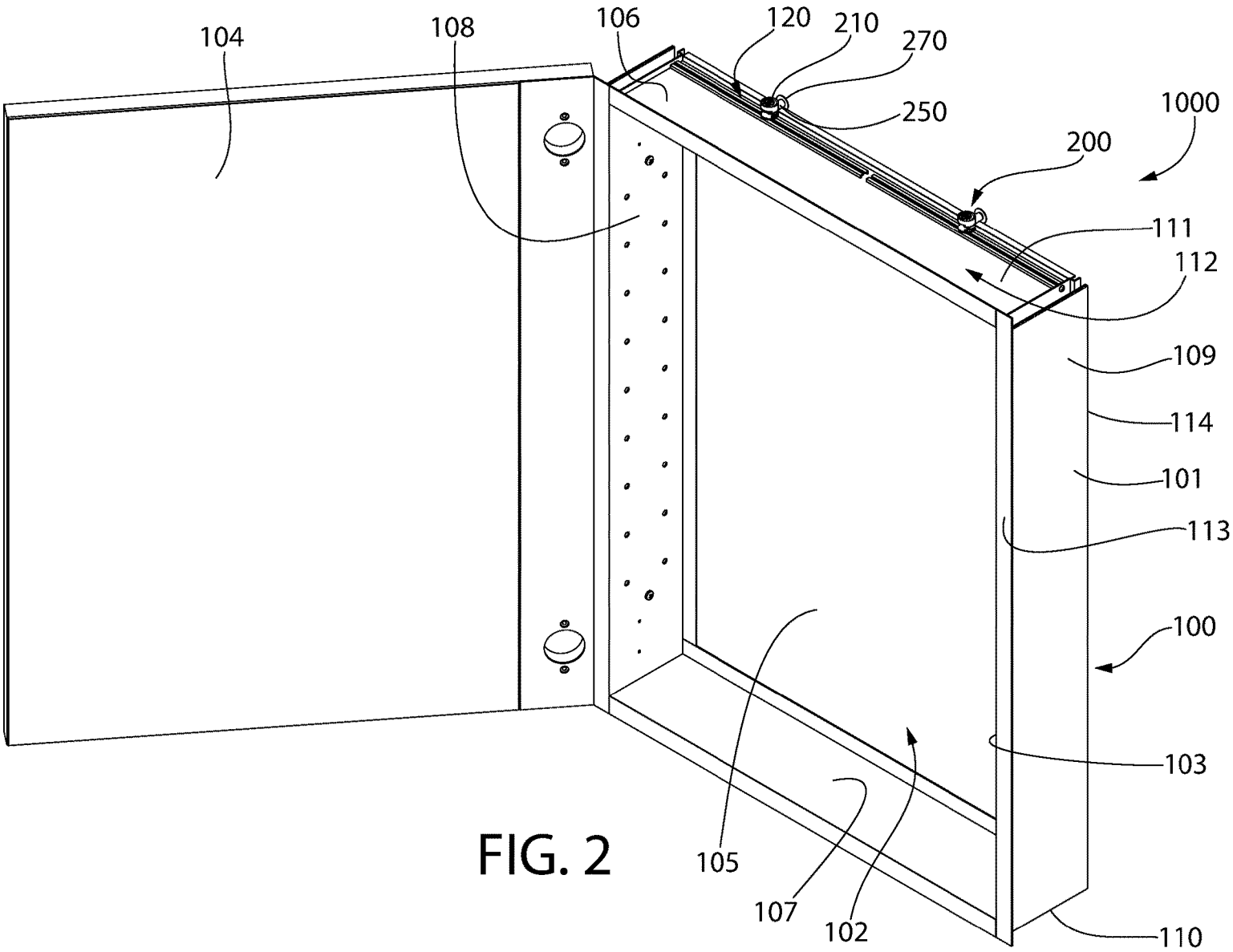
FIG. 2 is a front perspective view of the system of FIG. 1 with a door in an open state.

Referring to FIGS. 1 and 2, a system 1000 for hanging an article from a support surface is illustrated in accordance with an embodiment of the present invention. The system 1000 generally comprises an article 100 that is intended to be hung from a support surface and hardware 200 that is intended to facilitate the hanging of the article 100 from the support surface. In the exemplified embodiment, the hardware 200 comprises one or more cam locks 210 and one or more surface mounting elements 290. In the exemplified embodiment, the surface mounting elements 290 comprise one or more cam screws 250 and one or more wall anchors 270. However, the invention is not to be so limited and the surface mounting elements 290 may be nails, screws, clips, brackets, rings, clamps, pins, or any other device configured for mounting the article 100 from the support surface as described herein. In some embodiments, the surface mounting elements 290, or parts thereof, are configured to interact with the cam locks 210, to hang the article 100 from the support surface. Moreover, in some embodiments the hardware 200 may comprise cam screws 250 but the wall anchors 270 may be omitted, for example where the cam screw 250 is coupled to a stud within a wall and the additional support offered by the wall anchor 270 is not needed.

In the exemplified embodiment, the article 100 is a cabinet that is intended to be hung from an interior wall in a home or other building. More specifically, in the exemplified embodiment the article 100 is a medicine cabinet or the like that is intended to be hung in a bathroom to store items a person might need when in the bathroom. However, the invention is not to be so limited in all embodiments and the article 100 could alternatively be a kitchen cabinet, a household storage cabinet, or a non-cabinet type article such as a frame, a mirror, a poster or the like. In some embodiments, the article 100 could be any type of article that might be hung from a wall in a home or office. Thus, the article 100 of the article hanging system 1000 may be any type of item or article that is typically hung from a wall in a home, office, or other building or structure. In fact, in some embodiments the article 100 may be any item that is hung from a vertical surface regardless of whether it is interior (indoor) or exterior (outdoor).

In the exemplified embodiment, the article 100 comprises a housing 101 that defines a cavity 102 having an opening 103 and a door 104 that encloses the opening 103. As noted above, the article 100 need not be capable of storing items in all embodiments and thus it need not have a cavity 102 and door 104. In some embodiments, the article 100 may simply be a flat item, such as a picture frame or the like. Turning back to the exemplified embodiment, the housing 101 comprises a rear wall 105, a top wall 106, a bottom wall 107, a first sidewall 108, and a second sidewall 109 that collectively define the cavity 102. The first and second sidewalls 108, 109 may include openings or holes to facilitate coupling of shelf supports to the first and second sidewalls 108, 109. Shelves may then be placed within the cavity 102 and supported by the shelf supports. Although not illustrated, such shelves may provide horizontal support surfaces for holding various items. The door 104 may comprise a mirrored outer surface in some embodiments although this is not required. In the exemplified embodiment, the door 104 is coupled to the housing 101 via one or more hinges so that the door 104 may be altered between a closed state as illustrated in FIG. 1 and an open state as illustrated in FIG. 2.

In the exemplified embodiment the housing 101 and the cavity 102 are square or rectangular shaped. Thus, in the exemplified embodiment the housing 101 includes the top wall 106, the bottom wall 107, the first sidewall 108, and the second sidewall 109 extending from the rear wall 105. However, the invention is not to be so limited in all embodiments and the housing 101 may have any desired polygonal shape and can even be circular. Thus, the number of sidewalls extending from the rear wall 105 may be different than that shown in the exemplified embodiment and is dictated by the overall shape of the housing 101 and cavity 102. Furthermore, in some embodiments the terms first and second sidewall may merely refer to different portions of a singular wall, for example where the housing 101 has a round or circular shape. In some embodiments, the first and second sidewalls 108, 109 as used herein may refer to any of one or more sidewalls that extends between the top and bottom walls 106, 107.

The article 100 extends from a bottom end 110 to a top end 111 along a longitudinal axis A-A. The top end 111 of the article 100 comprises a top surface 112. Furthermore, the article 100 comprises an elongated mounting element 120 that facilitates coupling of the cam locks 210 to the article 100. In the exemplified embodiment, there are two of the cam locks 210 coupled to the article 100 on opposite sides of the longitudinal axis A-A of the article 100. As will be described in greater detail below, this assists in making sure that the article 100 is hung in a level manner and also enables the article 100 to be slid horizontally along a wall that it is hanging from. Of course, in other embodiments a single cam lock 210 may be coupled to the article 100 to hang the article 100 from a support surface (e.g., wall), and in still other embodiments it is possible that more than two cam locks 210 may be coupled to the article 100 to hang the article 100 from the support surface.

In the exemplified embodiment, the elongated mounting element 120 is a mounting channel and the description below will be made with reference to the mounting channel 120. However, the elongated mounting element 120 need not be a mounting channel 120 in all embodiments. Thus, the elongated mounting element 120 could be a protuberance rather than a channel. However, the elongated mounting element 120 should be configured to interact with the cam locks 210 so that one or more of the cam locks 210 are slidably mounted to the elongated mounting element 120.

As noted above, the elongated mounting element 120 is a mounting channel in the exemplified embodiment, and thus the term "mounting channel 120" is used below to describe this feature, it being understood that the "mounting channel 120" could be a mounting protuberance or some other structure in alternative embodiments. In the exemplified embodiment, the mounting channel 120 is located at the top end 111 of the article 100. However, the invention is not to be so limited in all embodiments and it is possible that in other embodiments the mounting channel 120 may be located on a rear surface of the article 100, on a bottom surface of the article 100, on a side surface of the article 100 or elsewhere. However, forming the mounting channel 120 at the top end 111 of the article 100 may be preferred in some embodiments as it enables the article 100 to be adequately mounted to the support surface while also permitting the article 100 to move horizontally along the support surface, as described in more detail herein below.

In the exemplified embodiment, the mounting channel 120 is elongated along a channel axis B-B that is perpendicular to the longitudinal axis A-A of the article 100. Furthermore, the top surface 112 of the article 100 extends between the first and second sidewalls 108, 109 of the housing 101 along an axis C-C that is equidistant from a front surface 113 of the housing 101 and a rear surface 114 of the housing 101. The mounting channel 120 is located between the axis C-C of the top surface 112 of the article 100 and the rear surface 114 of the housing 101. Thus, the mounting channel 120 is located closer to the rear surface 114 of the housing 101 than the front surface 113 of the housing 101. This helps to enable a cam screw 250 (or other surface mounting element 290) that is protruding from the support surface to be able to couple to one of the cam locks 210 located within the mounting channel 120. The further the mounting channel 120 is from the rear surface 114 of the housing 101, the further the mounting hardware or surface mounting element must protrude from the support surface to facilitate coupling of the mounting hardware to the cam locks 210 in the mounting channel 120.

Figure 3A:
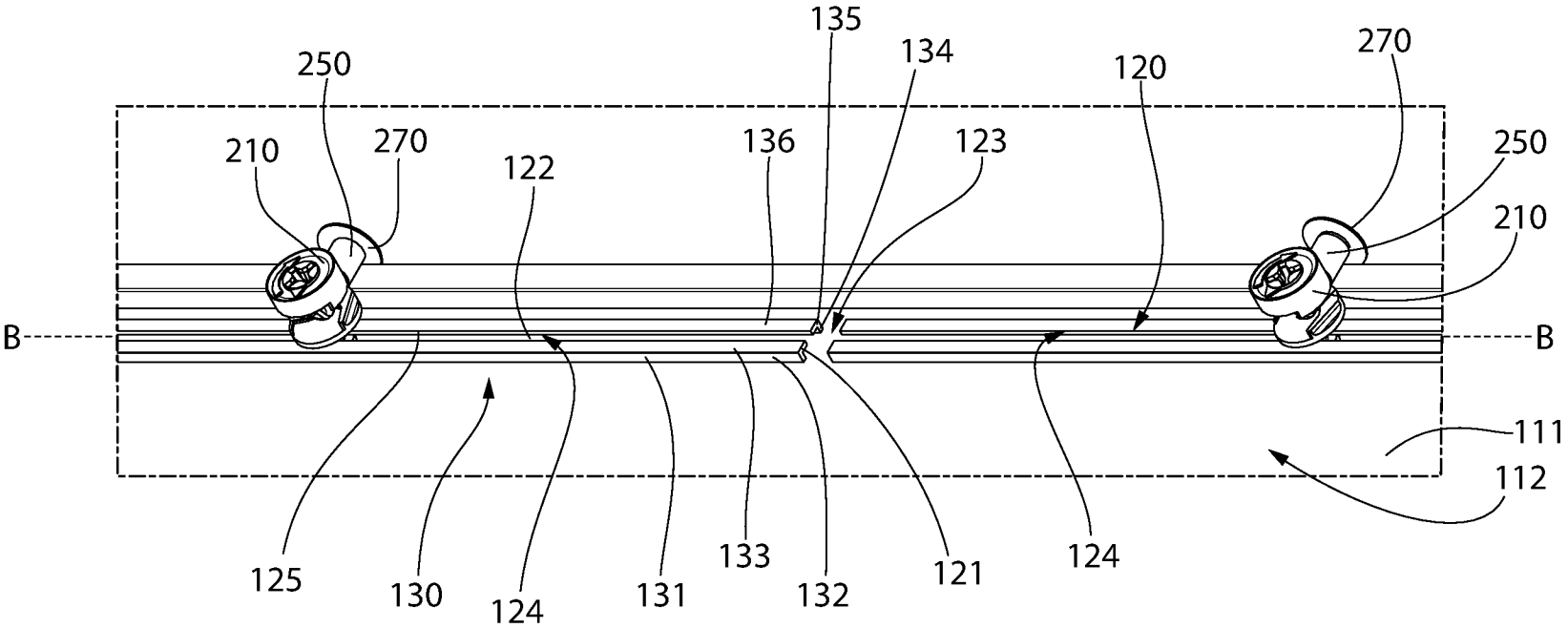
FIG. 3A is a close-up of area III of FIG. 1.

Referring to FIG. 3A, a close-up view of a portion of the mounting channel 120 is provided in accordance with an embodiment of the present invention. The mounting channel 120 is generally a channel or other slot-like feature that is formed integrally with the article 100 to facilitate hanging of the article 100 from a support surface. Thus, in the exemplified embodiment the mounting channel 120 is not formed by a structure that is distinct from and coupled to the article 100, but rather the mounting channel 120 is formed as a part of the article 100. Of course, the mounting channel 120 could be formed by a separate component that is coupled to the article 100 in other embodiments. As will be discussed in more detail below, the cam locks 210 are coupled to the article 100 by positioning portions of the cam locks 210 within the mounting channel 120. The cam locks 210 are able to support the weight of the article 100 without becoming detached from the article 100 due to the relative cross-sectional profiles of the portions of the cam locks 210 that are located within the mounting channel 120 and the open top end of the mounting channel 120.

In the embodiment exemplified in FIG. 3A, the mounting channel 120 is defined by a bracket 130 protruding from the top surface 112 of the article 100. The bracket 130 comprises a first bracket member 131 and a second bracket member 134 that are spaced apart from one another as they extend along the top end 111 of the article 100 in the direction of the channel axis B-B. Thus, the mounting channel 120 is defined between the first and second bracket members 131, 134.

The first bracket member 131 comprises a first wall 132 extending from the top surface 112 of the article 100 and a second wall 133 extending from a distal end of the first wall 132 towards the rear surface 114 of the housing 101. The second bracket member 134 comprises a third wall 135 extending from the top surface of the article 100 and a fourth wall 136 extending from a distal end of the third wall 135 towards the front surface 113 of the housing 101. In the exemplified embodiment, the first and third walls 132, 135 extend vertically in a direction of the longitudinal axis A-A of the article 100 and the second and fourth walls 133, 136 extend horizontally, in a direction transverse to the longitudinal axis A-A of the article 100. In the exemplified embodiment, each of the first and second bracket members 131, 134 are L-shaped members (they have L-shaped cross-sectional profiles taken transverse to the channel axis B-B) that are elongated along the channel axis B-B. However, the invention is not to be so limited in all embodiments and various shapes and configurations are possible for the first and second bracket members 131, 134 in other embodiments as long as the bracket 130 achieves the function described herein. For example, although in the exemplified embodiment the second and fourth walls 133, 136 extend horizontally or at right angles to the first and third walls 132, 135, in other embodiments the second and fourth walls 133, 136 may extend at acute angles from the first and third walls 132, 135 without affecting the functionality of the bracket 130.

The second wall 133 of the first bracket member 131 and the fourth wall 136 of the second bracket member 134 extend from the first and third walls 132, 135, respectively, in a direction towards each other. Thus, the mounting channel 120 comprises a lower portion 121 defined between the first and third walls 132, 135 and an upper portion 122 defined between the second and fourth walls 133, 136. Because the second and fourth walls 133, 136 extend towards each other, the lower portion 121 of the mounting channel 120 has a larger transverse cross-sectional area than the upper portion 122 of the mounting channel 120. Stated another way, the lower portion 121 of the mounting channel 120 has a greater width, measured in a direction transverse to the channel axis B-B, than the upper portion 122 of the mounting channel 120. This allows a portion of the cam lock 210 to nest within the lower portion 121 of the mounting channel 120 while being prevented from being removed from the mounting channel 120 without first sliding the cam lock 210 to an entry section of the mounting channel 120, as described below. The mounting channel 120 comprises an open top end 125 that provides access into the upper portion 122 of the mounting channel 120.

Still referring to FIG. 3A, the mounting channel 120 comprise an entry section 123 and a nesting section 124. The entry section 123 is provided to enable a portion of the cam lock 210 to enter into the mounting channel 120 because the cam lock 210 is unable to pass through the open top end 125 of the mounting channel 120 within the nesting section 124 of the mounting channel 120. In the exemplified embodiment, the entry section 123 is formed by a gap or break in the bracket 120. Specifically, at the location of the gap the first and second walls 132, 135 do not exist. The gap has a cross-sectional profile that is sufficiently sized and shaped to permit the portion of the cam lock 210 to enter into the mounting channel 120 through the entry section 123. Forming the entry section 123 via the gap in the bracket 120 is merely one exemplified embodiment.

Figure 9A:
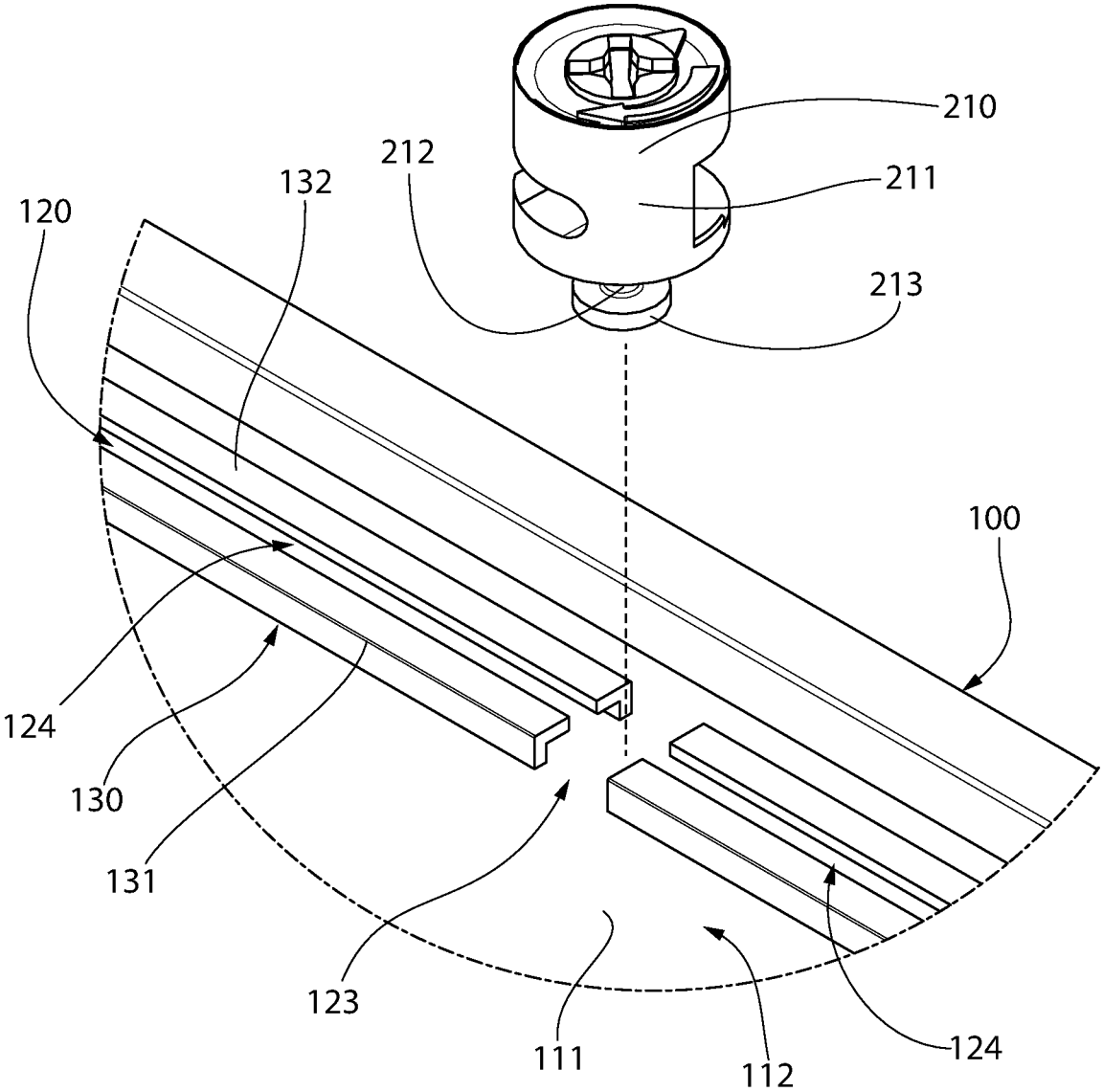
FIG. 9A is a partial top perspective view of the system of FIG. 1 illustrating the cam lock being inserted into a mounting channel of the article.
Figure 9B:
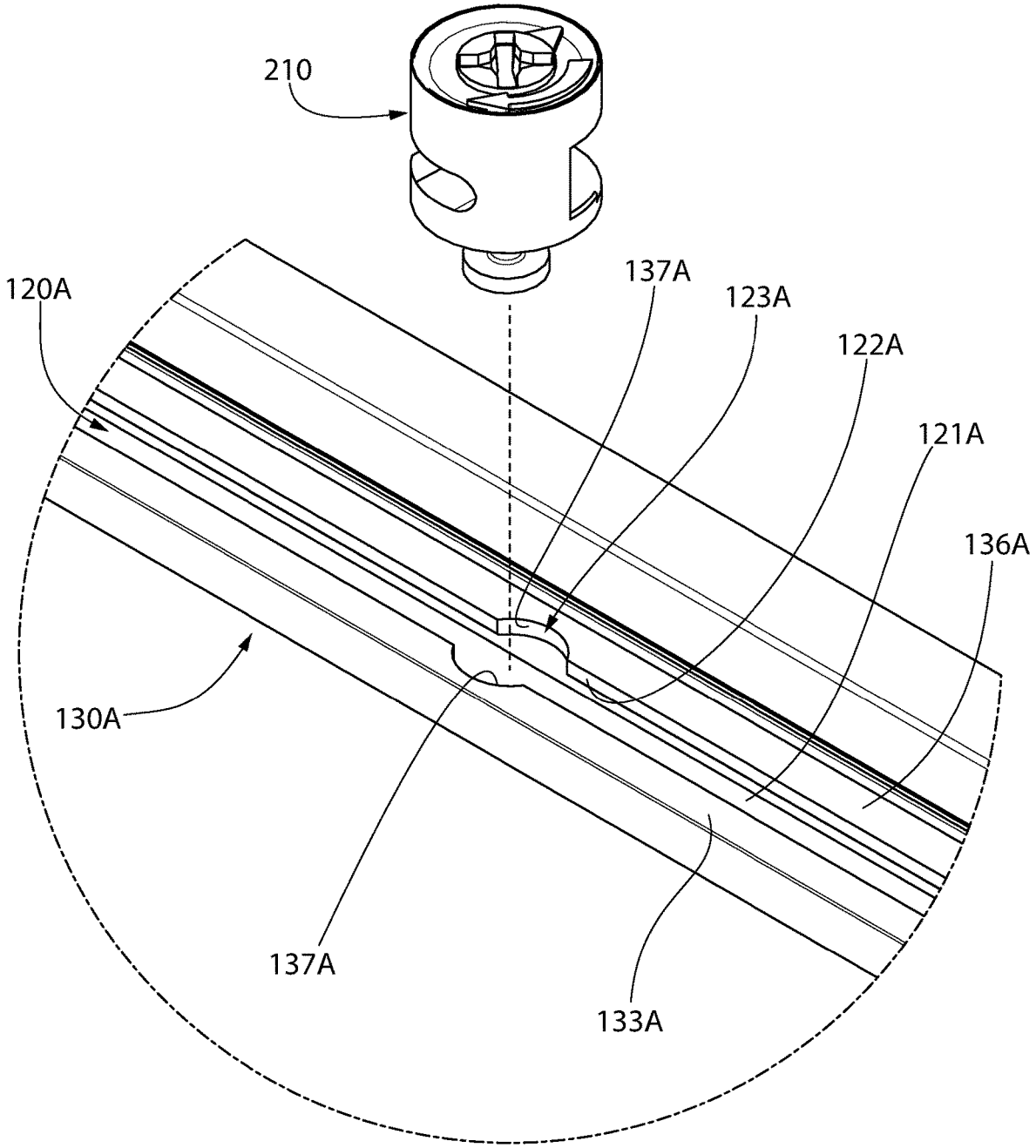
FIG. 9B is a partial top perspective view of an alternative embodiment of the system of FIG. 1 illustrating the cam lock being inserted into the mounting channel of the article.

FIG. 9B illustrates an alternative embodiment whereby the entry section 123A of the mounting channel 120A is formed by a region of the upper portion 122A of the mounting channel 120A having an increased size that permits the portion of the cam lock 210 to enter into the mounting channel 120A. Specifically, in FIG. 9B there is no gap in the bracket 130 forming the mounting channel 120, but rather the mounting channel 120 has an increased width at the entry section 123A. More specifically, in this embodiment the second and fourth walls 133A, 136A of the bracket 130A have a notch or cutout 137A that are aligned with one another. The notches 137A collectively have a diameter that permits a portion of the cam lock 210 to enter into the mounting channel 120A at the entry section 123A. More specifically, as seen in FIG. 9B the portion of the cam lock 210 that is located within the mounting channel 120 when the cam lock 210 is coupled to the article 100 is round. Thus, the entry section 123A of the mounting channel 120A defined by the notches 137A is also round and with a larger diameter than the portion of the cam lock 210 so that the portion of the cam lock 210 can enter into the mounting channel 120A through the entry section 123A. This will be described in more detail below. Of course, the entry section 123A and the portion of the cam lock 210 may have other complementary shapes so long as the portion of the cam lock 210 can pass into the mounting channel 120 via the entry section 123A.

Figure 3B:
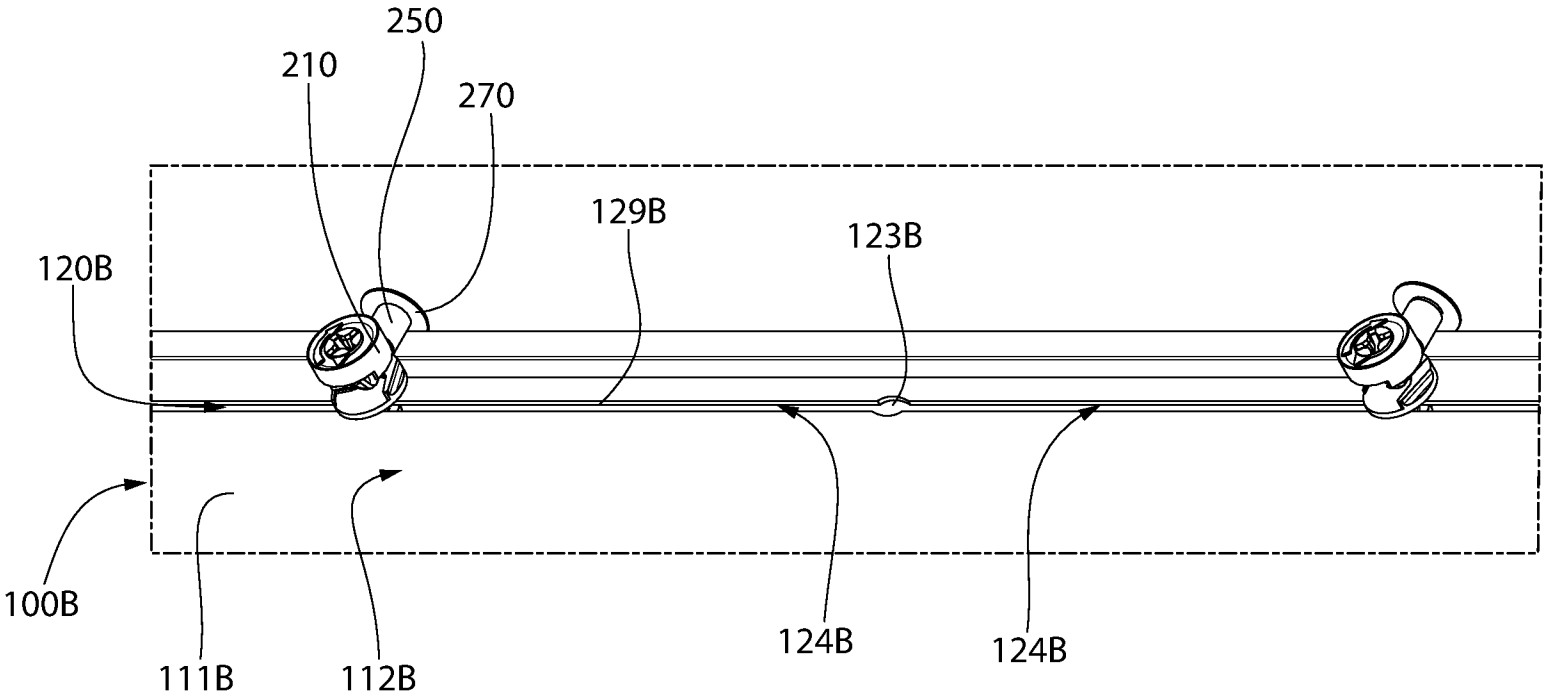
FIG. 3B is a close-up view of area III of FIG. 1 in accordance with an alternative embodiment of the present invention.
Figure 5:
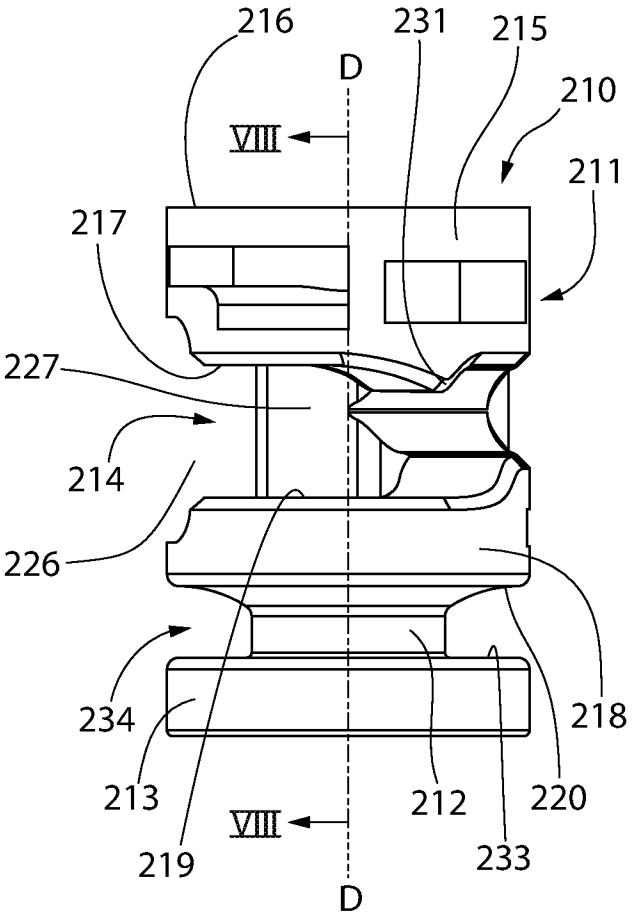
FIGS. 4-7 are perspective, front, and side views of a cam lock of the system of FIG. 1.
Figure 4:
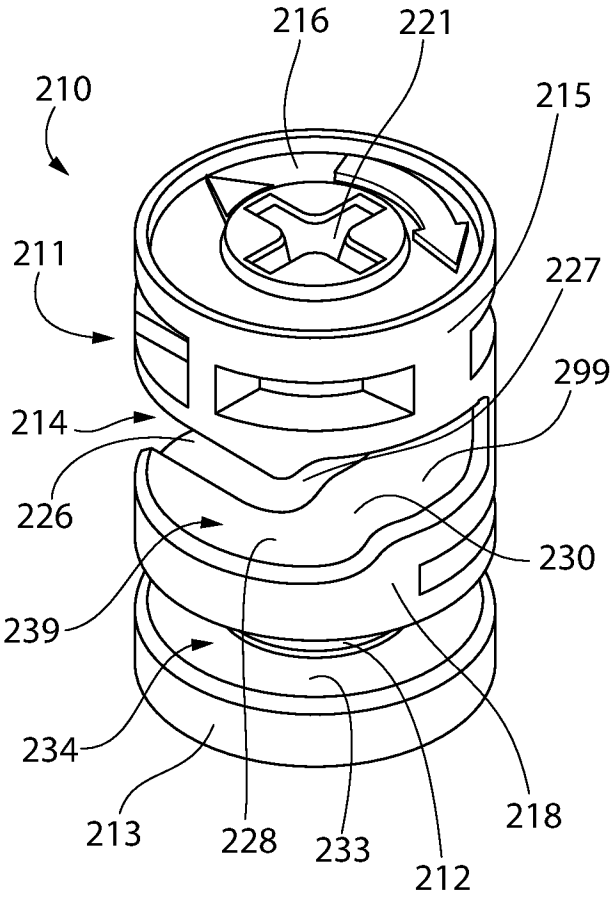
Figure 7:
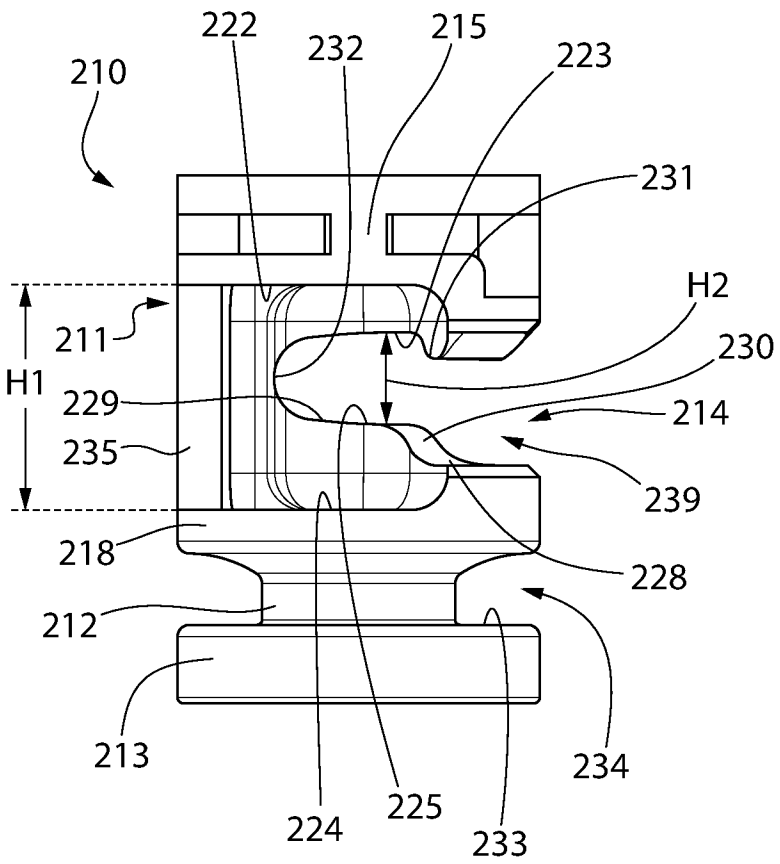
Figure 6:
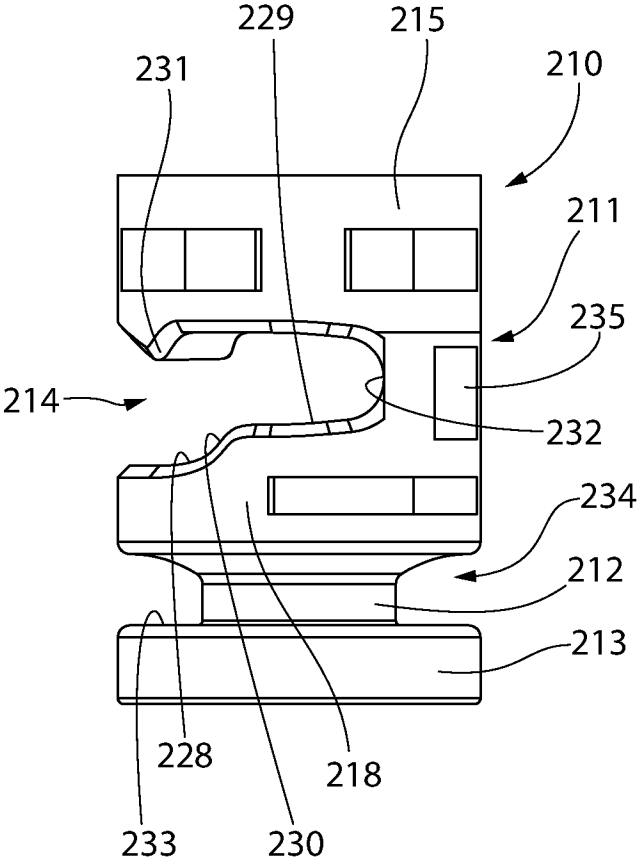
Figure 8:
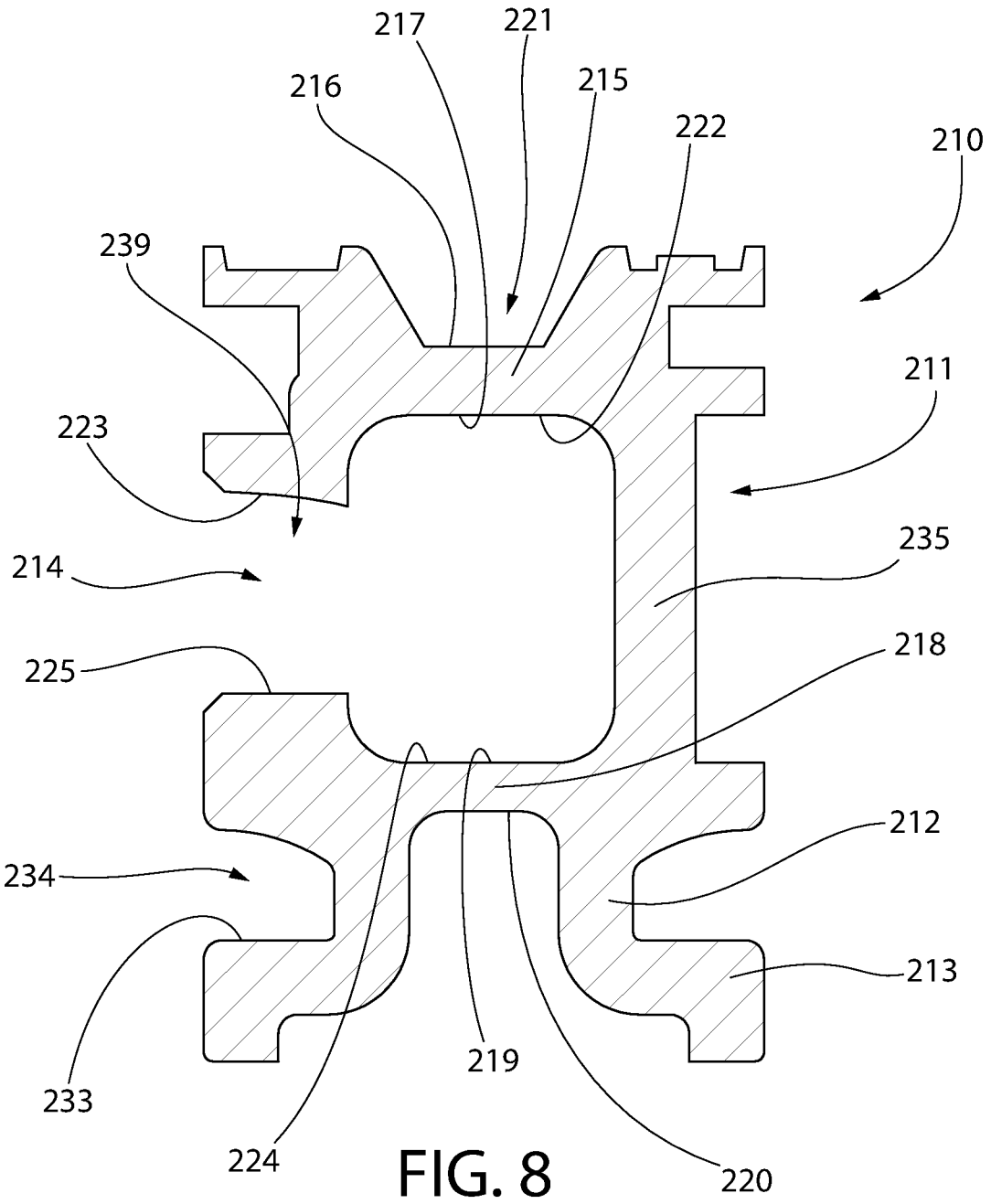
FIG. 8 is a cross-sectional view taken along line VIII-VIII in FIG. 5.

Referring to FIG. 3B, another alternative embodiment is illustrated wherein the mounting channel 120B is not formed by any brackets extending from the top end 111B. Rather, in FIG. 3B the mounting channel 120B is defined by a slot 129B that is formed directly into the top surface 112B of the article 100B. The slot 129B is an elongated opening that is formed directly into the top surface 112B of the article 100B. The slot 129B has an entry section 123B similar in shape to the entry section 123A shown in FIG. 9B and discussed above. Again, the portion of the cam lock 210 that is located within the mounting channel 120B when the cam lock 210 is coupled to the article 100B can only pass into the mounting channel 120B within the entry section 123B thereof. Thus, once the portion of the cam lock 210 is in the nesting section 124B of the mounting channel 120B, the cam lock 210 is coupled to the article 100B and can support the article 100B from the support surface. The manner of coupling the cam lock 210 to the article 100 will be described in greater detail below with reference to FIGS. 9A-11. As noted above, in other embodiments the mounting channel 120 may be replaced with a mounting protuberance and the cam lock 210 may include a slot that receives the mounting protuberance of the article 100. Variations of this type are possible and fall within the scope of the invention as disclosed herein.

Referring to FIGS. 4-8 concurrently, the cam lock 210 will be described. Generally speaking, a cam lock is a hardware component that is capable of being coupled to a head portion of a screw or nail having a specific structure. In the embodiment disclosed herein, the screw is referred to as a cam screw, although other types of hardware can be used in place of the cam screw, such as a standard screw, a nail, a bracket having protruding features that are similar in shape to the head/neck of a screw, or the like. In the exemplified embodiment, the cam lock 210 is coupled to the cam screw by placing the head portion of the screw within an opening in the cam lock and then rotating the cam lock relative to the head portion of the screw. This rotation creates a secure connection between the cam lock and the cam screw, as will be better understood from the description provided herein below, particularly with reference to FIGS. 16-18.

The cam lock 210 comprises a main body (also referred to herein as a second portion) 211, a stem 212 extending from the main body 211, and a flange (also referred to herein as a first portion) 213 extending radially from the stem 212. The main body 211 is coupled to a first end of the stem 212 and the flange 213 extends from a second end of the stem 212 that is opposite the first end.

The main body 211 of the cam lock 210 defines a receiving cavity 214 that is configured to receive a head and a neck of a cam screw to couple the cam lock 210 to the cam screw. In previously known cam locks, the main body 211 forms the entirety of the component. Thus, the stem 212 and the flange 213 are not formed as a part of a conventional cam lock. The stem 212 and the flange 213 are included in the cam lock 210 of the present invention to facilitate coupling of the cam lock 210 to the article 100, and specifically to the mounting channel 120 of the article 100. Thus, when the cam lock 210 is coupled to the article 100, the flange (or first portion) 213 of the cam lock 210 is located within the mounting channel 120, the stem 212 passes through the open top end 125 of the mounting channel 120, and the main body (or second portion) 211 of the cam lock 210 protrudes from the mounting channel 120.

The main body 211 comprises a top portion 215 having a top surface 216 and a bottom surface 217 and a bottom portion 218 having a top surface 219 and a bottom surface 220. The top and bottom portions 215, 218 are connected by a sidewall 235, and thus the main body 211 of the cam lock 210 has a generally C-shaped cross-sectional profile (see FIG. 8). The receiving cavity 214 is defined between the bottom surface 217 of the top portion 215 and the top surface 219 of the bottom portion 216 of the main body 211. The top surface 216 of the top portion 215 comprises a recess 221 or other configuration that is configured to receive a working end of a tool for rotating the cam lock 210 about a longitudinal axis D-D of the cam lock 210. The tool may be a screw driver and thus the recess 221 may have a cross-shape or a slot-shape for being engaged by a Phillips head or slot head screwdriver.

The bottom surface 217 of the top portion 215 of the main body 211 comprises a base surface 222 and an upper cam surface 223. The top surface 219 of the bottom portion 218 of the main body 211 comprises a base surface 224 and a lower cam surface 225. The receiving cavity 214 comprises an entry section 226 and a nesting section 227. Furthermore, the cam lock 210 comprises a cam slot between the upper and lower cam surfaces 223, 225. In the exemplified embodiment, the cam slot 239 is circumferentially aligned with the entry section 226 of the receiving cavity 214.

The upper cam surface 223 is at a different elevation than the base surface 222 and the lower cam surface 225 is at a different elevation than to the base surface 224. Thus, the receiving cavity 214 comprises a first maximum height H1 measured between the base surfaces 222, 224 and the cam slot 239 comprises a second maximum height H2 measured between the upper and lower cam surfaces 223, 225, the first maximum height H1 being greater than the second maximum height H2.

The lower cam surface 225 comprises a first portion 228, a second portion 229, and ramp 230 between the first and second portions 228, 229. The first portion 228 of the lower cam surface 225 is elevated (or raised) relative to the base surface 224 and the second portion 229 of the lower cam surface 225 is elevated (or raised) relative to the first portion 228 of the lower cam surface 225. The ramp 230 connects the first and second portions 228, 229 and is inclined relative to the first portion 228, thereby creating this difference in elevations of the first and second portions 228, 229. The upper cam surface 223 comprises an anti-rotation feature 231, which in the exemplified embodiment is a protuberance that extends downwardly into the cam slot 239. In the exemplified embodiment, the anti-rotation feature 231 is axially aligned with the first portion 228 of the lower cam surface 225. The anti-rotation feature 231 could also be axially aligned with the ramp 230 of the lower cam surface 225 while achieving the same purpose as set forth below.

Figure 18:
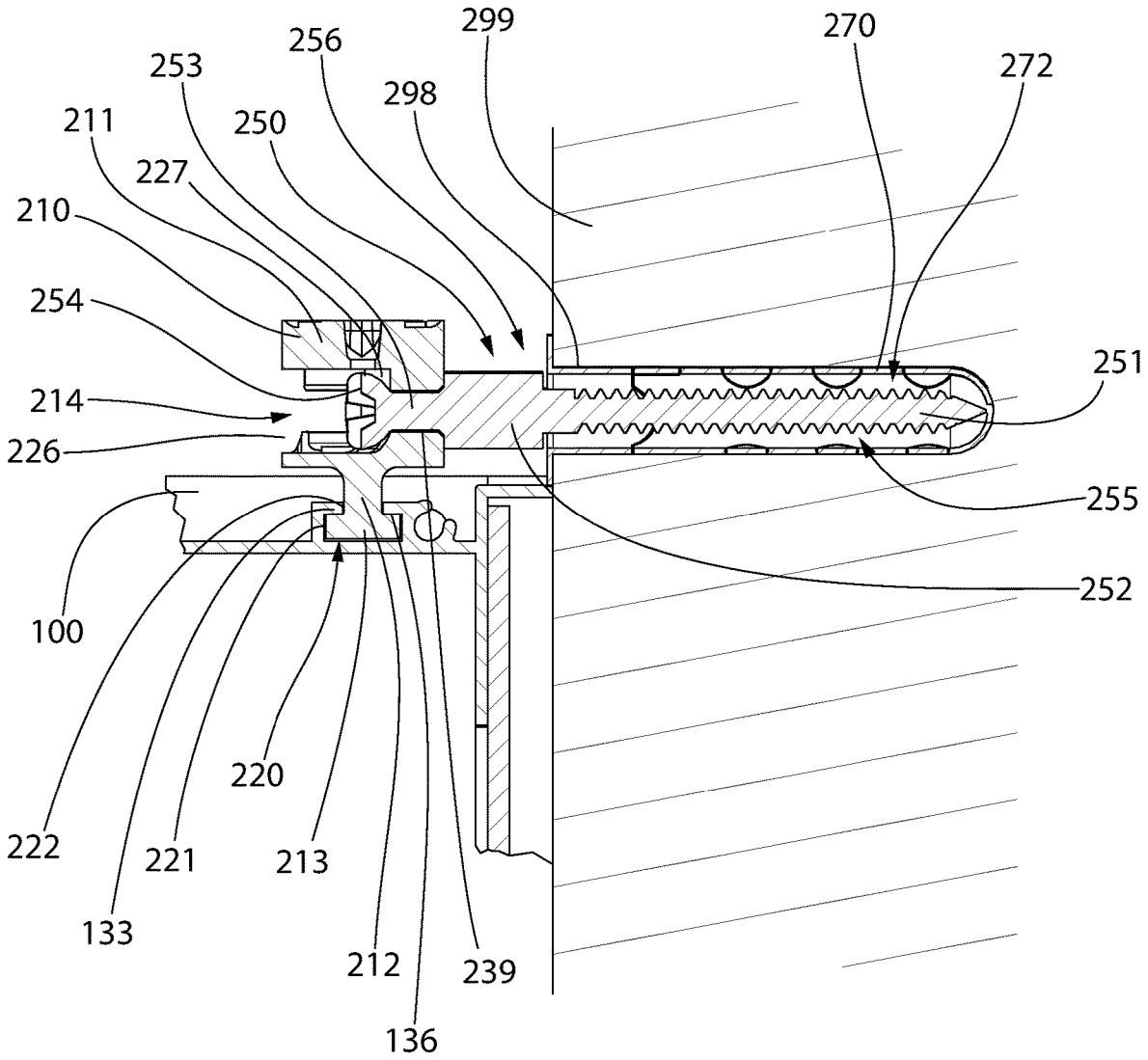
FIG. 18 is a cross-sectional view taken along line XVIII-XVIII of FIG. 17.

The combination of the change in elevations between the first and second portions 228, 229 of the lower cam surface 225 and the anti-rotation feature 231 of the upper cam surface 223 effectively prevent accidental de-coupling of the cam lock 210 from a cam screw. To couple a cam screw to the cam lock 210, the head and neck of the cam screw are inserted into the receiving cavity 214. Next, the cam lock 210 is rotated in a clockwise direction relative to the head and neck of the cam screw. As the cam lock 210 is rotated, the neck of the cam screw rides along the upper and lower cam surfaces 223, 225 until it abuts against the end wall 232 and the cam lock 210 can no longer be rotated. At this point, the cam screw is securely coupled to the cam lock 210 (as best shown in FIG. 18). Furthermore, if the cam lock 210 were to be accidentally rotated in a counter-clockwise direction, the neck of the cam screw would contact the anti-rotation feature (i.e., protuberance) 231, thereby effectively preventing the cam lock 210 from being rotated a sufficient amount to de-couple the cam lock 210 from the cam screw.

A user must purposefully rotate the cam lock 210 in the counter-clockwise direction to get the neck of the cam screw past the anti-rotation feature 231 to de-couple the cam lock 210 from the cam screw (or the accidental rotation would have to be at a sufficient force to move the neck of the cam screw past the anti-rotation feature 231).

As noted above, the stem 212 extends from the bottom surface 220 of the bottom portion 218 of the main body 211. The flange 213 extends radially from the stem 212. As a result, a top surface 233 of the flange 213 is spaced apart from the bottom surface 220 of the bottom portion 218 of the main body 211 by a gap 234. The gap 234 is an annular gap that circumferentially surrounds the stem 212. When the cam lock 210 is coupled to the article 100, a portion of the article 100 nests within the gap 234 and rests on the top surface 233 of the flange 213 so that the flange 213 axially supports the article 100. In the exemplified embodiment, the flange 213 has a circular shape. However, the invention is not to be so limited and the flange 213 may be square or otherwise shaped so long as it is able to fit into the mounting channel 210 as has been described herein.

As noted above, throughout the description and claims, the flange 213 of the cam lock 210 may be referred to as the first portion of the cam lock 210 and the main body 211 of the cam lock 210 may be referred to as the second portion of the cam lock 210. It should be appreciated that when the first portion of the cam lock 210 is referenced in the claims and disclosure, the description of the flange 213 is applicable and when the second portion of the cam lock 210 is referenced in the claims and disclosure, the description of the main body 211 is applicable.

Referring to FIGS. 9A-11, the manner in which the cam locks 210 are coupled to the mounting channel 120 of the article 100 will be described. The mounting channel 120 is configured to receive the cam lock 210 therein so that the cam lock 210 can slide within the mounting channel 120 in a direction of the channel axis B-B. Specifically, the cam lock 210 can be inserted into the mounting channel 112 by aligning the cam lock 210 with the entry section 123 of the mounting channel 120 and then the cam lock 210 can be slid into and within the nesting section 124 of the mounting channel 120. The cam lock 210 can only be removed from the mounting channel 120 by moving the cam lock 210 back to the entry section 123 and then pulling the cam lock 210 in a direction away from the article 100. When the cam lock 210 is located within the nesting section 124 of the mounting channel 120, the cam lock 210 is slidably coupled to the mounting channel 120 of the article 100 and can be used to hang the article 100 from a support surface (e.g., wall or other vertical surface) as will be discussed in greater detail below. The first portion (or flange) 213 of the cam lock 210 is freely slidable within the mounting channel 120 in a direction parallel to the channel axis B-B while being substantially prevented from movement in a direction perpendicular to the channel axis B-B (either in a direction parallel to the longitudinal axis A-A of the article 100 or in direction between the front and rear surfaces 113, 114 of the housing 101).

Figure 10:
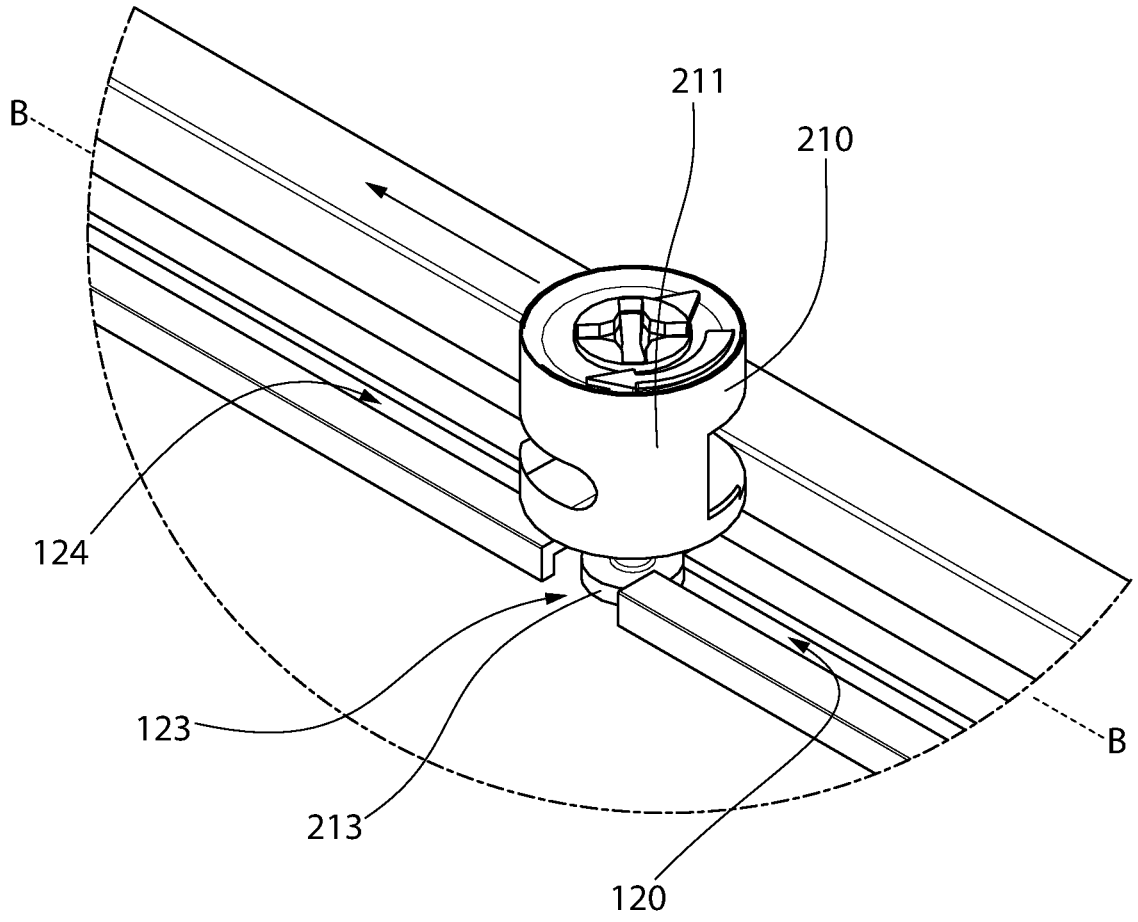
FIG. 10 is the partial top perspective view of the system of FIG. 9A illustrating the cam lock located within an entry section of the mounting channel of the article.
Figure 11:
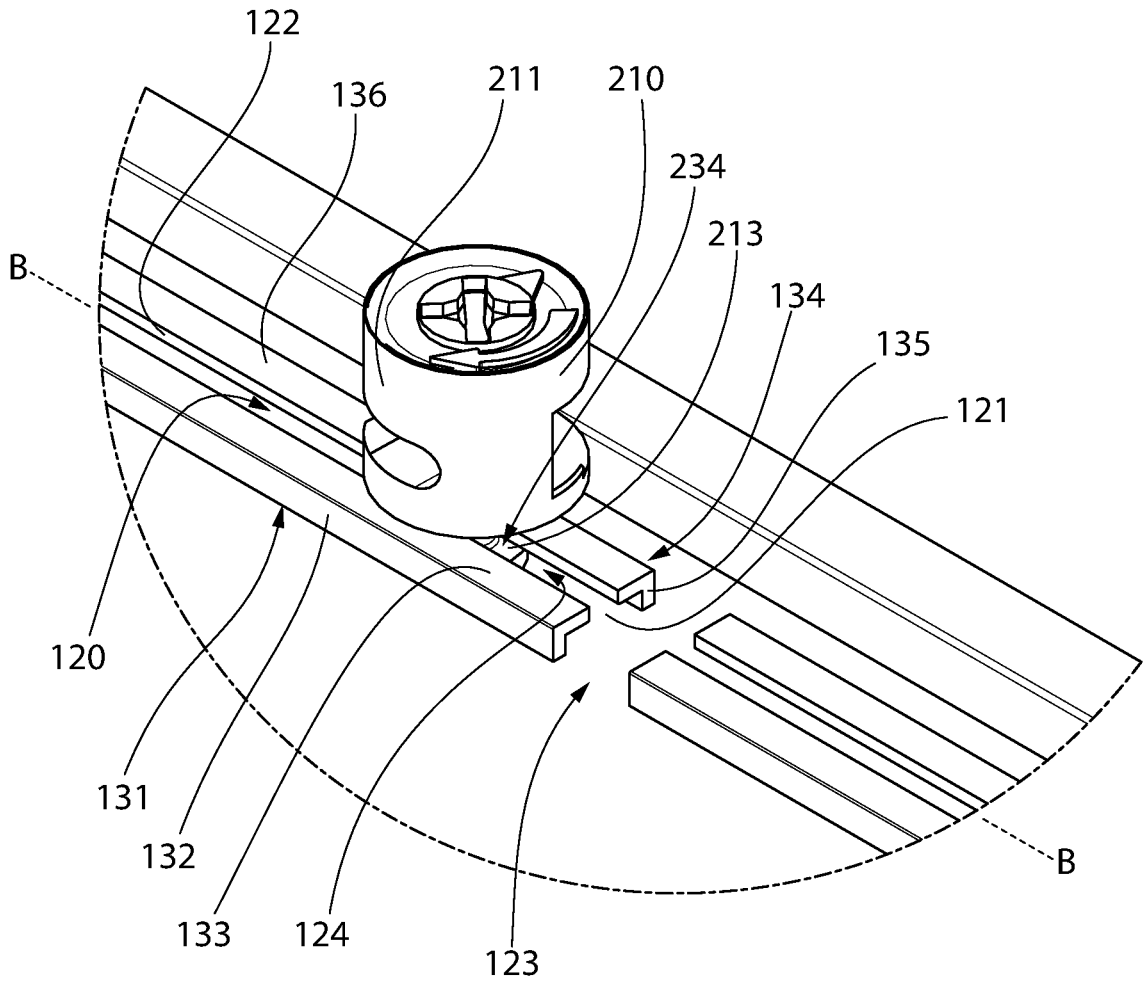
FIG. 11 is the partial top perspective view of the system of FIG. 9A illustrating the cam lock located within a nesting section of the mounting channel of the article.

FIGS. 9A and 9B are identical except with regard to the shape and/or structure of the entry section 123, 123A of the mounting channel 120, 120A, as described previously. Referring to FIGS. 9A, 9B, and 10, the flange or first portion 213 of the cam lock 210 is positioned adjacent to the entry section 123, 123A of the mounting channel 120, 120A. The cam lock 210 is then moved in a first direction towards the article 100 until the flange or first portion 213 of the cam lock 210 is located within the entry section 123, 123A of the mounting channel 120, 120A. Next, referring to FIGS. 10 and 11, the cam lock 210 is moved or translated in a second direction (i.e., in a direction of the channel axis B-B) that is perpendicular to the first direction, thereby moving the first portion or flange 213 of the cam lock 210 into the nesting section 124 of the mounting channel 120.

When the first portion or flange 213 of the cam lock 210 is located in the nesting section 124 of the mounting channel 120, the second and fourth walls 133, 136 extend over the first portion or flange 213 of the cam lock 210, thereby preventing the first portion or flange 213 of the cam lock 210 from being removed from the nesting section 124 of the mounting channel 120. Thus, interference between the second and fourth walls 133, 136 of the bracket 130 and the first portion or flange 213 of the cam lock 210 prevents the cam lock 210 from being removed from the mounting channel 120. Stated another way, the second and fourth walls 133, 136 of the bracket 130 are located within the gap 234 between the first portion/flange 213 and the second portion/main body 211. The only way to remove the first portion or flange 213 of the cam lock 210 from the mounting channel 120 is to slide the cam lock 210 over to the entry section 123 of the mounting channel 120 and then pull the cam lock 210 away from the article 100.

The first portion or flange 213 of the cam lock 210 can slide side-to-side in the direction of the channel axis B-B while remaining located within the nesting section 124 of the mounting channel 120. The cam lock 210 can also rotate about its longitudinal axis D-D while the first portion or flange 213 of the cam lock 210 is located in the nesting section 124 of the mounting channel 120. With the first portion or flange 213 of the cam lock 210 located in the nesting section 124 of the mounting channel 120, the second portion or main body 211 of the cam lock 210 protrudes from the mounting channel 120. More specifically, the first portion or flange 213 of the cam lock 210 is located in the lower portion 121 of the mounting channel 120, the stem 212 of the cam lock 210 extends through the upper portion 122 and the open top end 125 of the mounting channel 120, and the second portion of main body 211 of the cam lock 210 protrudes from the mounting channel 120. As a result, the second portion or main body 211 of the cam lock 210 is accessible for coupling to a surface mounting element (e.g., a cam screw) that is coupled to a support surface, as described herein below. When the first portion or flange 213 of the cam lock 210 is located within the nesting section 124 of the mounting channel 210, the first portion or flange 213 of the cam lock 210 can support the full weight of the article 100. Thus, one could support the article 100 from above by gripping the second portion/main body 211 of the cam lock 210 (or coupling it to a cam screw that is coupled to a support surface) while the first portion/flange 213 of the cam lock 210 is located in the nesting section 124 of the mounting channel 120.

Figure 12:
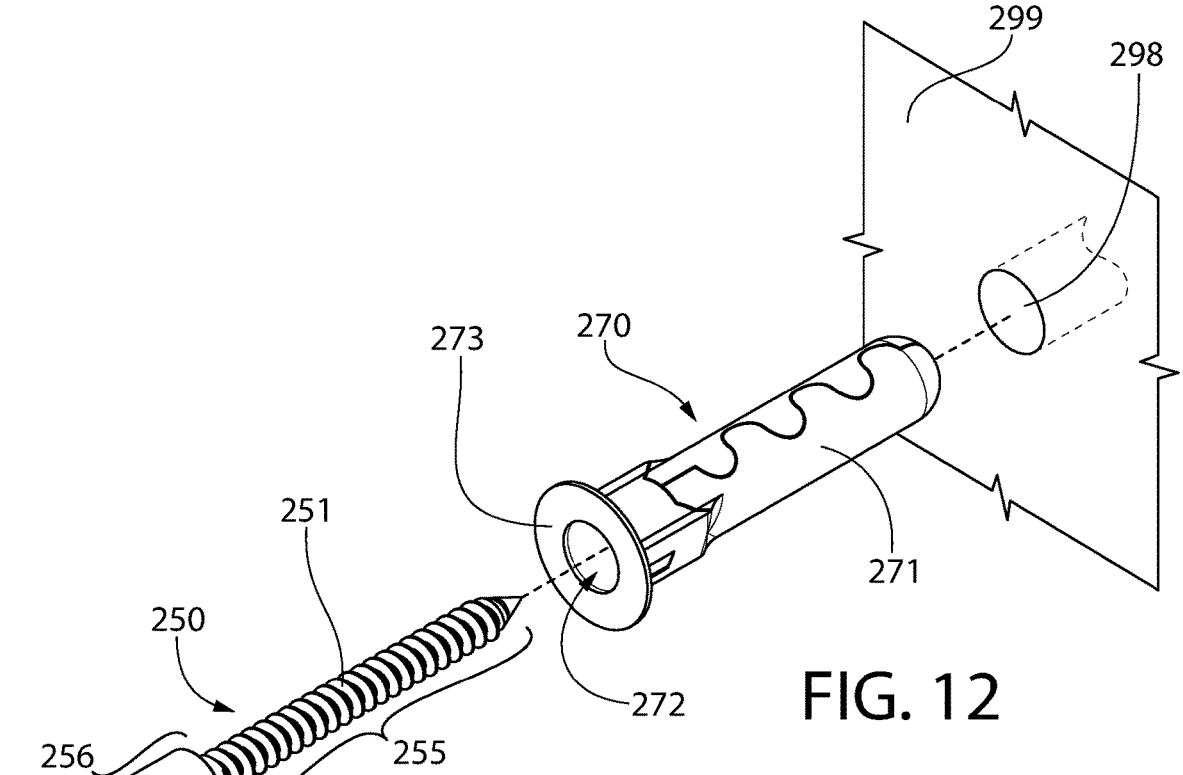
FIG. 12 is a perspective view of a cam screw and a wall anchor of the system of FIG. 1 being inserted into a support surface for hanging the article.
Figure 13:
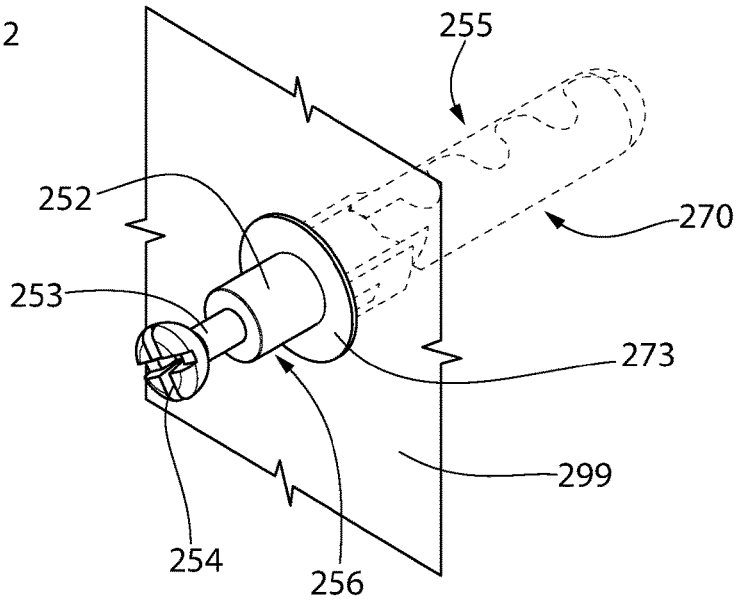
FIG. 13 is a perspective view of the cam screw and the wall anchor of FIG. 12 coupled to the support surface.

Referring to FIGS. 12 and 13, the coupling of the cam screw 250 and the anchor 270 to a support surface 299 (e.g., wall or other vertical surface) is illustrated. As noted above, the cam screw 250 and/or anchor 270 is merely one embodiment of a surface mounting element 290 that may be used to mount the article 100 to the support surface, and any of the other components or elements described herein can be used as an alternative to the cam screw 250 and anchor 270. The anchor 270 comprises a main portion 271 with an internal cavity 272 and a flange 273 that surrounds an opening into the internal cavity 272. As noted above, in some embodiments the anchor 270 may be omitted if it is determined that the cam screw 250 can sufficiently support the article 100 without the added support offered by the anchor 270. The anchor 270 may be formed of plastic or metal and may be specifically configured to support the weight of the article 100.

The cam screw 250 includes a threaded portion 251, a thickened portion 252 adjacent to the threaded portion 251, a neck portion 253 adjacent to the threaded portion 252, and a head 254. In the exemplified embodiment, the threaded portion 251 forms a first portion 255 of the cam screw 250 and the thickened portion 252, the neck portion 253, and the head portion 254 collectively form a second portion 256 of the cam screw 250. The thickened portion 252 has a greater diameter than the threaded portion 251 to prevent the thickened portion 252 from entering into the internal cavity 272 of the anchor 270 when the cam screw 250 is being coupled to the support surface 299 that is already fitted with the anchor 270. This ensures that the head 254 is maintained at a distance from the support surface 299 in the fully installed state to facilitate coupling of the cam screw 250 to the cam lock 210.

In the exemplified embodiment, first a hole 298 is drilled into the support surface 299. Next, the anchor 270 is placed into the hole 298 until the flange 273 abuts the front surface of the support surface 299. Finally, the cam screw 250 is placed into the internal cavity 272 of the anchor 270 until the thickened portion 252 of the cam screw 250 abuts against the flange 273 of the anchor 270. Of course, as noted previously the anchor 270 can be omitted and the cam screw 250 can be coupled directly to the support surface 299 in alternative embodiments. Regardless, in its fully installed state shown in FIG. 13, the first portion 255 of the cam screw 250 is embedded within the support surface 299 and the second portion 256 of the cam screw 250 protrudes from the support surface 299. Thus, when installed on the support surface 299, the head 254 of the cam screw 250 is spaced apart from the support surface 299 by the thickened portion 252 and the neck 253 of the cam screw 250.

As noted above, the surface mounting element 290 could take on other forms different from the cam screw 250. For example, the surface mounting element 290 could be a bracket that is coupled to the wall such that the bracket 290 has one or more protruding features that have a shape that is similar to a head and neck of a screw. This would ensure that the cam lock 210 is still capable of being coupled to the surface mounting element 290 in the same manner as described herein. Moreover, other substitutes for the cam screw 250 may also be used as has been described above (i.e., a nail, a traditional/conventional screw, or the like).

Referring now to FIGS. 14-18, the manner in which the article 100 is hung from the wall using the cam lock 210 and the cam screw 250 will be described. Specifically, as discussed previously, first the cam screw 250 is coupled to the support surface 299 (either with or without the anchor 270) and the cam lock 210 (or cam locks 210) is slidably coupled to the mounting channel 120 of the article 100. In the exemplified embodiment, there are two cam screws 250 coupled to the support surface 299 at the same elevation and in a horizontally spaced apart manner. There are also two cam locks 210 slidably mounted to the article 100 and configured for coupling to the cam screws 250. Next, the article 100 is positioned so that each of the cam locks 210 is aligned with one of the cam screws 250. This can be accomplished by holding the article 100 up near the cam screws 250 and sliding the cam locks 210 within the mounting channel 120 until each cam lock 210 is aligned with one of the cam screws 250.

While the cam screws 250 are fixedly coupled to the support surface 299 such that they cannot be moved once they are secured to the support surface 299, the cam locks 210 can be slid within the mounting channel 120 in the direction of the axis B-B of the mounting channel 120 while remaining coupled to the article 100. Thus, there is no exact distance that must exist between the cam screws 250 when they are coupled to the support surface 299. The cam screws 250 should simply be placed in the support surface 299 level to each other (along a horizontal axis to ensure that the article 100 is hung in a level manner) without concern about the exact distance between the cam screws 250. This eliminates the need for templates or other external assistance devices when hanging bath storage or other household storage products.

Thus, if the cam screws 250 are relatively close together, then the cam locks 210 will be slid within the mounting channel 120 towards one another to make sure each cam lock 210 is aligned with one of the cam screws 250. If the cam screws 250 are relatively far apart, then the cam locks 210 will be slid within the mounting channel 120 away from one another to make sure each cam lock 210 is aligned with one of the cam screws 250. The only requirement is that the distance between the cam screws 250 cannot be greater than the length of the mounting channel 120 measured in the direction of the axis B-B.

It should be appreciated that although two of the cam locks 210 and two of the cam screws 250 are illustrated in the exemplified embodiment, more than two cam locks 210 and cam screws 250 can be used in other embodiments to provide a more secure attachment of the article 100 to the support surface 299.

Figure 14:
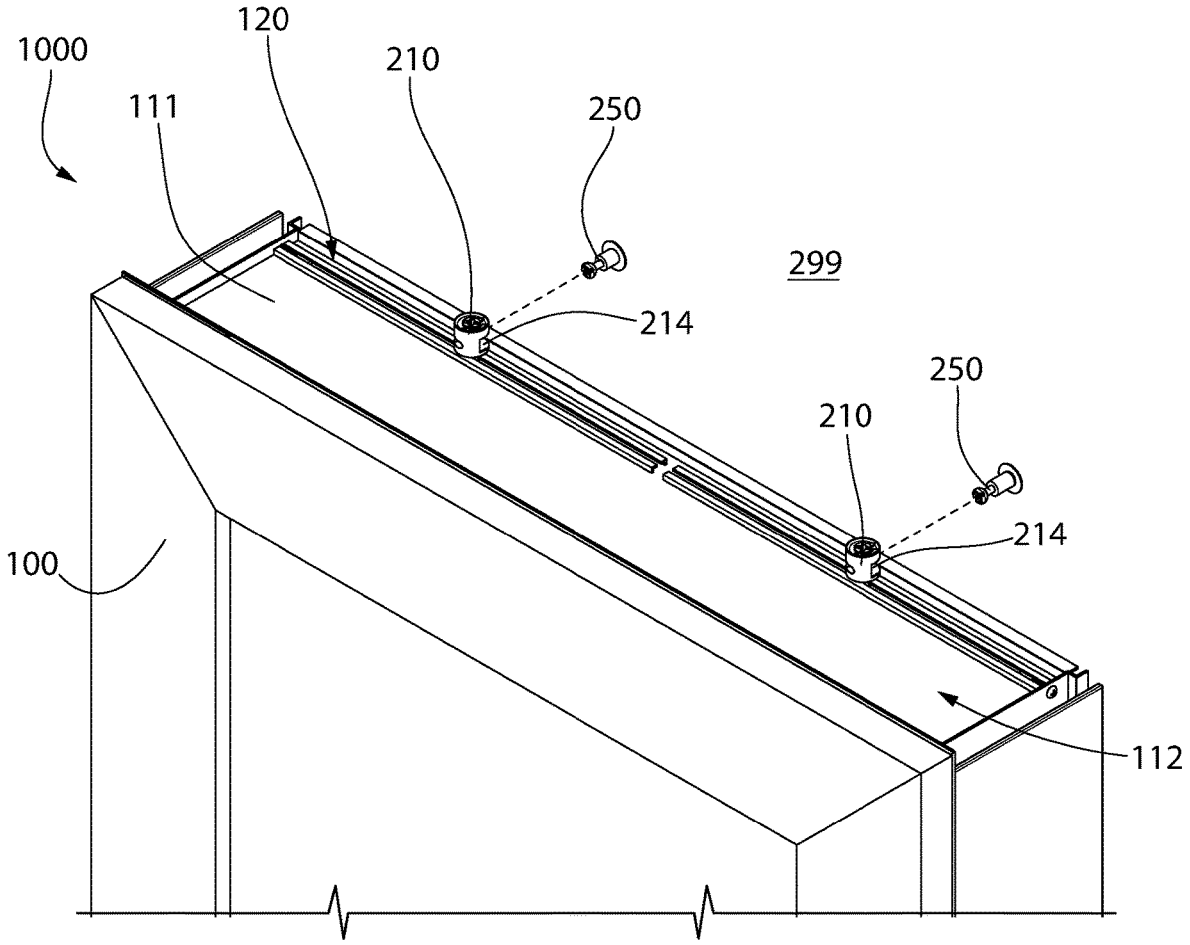
FIG. 14 is a top perspective view of a portion of the system illustrating the cam locks slidably coupled to the mounting channel of the article and prepared for coupling to portions of the cam screws that are protruding from the support surface.
Figure 15:
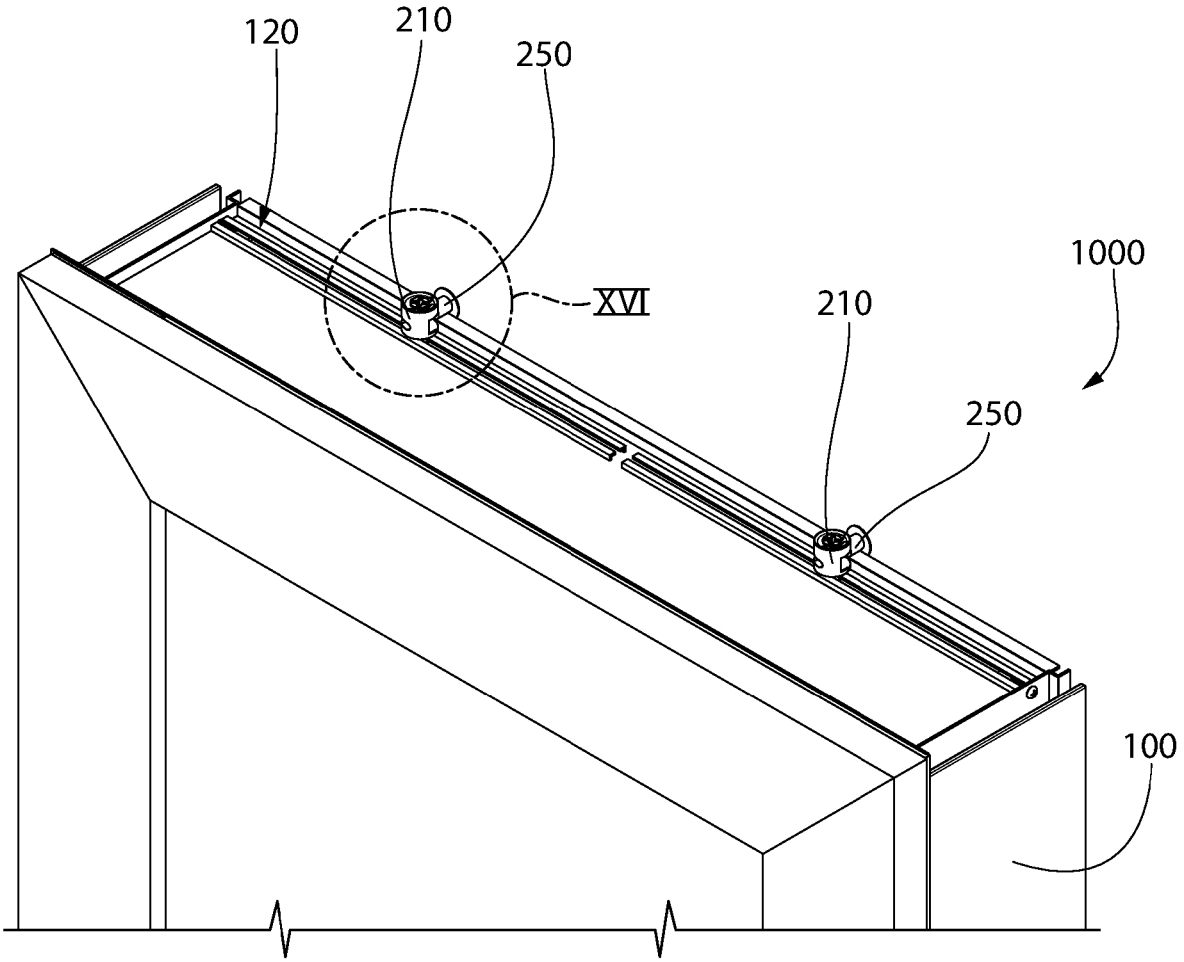
FIG. 15 is a top perspective view of a portion of the system illustrating the cam screw that is protruding from the wall being inserted into the cam locks that are coupled to the article.

As seen in FIGS. 14 and 15, once the cam locks 210 are aligned with the cam screws 250, the article 100 is moved towards the support surface 299 so that the heads 254 of the cam screws 250 can enter into the receiving cavities 214 of the cam locks 210. In order to enable this to occur, the cam locks 210 are rotated so that the entry section 226 of the receiving cavities 214 of the cam locks 210 face outwardly towards the cam screws 250. Thus, as the cam locks 210 approach the cam screws 250, the head and neck portions 254, 253 of the cam screws 250 enter into the receiving cavities 214 through the entry section 226.

Figure 16:
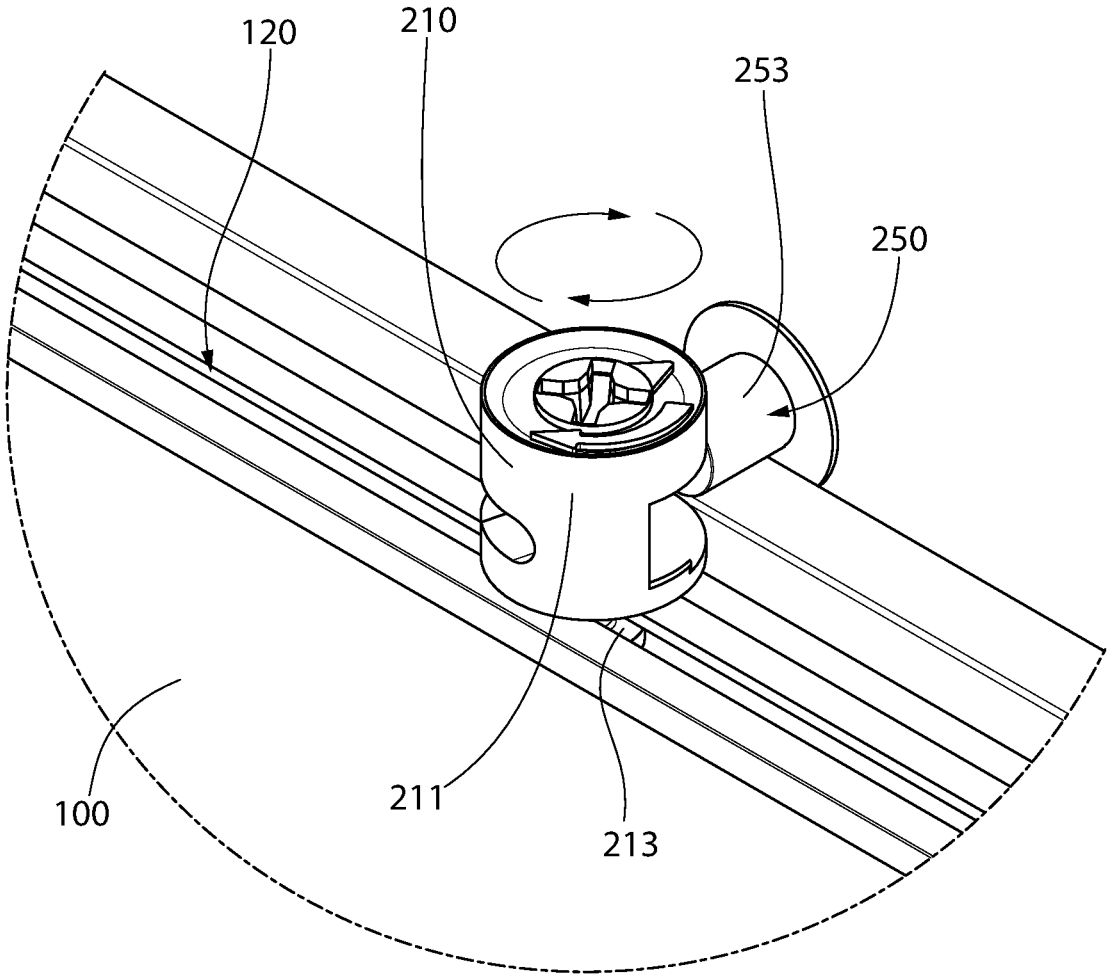
FIG. 16 is a close-up view of area XVI of FIG. 15 before the cam lock is tightened around the cam screw.
Figure 17:
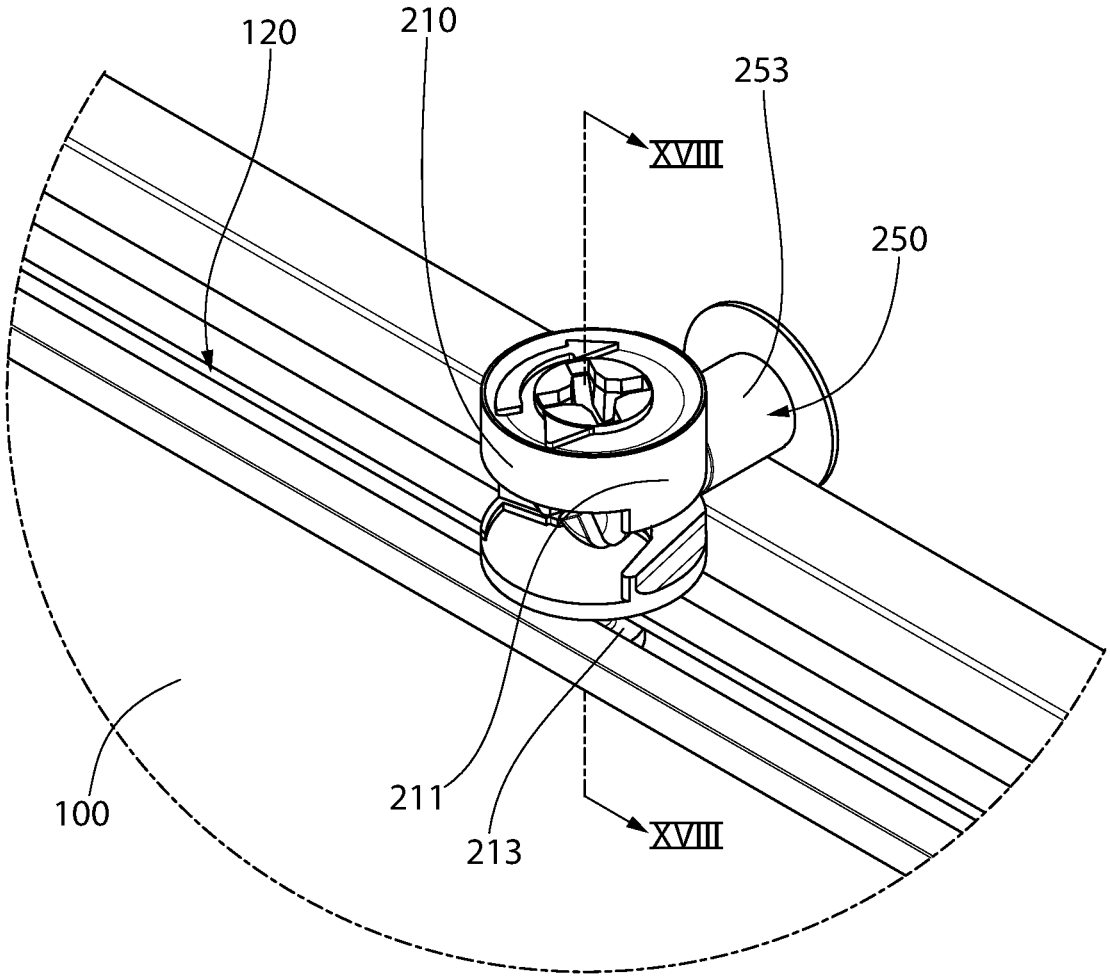
FIG. 17 is a close-up view of area XVI of FIG. 15 after the cam lock is tightened around the cam screw.

Referring to FIGS. 16 and 17, once the head and neck portions 254, 253 of the cam screws 250 are located within the receiving cavities 214 of the cam locks 210, the cam locks 210 are rotated in a clockwise direction. As the cam locks 210 are rotated, the head portions 254 of the cam screws 250 enter into the cam slot 239 of the receiving cavities 214. More specifically, the neck portions 253 of the cam screws 250 ride along the upper and lower cam surfaces 223, 225 until the neck portions 253 abut against the end walls 232. Once the cam locks 210 are rotated in this manner, the cam locks 210 are coupled to the cam screws 250 such that they cannot be detached without first rotating the cam locks 210 in the opposite (counterclockwise) direction. Stated another way, the cam locks 210 are alterable between: (1) a receiving state in which the second portion 256 of the surface mounting element (i.e., cam screws 250) can be inserted into and removed from the second portion 211 of the cam lock 210; and (2) a locked state in which the second portion 256 of the surface mounting element (cam screws 250) is prohibited from being removed from the second portion 211 of the cam lock 210.

The final installed state is perhaps best illustrated in FIG. 18. The first portion 255 of the cam screw 250 is embedded within the support surface 299 and the second portion 256 of the cam screw 250 protrudes from the support surface 299. The second portion 256 of the cam screw 250 is securely coupled to the main body/second portion 211 of the cam lock 210 as has been described herein above. The first portion/flange 213 of the cam lock 210 is slidably coupled to the mounting channel 120 of the article 100. The cam lock 210 supports the weight of the article 100 via contact between the second and fourth walls 133, 136 and the top surface of the first portion/flange 213 of the cam lock 210.

Figure 19A:
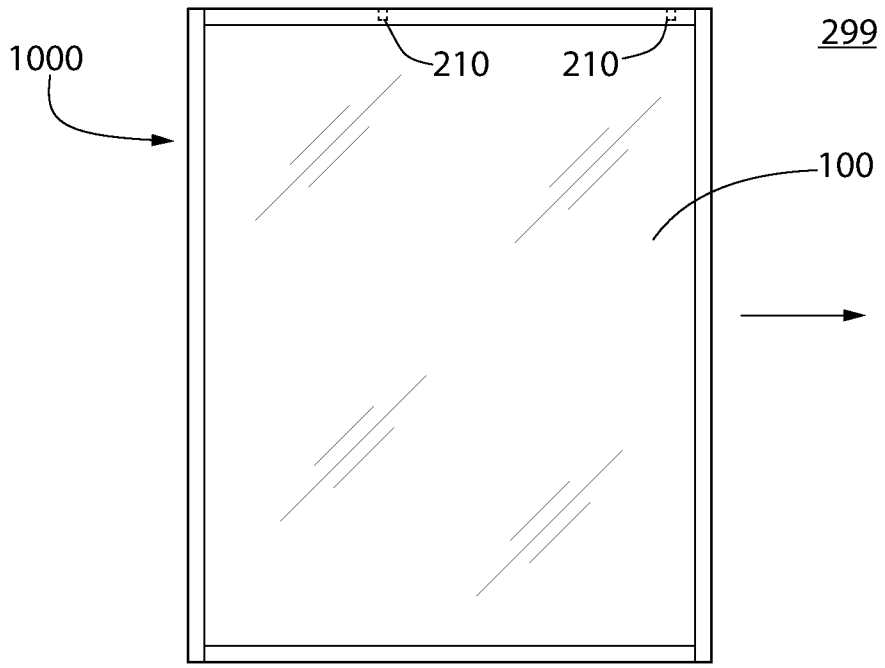
FIGS. 19A and 19B illustrate the horizontal movement of the article while it remains hanging from a support surface.
Figure 19B:
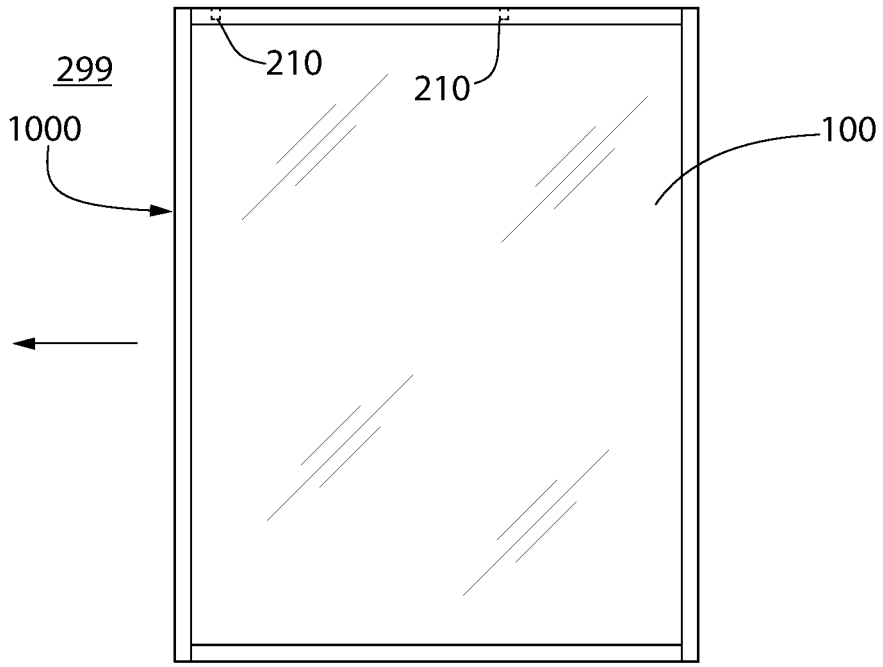

Referring to FIGS. 19A and 19B, when the article 100 is mounted to and hanging from the support surface 299 as shown in FIG. 18, the article 100 can slide or translate side-to-side along the support surface 299. As the article 100 slides side-to-side along the support surface 299, the first portion/flange 213 of the cam lock 210 slides within the mounting channel 120 of the article 100 while the cam screws 250 remain in a fixed position on the support surface 299. During such sliding of the article 100, the cam lock 210 remains coupled to the article 100 and to the cam screws 250 as has been described herein. Thus, if after installation it is desired to move the article 100 to the left or to the right, this can readily be accomplished without removing the screws 250 and the anchors 270. This enables movement of the article 100 without leaving holes in the wall that need to be repaired. In some embodiments, the article 100 can only be slid side-to-side while the cam lock 210 is in the receiving state. Specifically, once the cam locks 210 are rotated into the locked state, the rotation of the cam locks 210 pulls the article 100 into contact with the support surface such that frictional contact between the article 100 and the support surface makes it very difficult to slide the article 100 along the support surface. Thus, rotating the cam locks 210 locks the article 100 in position on the support surface.

The length of the mounting channel 120 measured along the channel axis B-B dictates the amount of movement that is possible, but in some embodiments it may be between 1-10 inches, or more specifically between 1-8 inches, or more specifically between 1-6 inches, or more specifically between 1-4 inches, or more specifically between 1-3 inches, or more specifically between 2-3 inches. Furthermore, by using two cam locks 210 and cam screws 250 and coupling the cam screws 250 to the support surface 299 in a level manner, it can be ensured that the article 100 will be level when the cam locks 210 are coupled to the cam screws 250. Sliding the article 100 side-to-side will not change the level hanging of the article 100 on the support surface 299.

Referring to FIGS. 20-22A, the article 100 may be further secured to the support surface via a support bracket 300 that is coupled to the bottom end 110 of the article 100. In some embodiments, the article 100 may first be coupled to the support bracket 300, which will support the article 100 from below. Next, the article 100 can be coupled to the support surface using the cam locks 210 and cam screws 250 as discussed above. Using the support bracket 300 to support the article 100 from below before coupling the article 100 to the support surface using the cam locks 210 and cam screws 250 makes it easier to complete an effective level hanging of the article 100 because much of its weight is supported by the support bracket 300.

In the exemplified embodiment the article 100 comprises a second mounting element (i.e., second mounting channel) 310 located on the bottom surface 110. Although described and illustrated herein as a channel, the second mounting element 310 could be a protuberance or the like in other embodiments similar to that which has been described above with regard to the first mounting element/channel 120. In the exemplified embodiment, the second mounting channel 310 is similar in structure to the mounting channel 120 in that it comprises first and second bracket members 311*a*, 311*b* that are spaced apart from one another to collectively define the mounting channel 310 between the first and second bracket members 311*a*, 311*b*. The details of the mounting channel 120, 120A, 120B are applicable to the mounting channel 310 and thus further details will not be provided herein for the structure mounting channel 310.

In the exemplified embodiment, the support bracket 300 comprises a first portion 301 and a second portion 302. The first portion 301 of the support bracket 300 is configured to be mounted to the support surface 299 and the second portion 302 of the support bracket 300 is configured to at least partially nest within the second mounting channel 310 on the bottom end 110 of the article 100. In the exemplified embodiment, the support bracket 300 is an S-shaped bracket having a first vertical section 303, a second vertical section 304, and a horizontal section 305 extending between the first and second vertical sections 301, 302. The first portion 301 of the support bracket 300 comprises the first vertical section 303 and the second portion 302 of the support bracket 300 comprises the second vertical section 302. Of course, other shaped brackets may be used and the S-shape is only one exemplary embodiment.

In use, the second vertical section 304 of the support bracket 300 is inserted into the mounting channel 310 and the first vertical section 303 of the support bracket 300 abuts against the support surface 299. Next, screws 306 or other fasteners are inserted into elongated openings 307 that are formed into the first vertical section 303 of the support bracket 300 to secure the support bracket 300 to the support surface 299. Even when the support bracket 300 is secured to the support surface 299 and the second vertical section 304 is located within the mounting channel 310, the article 100 can slide side-to-side with the second vertical section 304 of the support bracket 300 remaining positioned within the mounting channel 310. Specifically, as the article 100 moves side-to-side along the support surface 299 as described above, the support bracket 300 remains in a fixed position on the support surface 299 while the article 100 moves relative to the support bracket 300, all with the second vertical section 304 of the support bracket 300 located within the mounting channel 310. It should be appreciated that the support bracket 300 provides added support for the article 100 in embodiments that it include it, but it may be omitted in some embodiments. The support bracket 300 holds the bottom end 110 of the article 100 close to the support surface 299 rather than permitting it to separate from the support surface 299 as would occur if the support bracket 300 were not used.

Figure 22A:
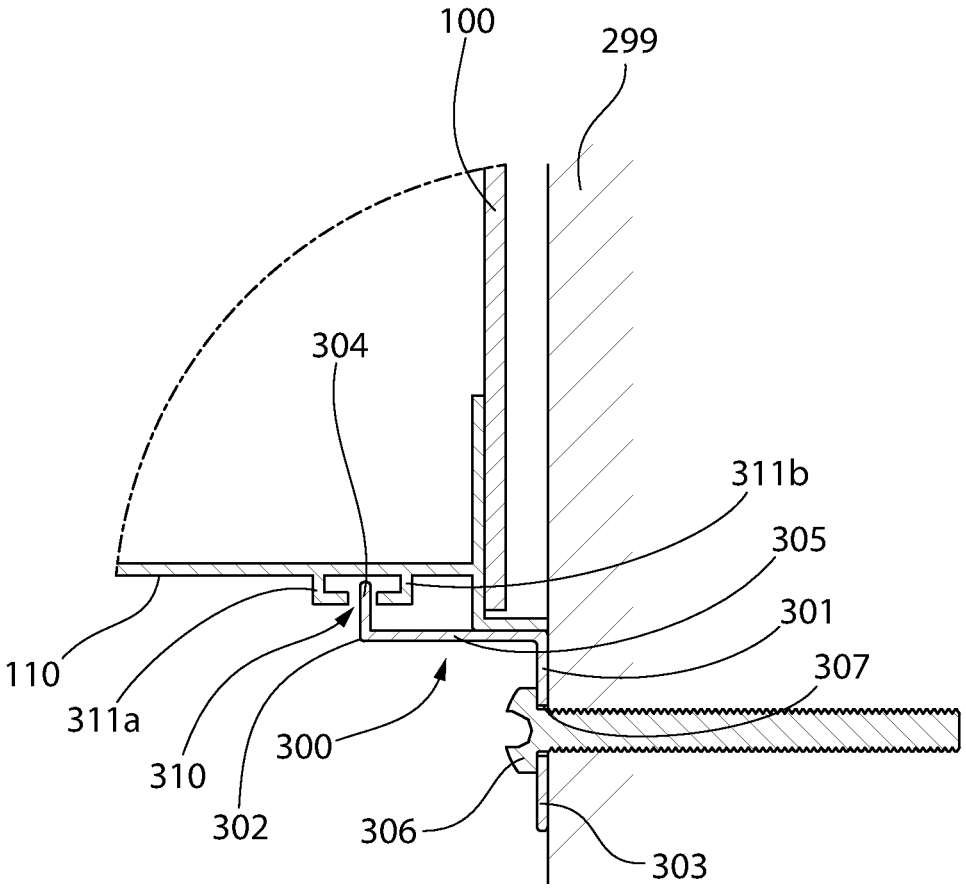
FIG. 22A is a cross-sectional view taken along line XXII-XXII of FIG. 21.
Figure 22B:
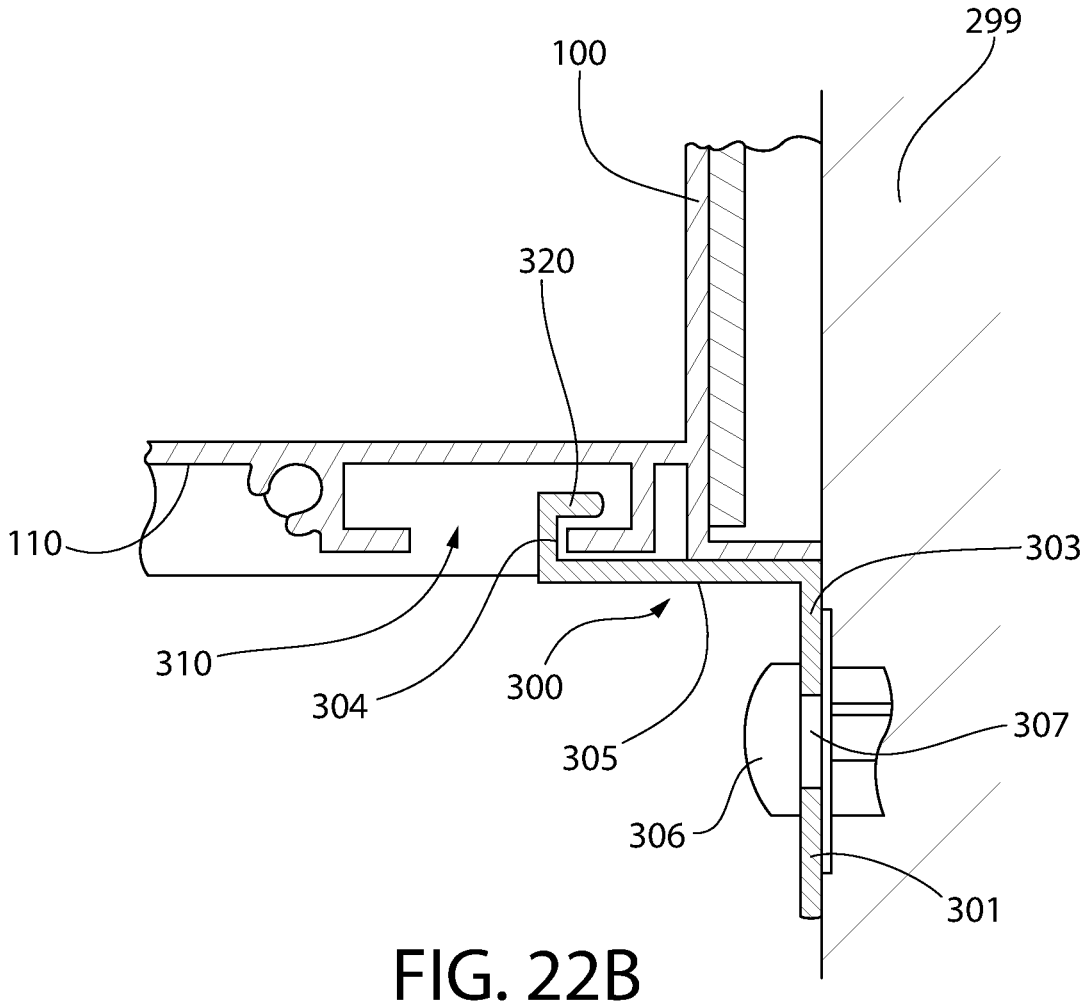
FIG. 22B is a cross-sectional view taken along line XXII-XXII of FIG. 21 in accordance with an alternative embodiment of the present invention.
Figure 23:
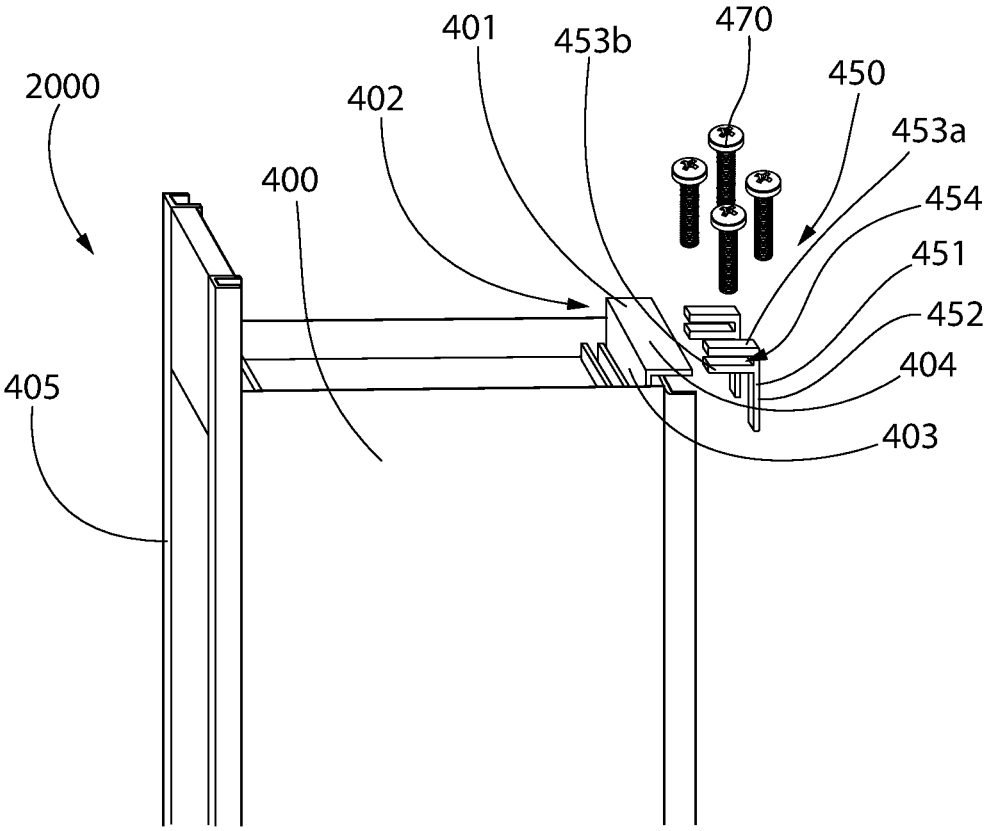
FIGS. 23-26 illustrate a system for hanging an article from a support surface in accordance with an alternative embodiment of the present invention.

FIG. 22B illustrates an alternative embodiment whereby the support bracket 300 has a lip 320 that extends horizontally from the second vertical section 304 in a direction towards the first vertical section 303. The lip 320 interacts with the second mounting channel 310 to assist in preventing the article 100 from moving away from the wall. All other details of the support bracket 300 shown in FIG. 22B are identical to that which has been described above with reference to FIGS. 20-22A.

Referring now to FIGS. 23-26, an alternative article hanging system 2000 is illustrated and will be described. The hanging system 2000 comprises an article 400 having a mounting member 401 and hardware 450, as with the previous embodiment. However, the specific structure and type of the mounting member 401 of the article 400 and of the hardware 450 is different than in the previously described embodiment.

Specifically, in this embodiment the mounting member 401 of the article 400 comprises a mounting bracket 402 (L-shaped in the exemplified embodiment) having a vertical portion 403 extending upwardly from the top end of the article 400 and a horizontal portion 404 extending from the vertical portion 403 in a direction away from a front 405 of the article 400.

Furthermore, the hardware 450 comprises one or more wall brackets 451 and various fasteners including screws and anchors. Specifically, each of the wall brackets 451 comprises a vertical portion 452 and a pair of fingers 453*a*, 453*b* extending horizontally from the vertical portion 452 in a spaced apart manner. The fingers 453*a*, 453*b* are spaced apart by a gap 454 that is larger than the thickness of the horizontal portion 404 of the mounting bracket 402 of the mounting member 401 of the article 400. This enables the horizontal portion 404 of the mounting bracket 402 to be received within the gap 454 such that one of the fingers 453*a* is positioned adjacent a top surface of the horizontal portion 404 of the mounting bracket 402 and the other one of the fingers 453*b* is positioned adjacent a bottom surface of the horizontal portion 404 of the mounting bracket 402.

Although not illustrated, in certain embodiments each of the fingers 453*a*, 453*b* may include an aperture extending therethrough and the horizontal portion 404 of the mounting bracket 402 may include a plurality of apertures extending therethrough in a spaced apart manner along the length of the horizontal portion 404 of the mounting bracket 402. Thus, the fingers 453*a*, 453*b* may be located along the horizontal portion 404 of the mounting bracket 402 so that the apertures in the fingers 453*a*, 453*b* are aligned with one of the apertures in the horizontal portion 404 of the mounting bracket 402. Then, a fastener such as one or more screws 470 may be inserted through the aligned apertures to secure the wall brackets 451 to the mounting bracket 402.

The installation of the article 400 on a support surface 399 using the mounting bracket 402 and the hardware 450 will be described. First, referring to FIG. 25, the wall brackets 451 are secured to the support surface 399 by inserting a screw 460 into an aperture formed into the vertical portion 452 of the wall brackets 451. The screw 460 may enter into an anchor 461 that is pre-inserted into a pre-drilled hole in the support surface 399 if the addition of an anchor 461 is desired or required depending on the weight of the article being hung and whether it is being secured to the support surface 399 at the location of a wall stud.

Figure 20:
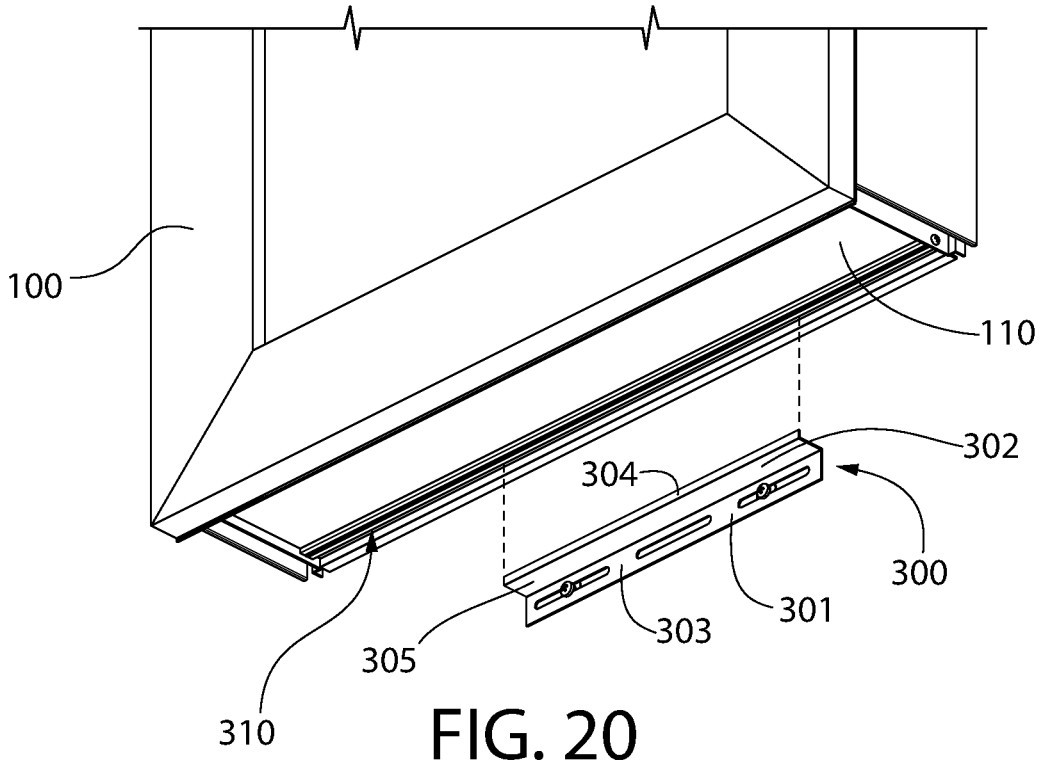
FIGS. 20 and 21 are bottom perspective views of the system of FIG. 1 illustrating a support bracket securing a bottom portion of the article to the support surface.
Figure 21:
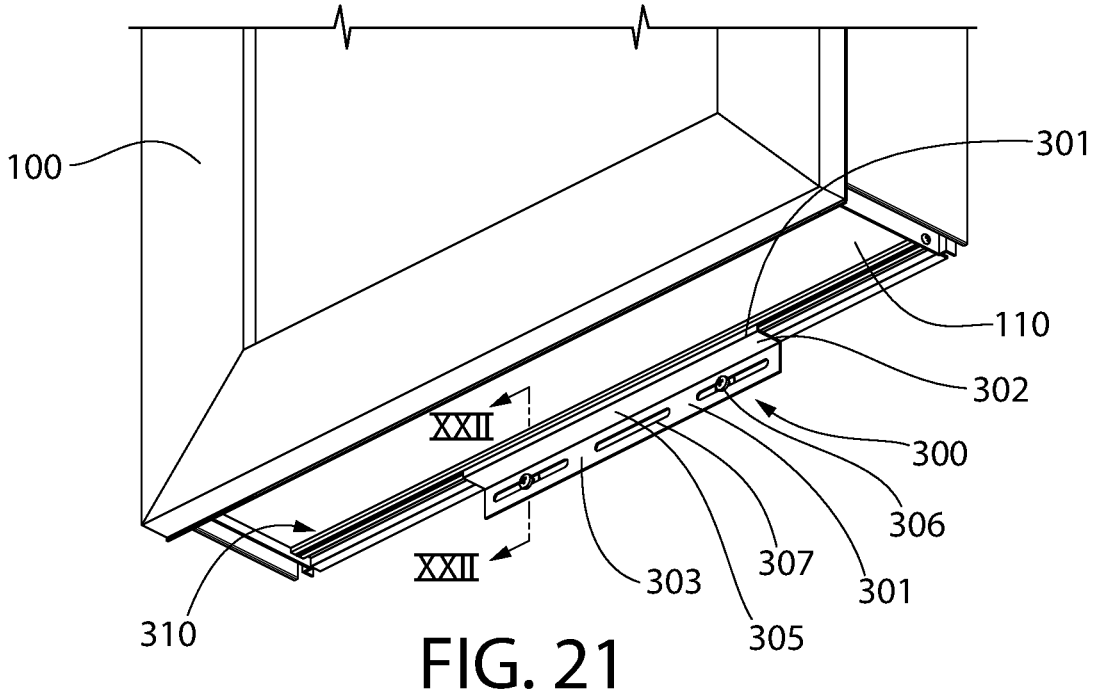
Figure 24:
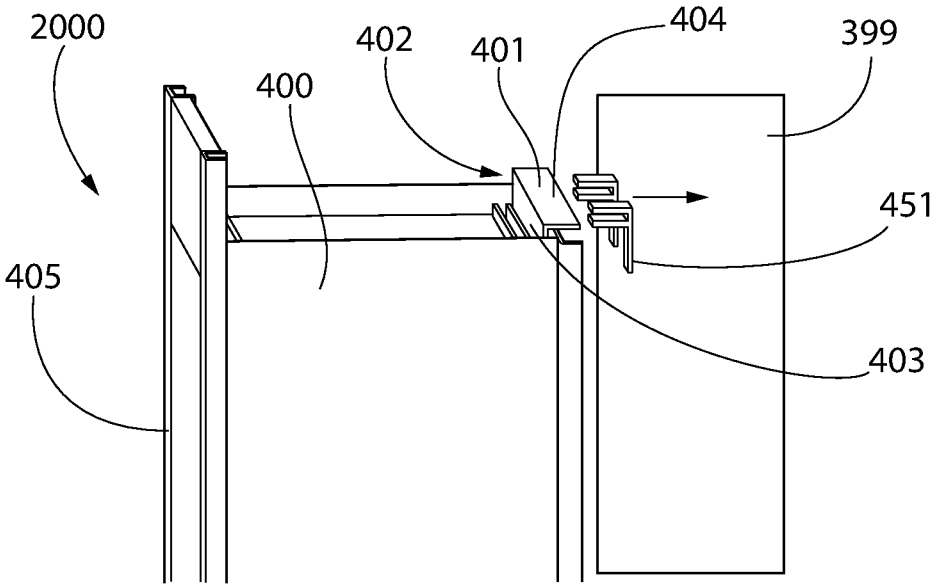
Figure 25:
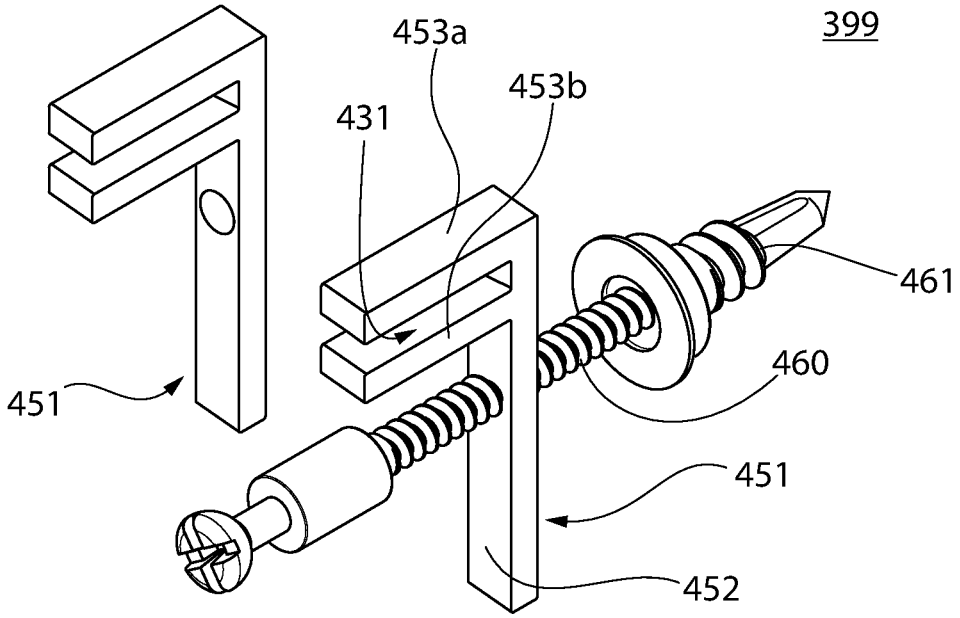
Figure 26:
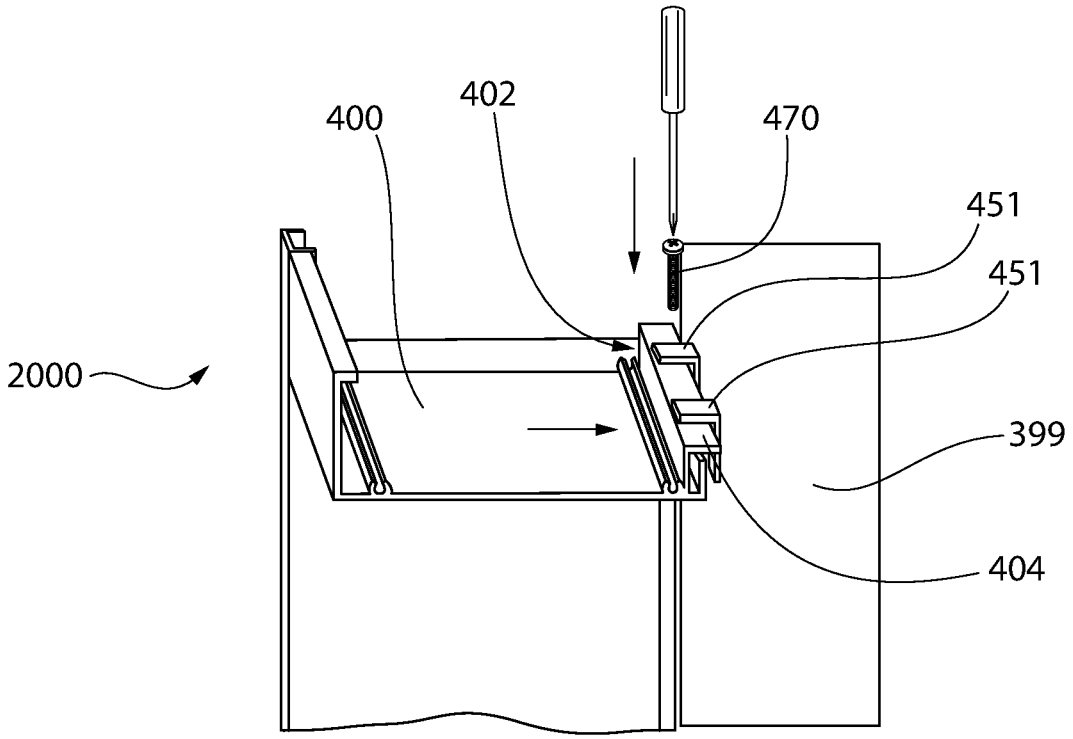

Next, as illustrated in FIG. 24, the article 400 is aligned with the installed wall brackets 451 so that the horizontal portion 404 of the mounting bracket 402 is aligned with the gap 454 between the fingers 453*a*, 453*b* of the wall bracket 451. Then, as shown in FIG. 26, the article 400 is translated towards the wall brackets 451 until the horizontal portion 404 of the mounting bracket 402 enters into the gaps 454 between the fingers 453*a*, 453*b* of the wall brackets 451. Finally, the additional screws 470 or other fasteners are inserted into the aligned openings in the fingers 453*a*, 453*b* and openings in the horizontal portion 404 of the mounting bracket 402 to couple the wall bracket 451 to the mounting bracket 402. This is shown in FIG. 20 whereby a screw 470 and screwdriver are facing the wall brackets 451 and mounting bracket 402 in preparation for insertion therein. Thus, once the wall brackets 451 are secured to the support surface 399 and to the mounting bracket 402 of the mounting member 401 of the article 400, the article 400 is fully installed and secured to support surface. Of course, in some embodiments the support bracket 300 described in FIGS. 20-22B may also be used with this embodiment to secure a lower portion of the article to the support surface 399.

In this embodiment, the article 400 may be slid side-to-side along the support surface 399 while the horizontal portion 404 of the mounting bracket 402 is located within the gap 454 of the wall bracket 451. However, once the hardware 470 secures the mounting bracket 402 to the wall bracket 451, the article 400 can no longer be moved along the support surface 399. If there is a desire to move the article 400 horizontally along the support surface 399, a user would merely need to remove the hardware 470, move the article 400 as desired, and then reattach the hardware 470 in the manner shown and described herein. The wall brackets 451 would not need to be moved to accomplish such horizontal movement of the article 400 along the support surface 399. Furthermore, in some embodiments the hardware 470 need not be used and the article 400 may be hung from the support surface 399 merely by the engagement between the mounting bracket 402 and the wall brackets 451 without physically coupling those components together with hardware.

Figure 27:
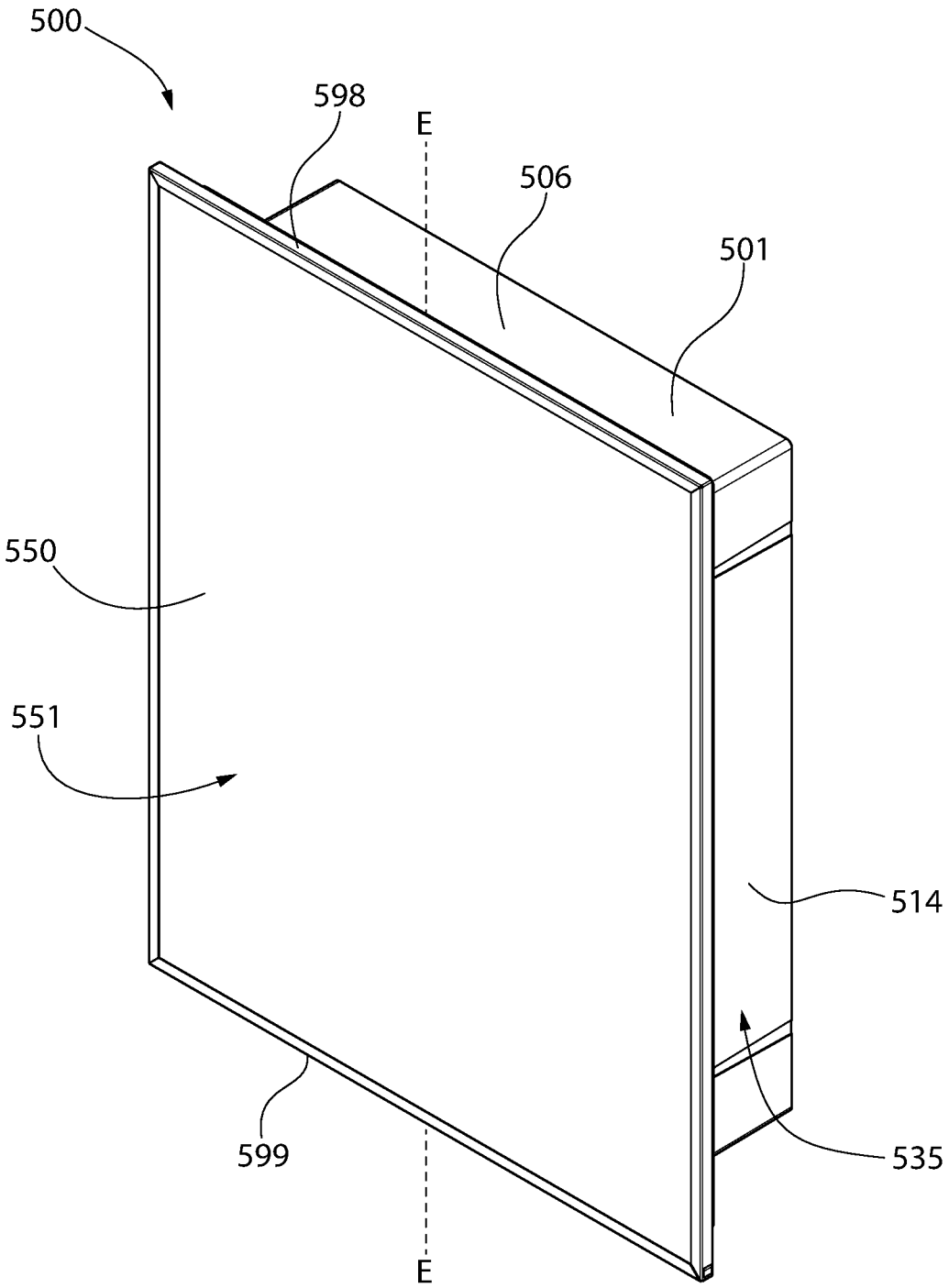
FIG. 27 is a front perspective view of a cabinet in accordance with an embodiment of the present invention.
Figure 28:
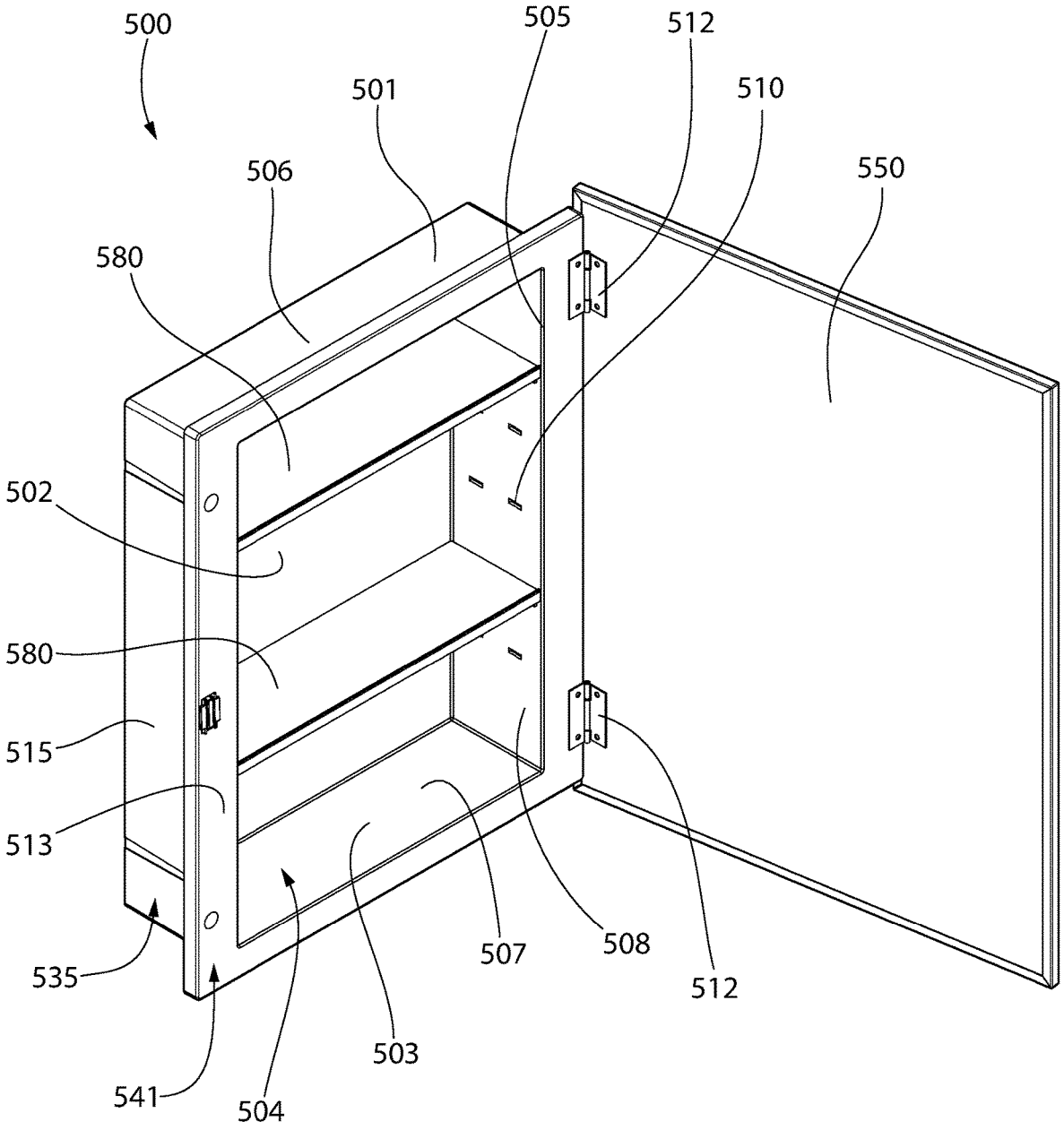
FIG. 28 is a front perspective view of the cabinet of FIG. 27 with a door of the cabinet in an open state.
Figure 29:
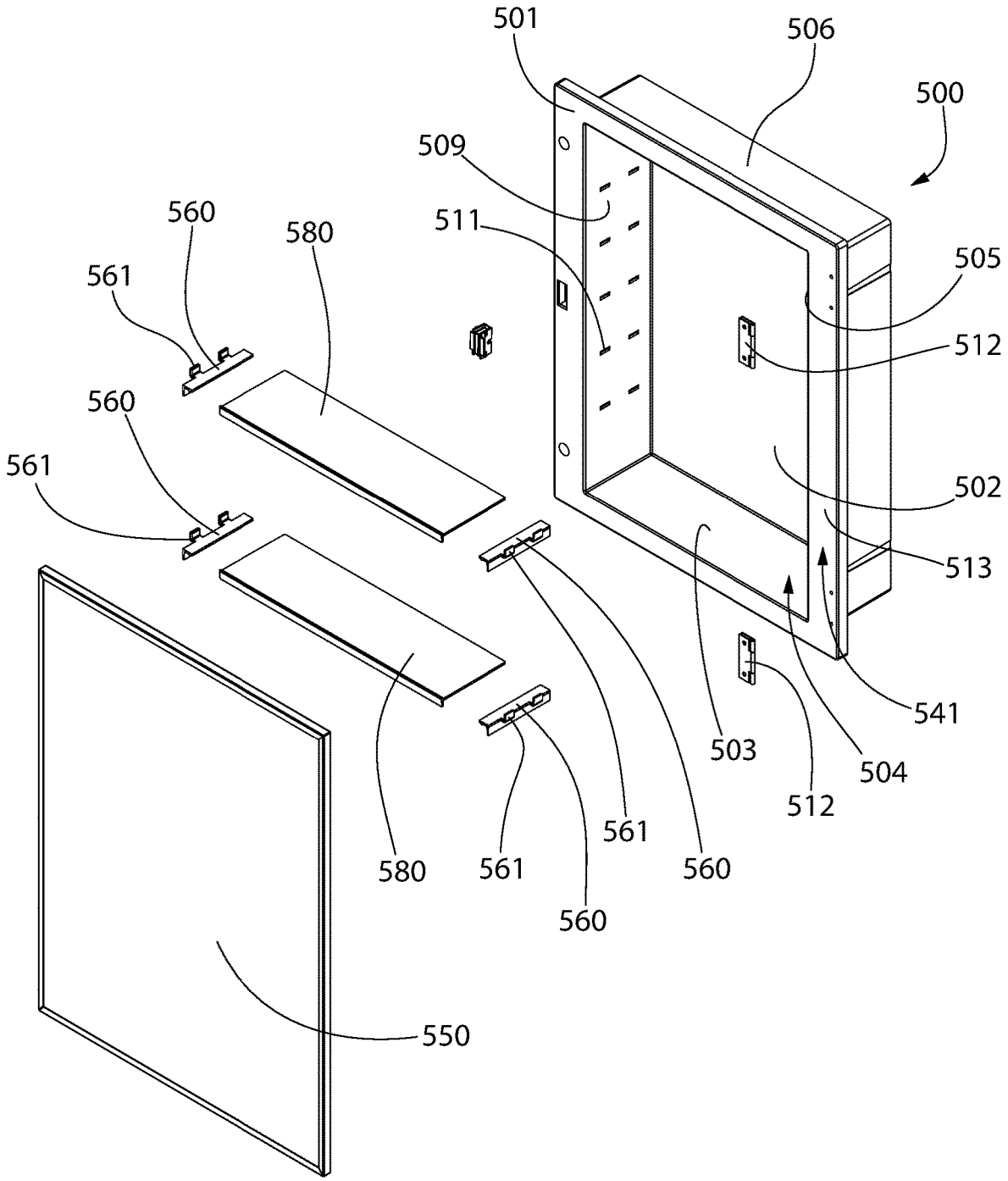
FIG. 29 is an exploded front perspective view of the cabinet of FIG. 27.

Referring to FIGS. 27-29, a cabinet 500 is illustrated in accordance with another embodiment of the present invention. In the exemplified embodiment, the cabinet 500 is a medicine cabinet. However, the invention is not to be so limited in all embodiments and the cabinet 500 could alternatively be a kitchen cabinet, a household storage device, any type of bath storage device, or the like. Generally, the cabinet 500 is of the type that can be flush mounted or surface mounted on a support surface such as a wall. Flush mounting is achieved by recessing the cabinet 500 into a wall with the front surface of the cabinet 500 (door excepted) flush with the wall. In flush mounting the side walls of the cabinet 500 are hidden from view because they are disposed within a recess in the wall rather than being exposed. Surface mounting is achieved by mounting the cabinet 500 to a wall with the rear surface of the cabinet 500 in contact with the exposed surface of the wall. Cabinets that are surface mounted have their side walls exposed.

The present invention results in the exposed side walls of the cabinet 500 being aesthetically pleasing to enhance the aesthetic of the cabinet 500 as viewed by an individual. Specifically, cabinets of the type described herein have holes in their sidewalls for coupling shelf supports to the cabinet. The holes in the sidewalls are exposed when the cabinet 500 is surface mounted onto a wall. The present invention hides the holes in the sidewalls by forming a double-walled structure such that the outermost wall that is exposed while the cabinet 500 is surface mounted on a wall does not have any holes therein. The storage cabinet 500 may be formed out of a plastic material via injection molding in some embodiments, although other materials and manufacturing techniques are also possible in accordance with other embodiments of the invention.

The cabinet 500 extends from a bottom end 599 to a top end 598 along an axis E-E. The cabinet 500 comprises a housing 501 and a door 550 coupled to the housing 501. The housing 501 comprises a rear wall 502 that forms a rear surface 540 of the housing 501 and a plurality of sidewalls 503 extending from the rear wall 502 in a direction opposite the rear surface 540. The rear wall 502 and the plurality of sidewalls 503 collectively define a cavity 504 having an opening 505. In the exemplified embodiment, the cavity 504 of the housing 501 has a square or rectangular shape. Of course, the invention is not to be so limited and the cavity 504 may have any polygonal shape or may be circular in alternative embodiments. The cabinet 500 comprises a front wall 513 that surrounds the opening 505, the front wall forming a front surface 541 of the housing 501. The door 550 of the cabinet 500 encloses the opening 505 and is coupled to the housing 501, and more specifically to the front wall 513 of the housing 501, via one or more hinges 512. The door 550 is configured to be altered between an open state whereby the opening 505 is exposed (FIG. 28) and a closed state whereby the opening 505 is closed (FIG. 27). The door 550 may have a mirrored front surface 551 in some embodiments, although this is not required in all embodiments.

The plurality of sidewalls 503 comprise a top wall 506, a bottom wall 507 opposite the top wall 506, a first inner sidewall 508, and a second inner sidewall 509 opposite the first inner sidewall 508. Inner surfaces of the top wall 506, the bottom wall 507, the first inner sidewall 508, the second inner sidewall 509, and a front surface of the rear wall 502 collectively define the cavity 504. The first inner sidewall 508 comprises a plurality of openings 510 and the second inner sidewall 509 comprises a plurality of openings 511. In the exemplified embodiment, there are a plurality of pairs of the openings 510, 511 arranged at different vertical locations along the first and second inner sidewalls 508, 509. The openings 510 on the first inner sidewall 508 are aligned with the openings 511 on the second inner sidewall 509.

The openings 510, 511 of the first and second inner sidewalls 508, 509 are configured to receive connection elements 561 of shelf supports 560 to couple the shelf supports 560 to the first and second inner sidewalls 508, 509. The shelf supports 560 support one or more shelves 580 between the first and second inner sidewalls 508, 509 of the housing 501. The shelves 580 are oriented horizontally within the cavity 504 between the first and second inner sidewalls 508, 509 and are configured to hold or otherwise support items that are stored in the cabinet 500. The details of the shelf supports 560 and the shelves 580 will be provided below with reference to FIGS. 33A-34D.

Figure 30:
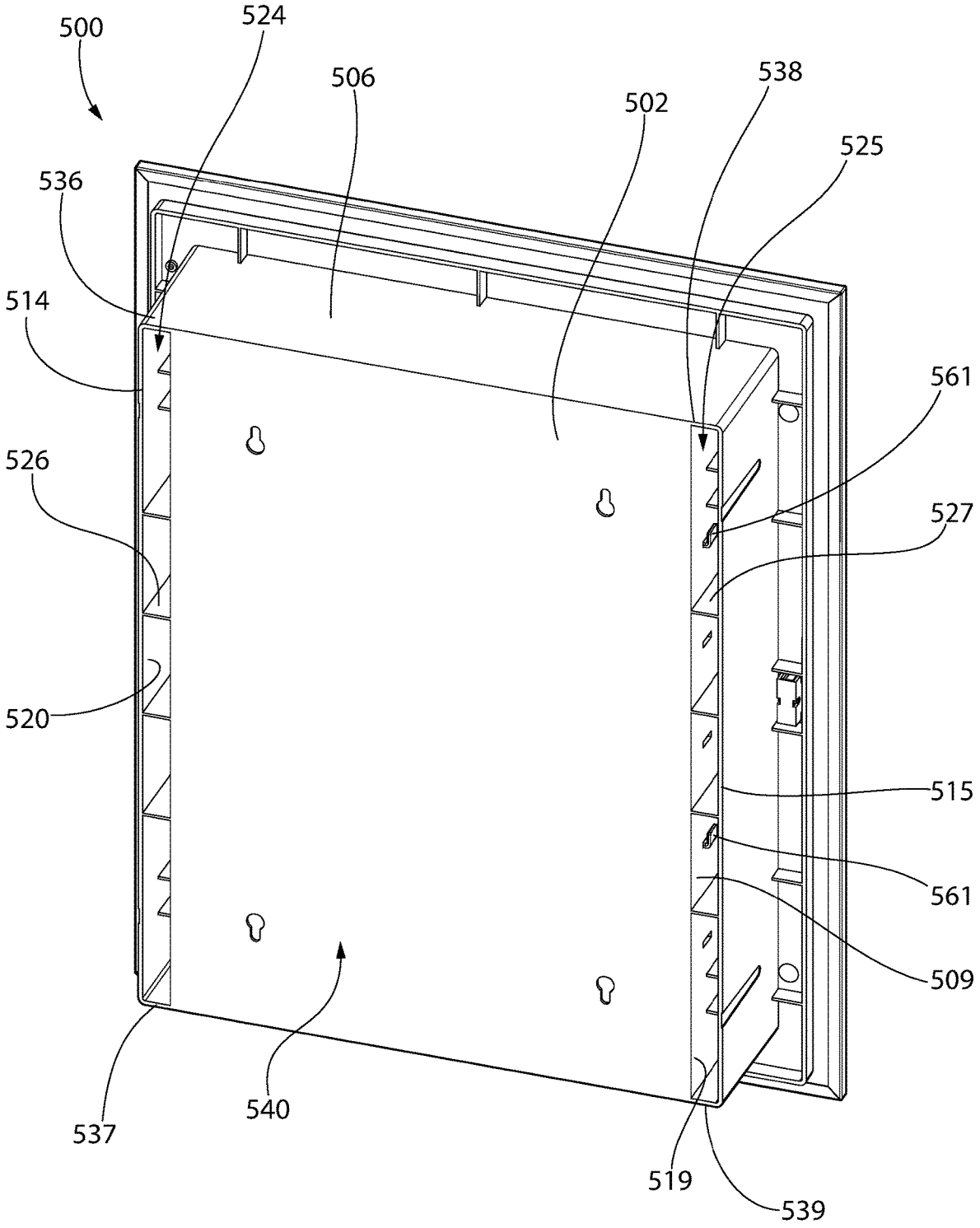
FIG. 30 is a rear perspective view of the cabinet of FIG. 27.
Figure 31:
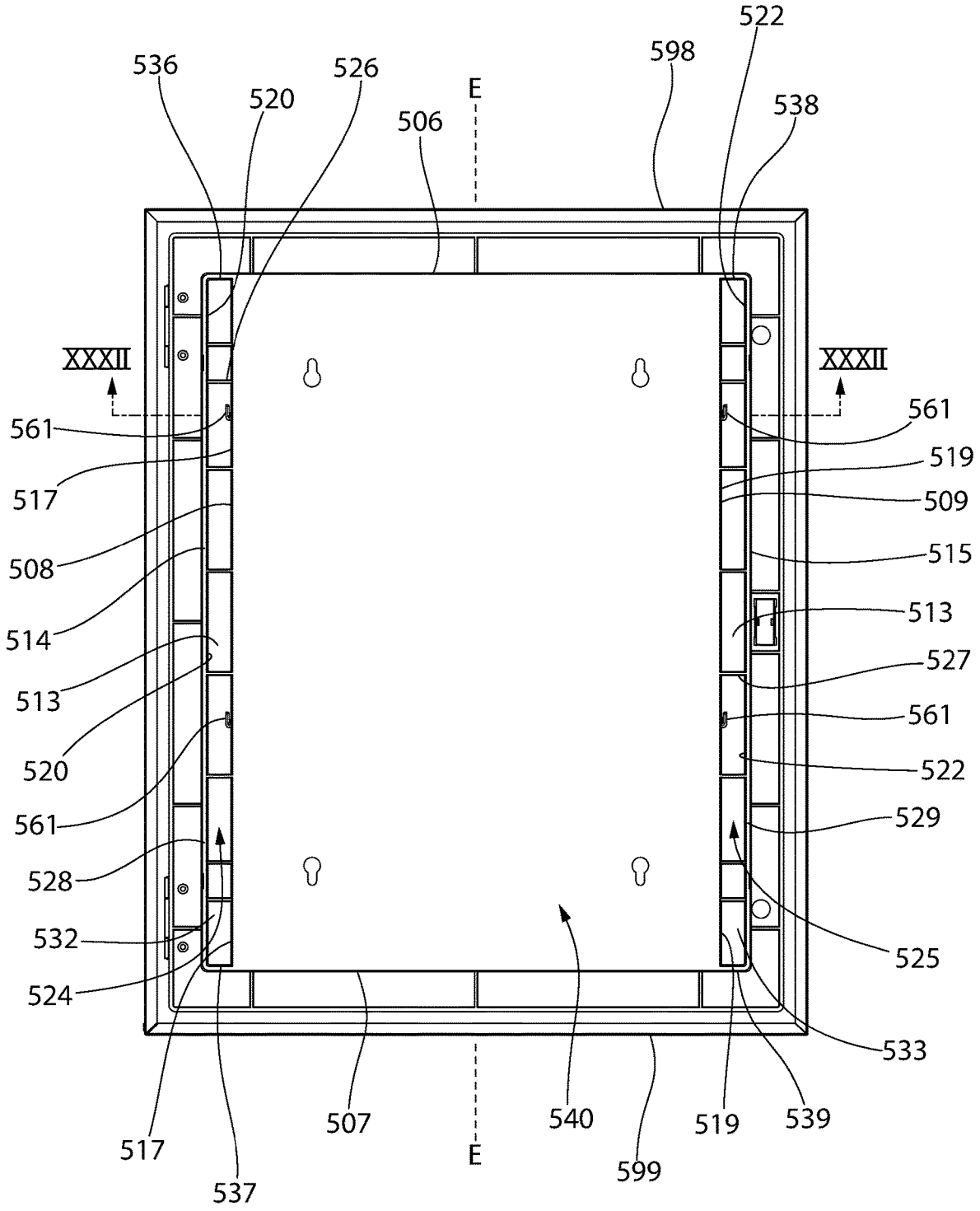
FIG. 31 is a rear view of the cabinet of FIG. 27.
Figure 32:
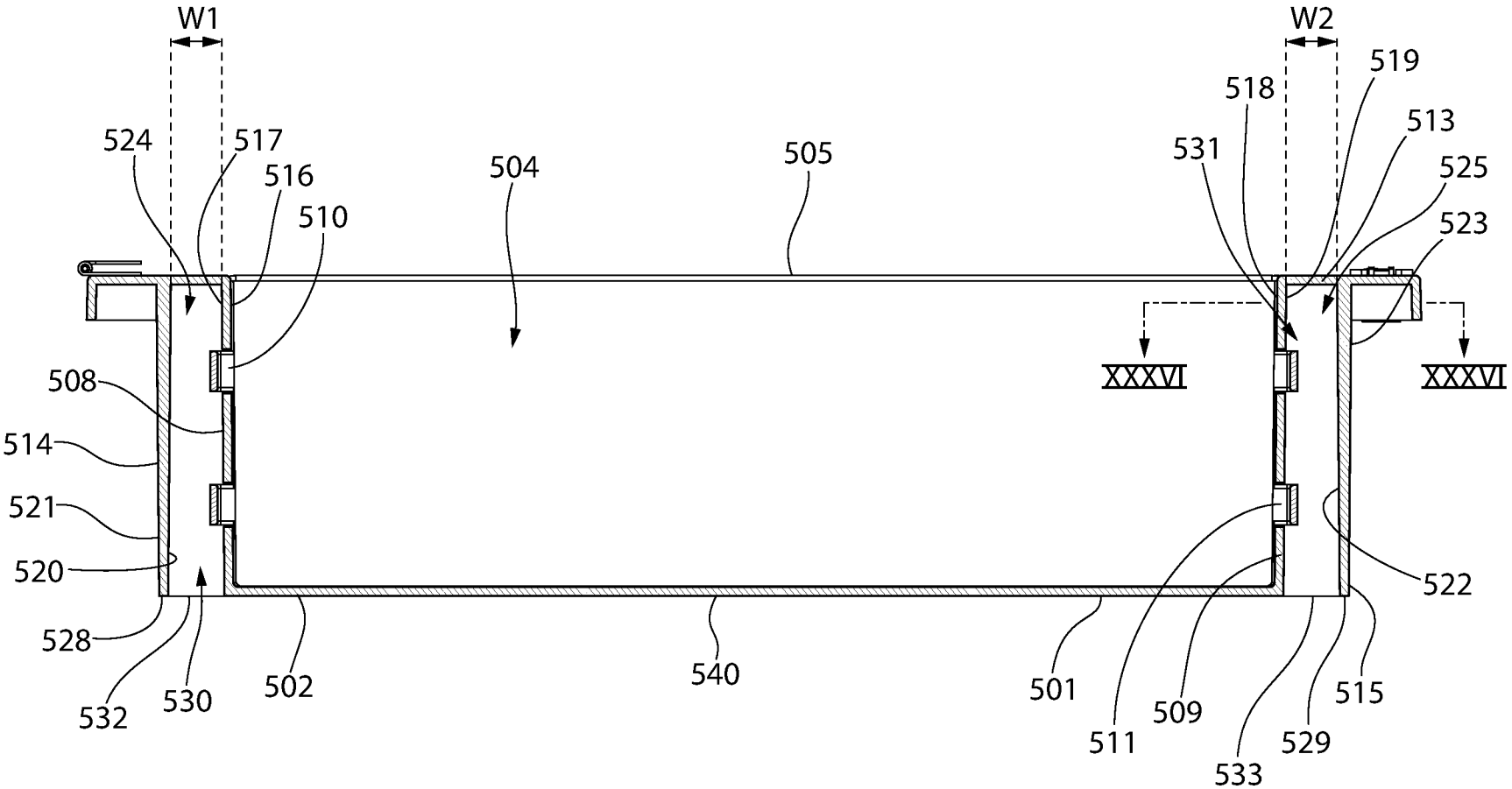
FIG. 32 is a cross-sectional view taken along line XXXII-XXXII of FIG. 31.

Referring to FIGS. 30-32, the cabinet 500 will be further described. As noted previously, in some embodiments it may be desirable for the first and second inner sidewalls 508, 509 to be hidden from view because viewing the openings 510, 511 in the first and second inner sidewalls 508, 509 and the connection elements 561 of the shelf supports 560 is not aesthetically pleasing. The first and second inner sidewalls 508, 509 extend between the top wall 506 and the bottom wall 507. Furthermore, the cabinet 500 comprises a first outer sidewall 514 extending between the top and bottom walls 506, 507 adjacent to and spaced apart from the first inner sidewall 508 and a second outer sidewall 515 extending between the top and bottom walls 506, 507 adjacent to and spaced apart from the second inner sidewall 509. In the exemplified embodiment, the front wall 513 extends radially beyond the top wall 506, the bottom wall 507, and the first and second outer sidewalls 514, 515. In the exemplified embodiment, the first outer sidewall 514 is parallel to the first inner sidewall 508 and the second outer sidewall 515 is parallel to the second inner sidewall 509.

Each of the first and second inner and outer sidewalls 508, 509, 514, 514 extend between the top and bottom walls 506, 507, and thus each of the first and second inner and outer sidewalls 508, 509, 514, 515 has the same length measured in a direction between the top and bottom walls 506, 507 (i.e., in a direction parallel to the longitudinal axis E-E of the cabinet 500). More specifically, the top and bottom walls 506, 507 extend beyond the first and second inner sidewalls 508, 509 in a direction transverse to the longitudinal axis E-E so that the top and bottom walls 506, 507 are connected directly to opposite ends of the first and second outer sidewalls 514, 515.

The first inner sidewall 508 has an inner surface 516 facing the cavity 504 and an opposite outer surface 517. The second inner sidewall 509 has an inner surface 518 facing the cavity 504 and an opposite outer surface 519. The first outer sidewall 514 has an inner surface 520 facing the outer surface 517 of the first inner sidewall 508 and an opposite outer surface 521 that is exposed when the cabinet 500 is surface mounted on a support surface. The second outer sidewall 515 has an inner surface 522 facing the outer surface 519 of the second inner sidewall 509 and an opposite outer surface 523 that is exposed when the cabinet 500 is surface mounted on a support surface. The outer surface 517 of the first inner sidewall 508 is concealed by the first outer sidewall 514 and the outer surface 519 of the second inner sidewall 509 is concealed by the second outer sidewall 515.

The outer surface 517 of the first inner sidewall 508 is spaced apart from the inner surface 520 of the first outer sidewall 514 by a first gap 524. The first gap 524 exists along the entire length of the first inner and first outer sidewalls 508, 514 (with the length of the first inner and outer sidewalls 508, 514 being measured in a direction parallel to the longitudinal axis E-E of the housing 501). The outer surface 519 of the second outer sidewall 509 is spaced apart from the inner surface 522 of the second outer sidewall 514 by a second gap 525. The second gap 525 exists along the entire length of the second inner and second outer sidewalls 509, 515 (with the length of the second inner and outer sidewalls 509, 515 being measured in a direction parallel to the longitudinal axis E-E of the housing 501). The first gap 524 has a first width W1 measured in a direction transverse to the longitudinal axis E-E and the second gap 525 has a second width W2 measured in a direction transverse to the longitudinal axis E-E. In the exemplified embodiment, the first and second widths W1, W2 are the same. Furthermore, in the exemplified embodiment each of the first and second widths W1, W2 is constant along the entirety of the length of the walls 508, 509, 514, 515 such that the first and second widths W1, W2 are the same irrespective of the axial location along the first and second gaps 524, 525 that the first and second widths W1, W2 are measured. As seen in FIGS. 30 and 31, the connection elements 561 of the shelf supports 560 extend through the openings 510, 511 in the first and second inner sidewalls 508, 509 and into the first and second gaps 524, 525.

Furthermore, a first plurality of ribs 526 are located in the first gap 524 and extend between the inner surface 520 of the first outer sidewall 514 and the outer surface 517 of the first inner sidewall 508. The first plurality of ribs 526 are oriented substantially horizontally and are spaced apart vertically. A second plurality of ribs 527 are located in the second gap 525 and extend between the inner surface 522 of the second outer sidewall 515 and the outer surface 519 of the second inner sidewall 509. The second plurality of ribs 527 are substantially horizontally oriented and are spaced apart vertically. The first and second pluralities of ribs 526, 527 provide structural integrity to the cabinet 500.

As best seen in FIG. 32, the first and second inner sidewalls 508, 509 extend from the front wall 513 to the rear wall 502 such that the first and second inner sidewalls 508, 509 are connected directly to both of the front and rear walls 513, 502. The first and second inner sidewalls 508, 509 have a depth measured from the front wall 513 to the rear wall 502. The first outer sidewall 514 extends from the front wall 513 to a free distal edge 528 and the second outer sidewall 514 extends from the front wall 513 to a free distal edge 529. Thus, the first and second outer sidewalls 514, 515 are not connected to the rear wall 502 in the exemplified embodiment, although it is possible for the first and second outer sidewalls 514, 515 to be connected to the rear wall 502 in alternative embodiments. However, the first and second outer sidewalls 514, 515 have a depth measured from the front wall 513 to the free distal edges 528, 529 such that the depths of the first and second outer sidewalls 514, 515 are the same as the depths of the first and second inner sidewalls 508, 509. This ensures that the first and second outer sidewalls 514, 515 completely conceal the first and second inner sidewalls 508, 509 when the cabinet 500 is surface mounted to a support surface. Specifically, when viewed from either side of the housing 501, neither of the first and second inner sidewalls 508, 509 is visible.

A first cavity 530 is formed by the gap 524 between the first inner and outer sidewalls 508, 514 and a second cavity 531 is formed by the gap 525 between the second inner and outer sidewalls 509, 515. Specifically, the first cavity 530 is defined by the outer surface 517 of the first inner sidewall 508, the inner surface 520 of the first outer sidewall 514, the portion 536 of the top wall 506 that extends between the first inner and first outer sidewalls 508, 514, the portion 537 of the bottom wall 507 that extends between the first inner and first outer sidewalls 508, 514, and a portion of the front wall 513 that extends between the first inner and first outer sidewalls 508, 514. Similarly, the second cavity 531 is defined by the outer surface 519 of the second inner sidewall 509, the inner surface 522 of the second outer sidewall 515, the portion 538 of the top wall 506 that extends between the second inner and second outer sidewalls 509, 515, the portion 539 of the bottom wall 507 that extends between the second inner and second outer sidewalls 509, 515, and a portion of the front wall 513 that extends between the second inner and second outer sidewalls 509, 515. In the exemplified embodiment, the first and second channels 530, 531 are in the shape of rectangles that are elongated in a direction parallel to the longitudinal axis E-E.

Because the first and second outer sidewalls 514, 515 are not connected to the rear wall 502 in the exemplified embodiment, the first cavity 530 has a first opening 532 on the rear surface 540 of the housing 501 and the second cavity 531 has a second opening 533 on the rear surface 540 of the housing 501. In the exemplified embodiment, the openings 510 in the first inner sidewall 508 and the opening 532 on the rear surface 540 of the housing 501 are the only openings into the first cavity 530. Similarly, the openings 511 in the second inner sidewall 509 and the opening 533 on the rear surface 540 of the housing 501 are the only openings into the second cavity 531.

Turning again to FIGS. 27 and 28, it should be appreciated that the first and second outer sidewalls 514, 515 are exposed and the first and second inner sidewalls 508, 509 are completely concealed and cannot be seen from those provided views. Thus, the openings 510, 511 in the first and second inner sidewalls 508, 509 that are configured to receive connection elements of the shelf supports 580 are concealed or hidden from view by the first and second outer sidewalls 514, 515. The housing 501 comprises a smooth and continuous outer surface 535 defined by outer surfaces of the top wall 506, the bottom wall 507, and the first and second outer sidewalls 513, 514. The junction between the outer surfaces of the first and second outer sidewalls 513, 514 and the outer surfaces of the top and bottom walls 506, 507 is smooth and flush so that the outer surface 535 of the housing 501 is a smooth, unbroken surface. This creates the desired aesthetic without affecting the functionality of the cabinet 500.

When the cabinet 500 is surface mounted to a support surface, the rear surface 540 of the housing 101 abuts against the support surface. Thus, the openings 532, 533 into the channels 530, 531 are also abutted directly against the support surface. As a result, when the cabinet 500 is surface mounted on a support surface, the first and second inner sidewalls 508, 509 cannot be seen at all because they are entirely concealed by the first and second outer sidewalls 514, 515. Thus, the structure of the cabinet 500 creates a desired aesthetic. In certain embodiments, the first and second outer sidewalls 514, 515 do not have any holes or other non-aesthetically pleasing features. Of course, the outer surfaces of the first and second outer sidewalls 514, 515 may include a desired design or topography for aesthetic purposes.

In the exemplified embodiment, the housing 501 has a square shape such that each of the sidewalls is linear in only one direction. However, the invention is not to be so limited in all embodiments and the housing 501 may be other shapes including circular, triangular, hexagonal octagonal, or the like. Regardless of the shape of the housing 501, the sidewalls of the housing 501 may be dual-walled such that inner sidewalls that have openings for receiving shelf supports are concealed or otherwise covered by outer sidewalls that are spaced apart from the inner sidewalls. Thus, it should be appreciated by persons skilled in the art that the cabinet 500 can be formed with many different shapes while still implementing the teachings set forth herein.

Figure 33A:
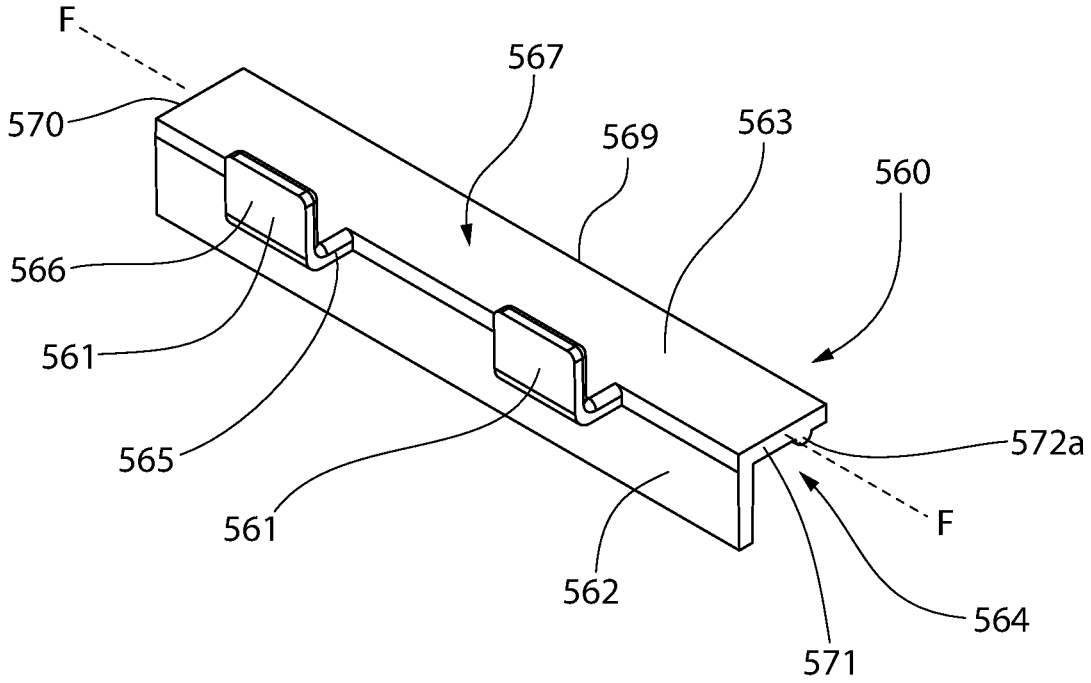
FIG. 33A is a top perspective view of a shelf support of the cabinet of FIG. 27.
Figure 33B:
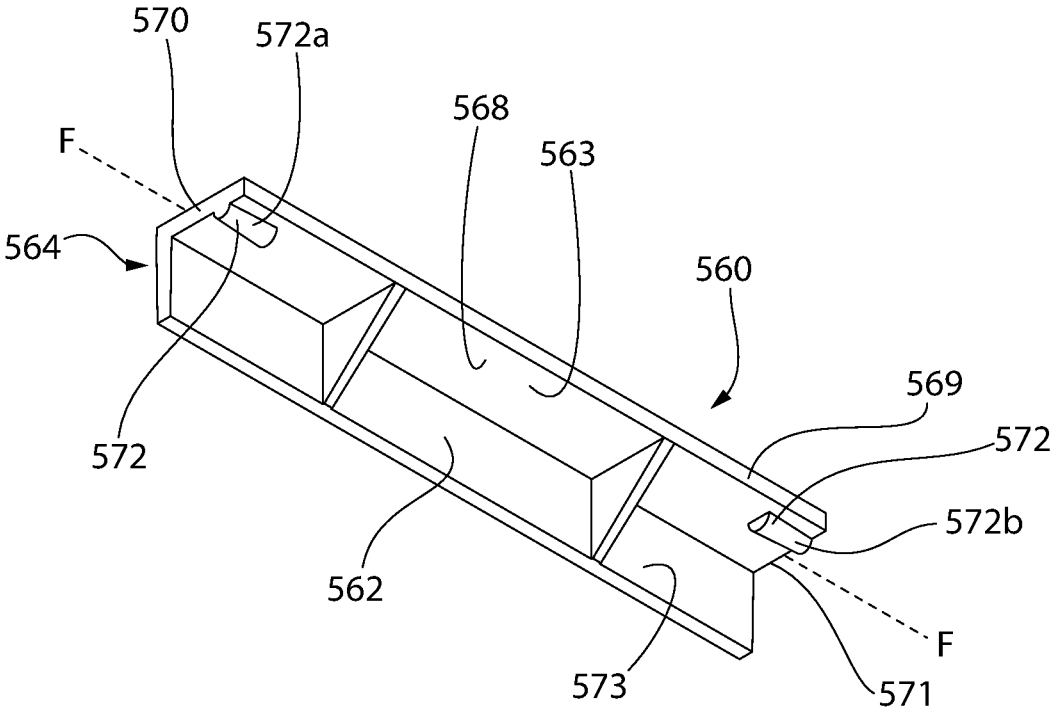
FIG. 33B is a bottom perspective view of the shelf support of FIG. 33A.
Figure 34A:
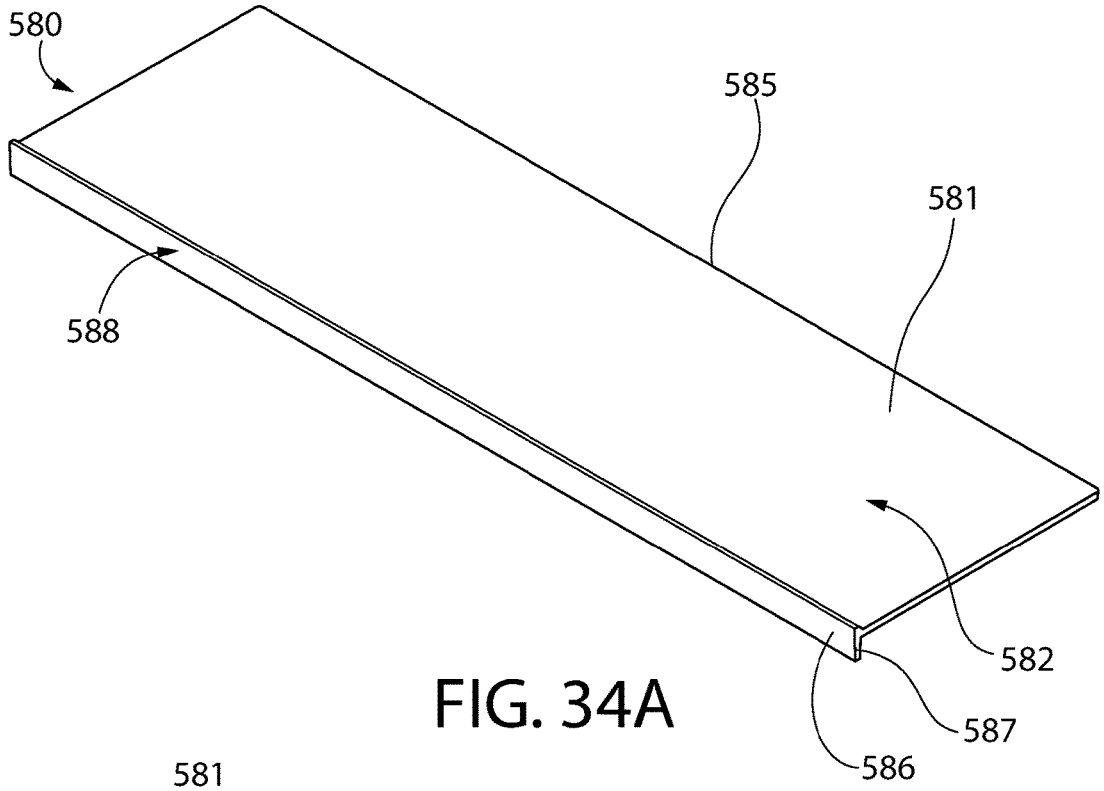
FIG. 34A is a top perspective view of a shelf of the cabinet of FIG. 27.
Figure 34B:
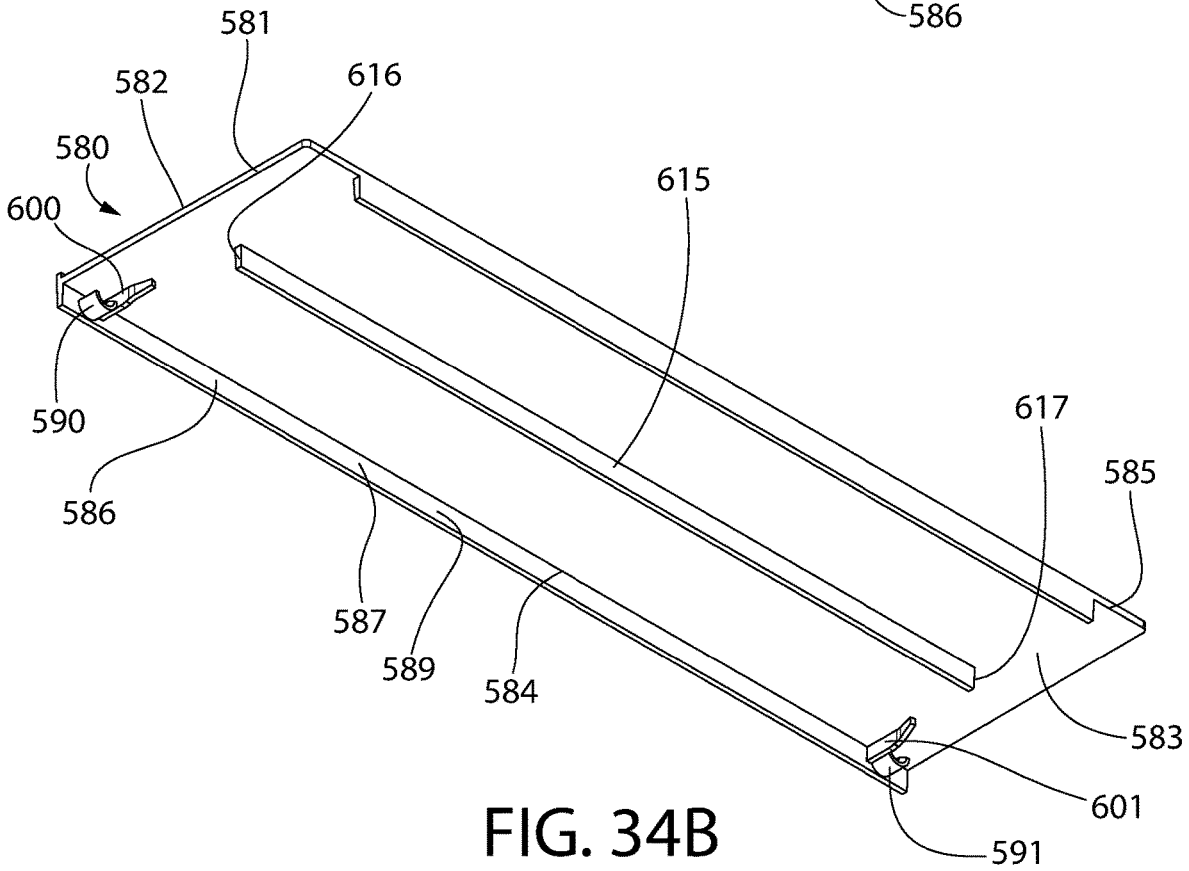
FIG. 34B is a bottom perspective view of the shelf of FIG. 34A.
Figure 34C:
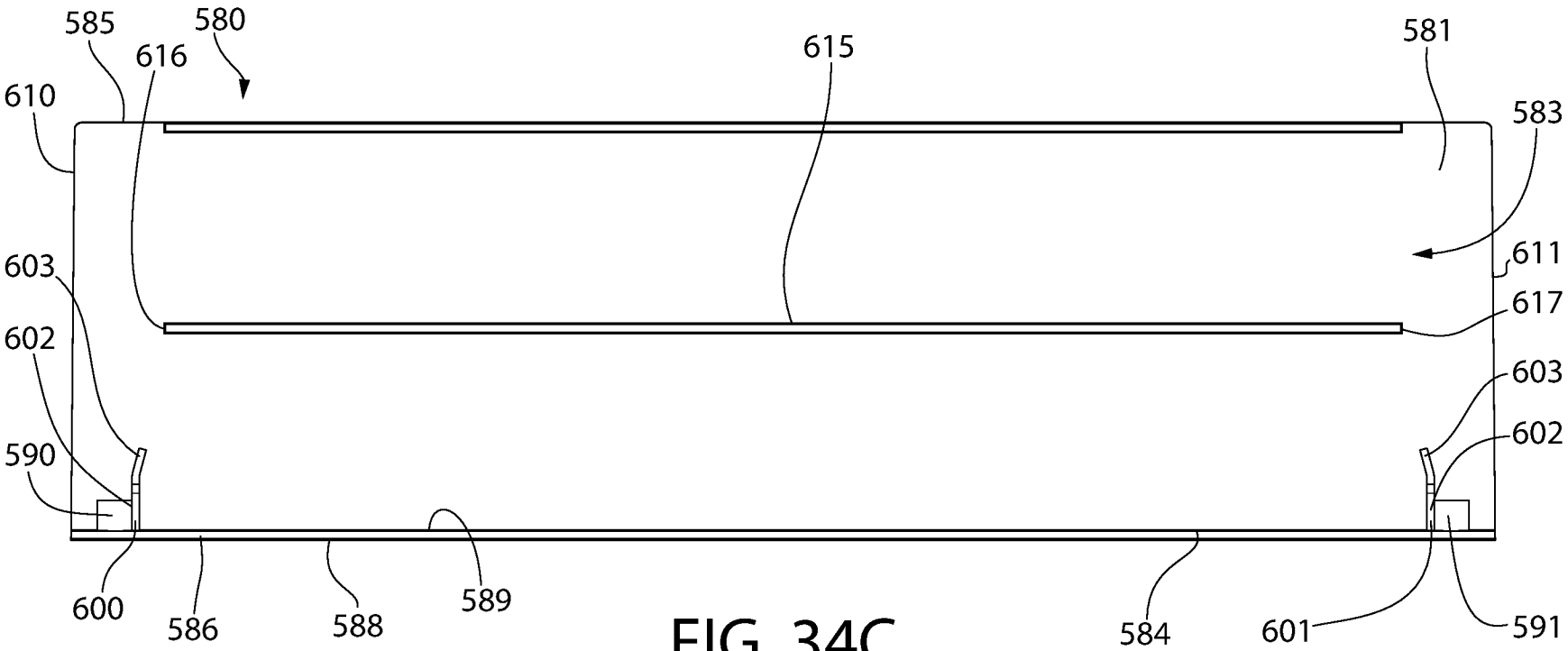
FIG. 34C is a bottom view of the shelf of FIG. 34A.
Figure 34D:
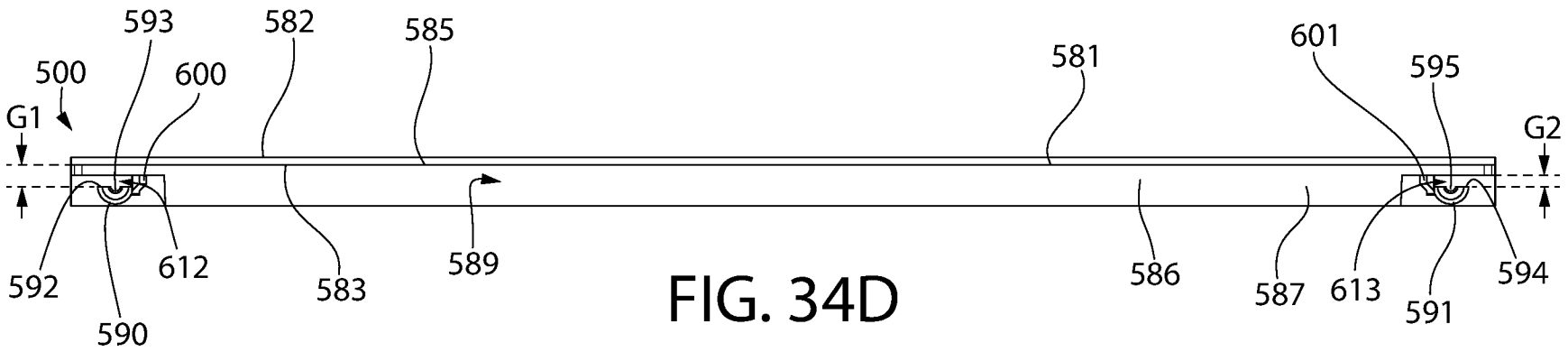
FIG. 34D is a rear view of the shelf of FIG. 34A.

Referring to FIGS. 33A and 33B, the shelf supports 560 will be described in detail. The shelf support 560 comprises a main body 564 and two of the connection elements 561 extending from the main body 564 in a spaced apart manner. Specifically, the main body 564 comprises a vertical wall 562 and a horizontal wall 563 extending from an end of the vertical wall 562. The horizontal wall 563 forms a ledge of the shelf support 560 that is configured to at least partially support one of the shelves 580. In the exemplified embodiment, the horizontal wall 563 and the vertical wall 562 are perpendicular to one another.

The connection elements 561 of the shelf support 560 extend from an upper portion of the vertical wall 562 of the main body 564. Specifically, the connection elements 561 in the exemplified embodiment are L-shaped brackets comprising a first portion 565 extending horizontally from the vertical wall 562 in a direction opposite the horizontal wall 563 of the main body 564 and a second portion 566 extending vertically from the first portion 565 in a direction away from the vertical wall 562 of the body 564. In the exemplified embodiment, the first portion 565 of the connection elements 561 is coplanar with the horizontal wall 563 of the main body 564.

As noted above, the horizontal wall 563 of the main body 564 forms a ledge that supports one of the shelves 580. When the shelf supports 560 are coupled to the housing 501, the horizontal wall or ledge 563 of the shelf supports 560 extends into the cavity 504 of the housing 501 to support the shelves 580 thereon. The horizontal wall 563 comprises a top surface 567 and a bottom surface 568 opposite the top surface 567. When installed, the shelf 580 rests atop and in direct surface contact with the top surface 567 of the horizontal wall 563. The horizontal wall 563 extends from the vertical wall 562 to a distal edge 569. Furthermore, the horizontal wall 563 is elongated from a first edge 570 to a second edge 571 along an axis F-F.

The shelf support 560 comprises an engagement feature 572 located on the bottom surface 578 of the horizontal wall/ledge 563. In the exemplified embodiment, the engagement feature 572 is a protuberance extending from the bottom surface 578 of the horizontal wall 563. However, the invention is not to be so limited and the engagement feature 572 can take on other forms in other embodiments, so long as it is configured to mate with an engagement feature of the shelf, as described in more detail below with particular reference to FIG. 36. In the exemplified embodiment, the engagement feature 572 comprises a first protuberance 572*a* and a second protuberance 572*b*, although in other embodiments only one of the first and second protuberances 572*a*, 572*b* may be included or the engagement feature 572 may be a structure that is not a protuberance (such as a notch or the like).

In the exemplified embodiment, the first and second protuberances 572*a*, 572*b* are located along the bottom surface 568 of the horizontal wall 563 so as to be spaced apart from the distal edge 569 and spaced apart from an inner surface 573 of the vertical wall 562. Furthermore, the first and second protuberances 572*a*, 572*b* are elongated in a direction of the axis F-F. The first protuberance 572*a* extends from the first edge 570 a short distance towards the second edge 571, an end face of the first protuberance 572*a* being flush with the first edge 570. The second protuberance 572*b* extends from the second edge 571 a short distance towards the first edge 570, an end face of the second protuberance 572*b* being flush with the second edge 571. In the exemplified embodiment, the first and second protuberances 572*a*, 572*b* are spaced apart from one another, but in other embodiments they may be connected to form a single protuberance extending along the bottom surface 578 of the horizontal wall 563. In the exemplified embodiment, each of the first and second protuberances 572*a*, 572*b* are cylindrical or conical-shaped and elongated in the direction of the axis F-F as noted above. Thus, the first and second protuberances 572*a*, 572*b* have curved, and specifically convex, outer surfaces in the exemplified embodiment. As will be discussed further below, the first and second protuberances 572*a*, 572*b* assist with alignment between the shelf 580 and the shelf support 560.

Referring to FIGS. 34A-D, the shelf 580 will be described. The shelf 580 comprises a top surface 582 and a bottom surface 583 opposite the top surface. More specifically, the shelf 580 comprises a horizontal support member 581 that forms the top surface 582 and the bottom surface 583 of the shelf 580. The horizontal support member 581 also comprises a front edge 584 and a rear edge 585 opposite the front edge 584. The horizontal support member 581 is elongated between lateral edges 610, 611 of the shelf 580 that extend between the front and rear edges 584, 585. The shelf 580 also comprises a concealment wall 586 extending from the front edge 584 of the horizontal support member 581. A first portion 587 of the concealment wall 586 extends below the bottom surface 583 of the horizontal support member. The concealment wall 586 has a front surface 588 and a rear surface 589 opposite the front surface 588.

Furthermore, the shelf 580 comprises a first tab 590 and a second tab 591. The first and second tabs 590, 591 protrude from the rear surface 589 of the concealment wall 586 in a direction towards the rear edge 585 of the horizontal support member 581. In the exemplified embodiment, the first and second tabs 590, 591 are located below the bottom surface 583 of the horizontal support member 581 so that the first and second tabs 590, 591 are entirely spaced apart from the bottom surface 583 of the horizontal support member 581. Specifically, the first tab 590 is spaced from the bottom surface 583 of the horizontal support member 581 by a first gap G1 and the second tab 591 is spaced from the bottom surface 583 of the horizontal support member 581 by a second gap G2. Thus, a first receiving slot 612 is formed between the bottom surface 583 of the shelf 580 and the first tab 590 and a second receiving slot 613 is formed between the bottom surface 583 of the shelf 580 and the second tab 591.

In the exemplified embodiment, the first and second tabs 590, 591 are arcuate shaped tabs. Thus, in the exemplified embodiment, the first tab 590 comprises a concave inner surface 592 that defines a first notch 593 and the second tab 591 comprises a concave inner surface 594 that defines a second notch 595. The concave inner surfaces 592, 594 of the first and second tabs 590, 591 face the bottom surface 583 of the horizontal support member 581. The first and second notches 593, 595 are configured to receive one of the engagement features 572 of one of the shelf supports 560 when the shelf 580 is resting on the shelf supports 560 as described herein below. Of course, the first and second tabs 590, 591 need not be arcuate in all embodiments and in other embodiments they may take on other shapes while still having the first and second notches 593, 595. For example, the first and second tabs 590, 591 could be square-shaped or the like while defining a square-shaped notch. However, so long as the notch is configured to interact/mate with the engagement feature 572 on the shelf support 560, the exact shape of the notch is not to be limiting of the present invention.

The shelf 580 further comprises a first guide rib 600 adjacent to the first tab 590 and a second guide rib 601 adjacent to the second tab 591. The first tab 590 is located between the first guide rib 600 and the first lateral edge 610 of the shelf 580 and the second tab 591 is located between the second guide rib 601 and a second lateral edge 611 of the shelf 580. In the exemplified embodiment, there is no space between the first guide rib 600 and the first tab 590 and there is no space between the second guide rib 601 and the second tab 591. Stated another way, the first guide rib 600 is coupled directly to the first tab 590 and the second guide rib 601 is coupled directly to the second tab 591 (best shown in FIG. 36). In the exemplified embodiment, the first receiving slot 612 is defined collectively by the first tab 590 and the first guide rib 600 and the second receiving slot 613 is defined collectively by the second tab 591 and the second guide rib 601.

The first and second guide ribs 600, 601 are connected directly to the rear surface 589 of the concealment wall 586 and to the bottom surface 583 of the horizontal support member 581. Thus, unlike the tabs 590, 591, the first and second guide ribs 600, 601 are not spaced apart from the bottom surface 583 of the horizontal support member 581. The first guide rib 600 comprises a first linear portion 602 extending from the rear surface 589 of the concealment wall 586 and a second linear portion 603 extending from the first linear portion 602 to a terminal end. The second guide rib 601 comprises a first linear portion 604 extending from the rear surface 589 of the concealment wall 586 and a second linear portion 605 extending from the first linear portion 605 to a terminal end. The first and second linear portions 602, 603 of the first guide rib 600 are oriented at an obtuse angle relative to one another and the first and second linear portions 604, 605 of the second guide rib 601 are oriented at an obtuse angle relative to one another. The second linear portions 603, 605 of the first and second guide ribs 600, 601 converge towards one another as they extend from the first linear portions 602, 604 of the first and second guide ribs 600, 601 respectively. Thus, the second linear portions 603, 605 extend in a direction away from the lateral edge of the shelf 580 that they are positioned closest to. The first and second guide ribs 600, 601 assist in guiding the protuberances 572*a*, 572*b* of the shelf supports 560 into the receiving channels 593, 595 of the tabs 590, 591.

The shelf 580 also comprises an elongated strengthening rib 615 extending from the bottom surface 583 of the shelf 580. The elongated strengthening rib 615 has a first end 616 and a second end 617 opposite the first end 616. In the exemplified embodiment, the first tab 590 is located between the first end 616 of the elongated strengthening rib 615 and the first lateral edge 610 of the shelf 580 and the second tab 591 is located between the second end 617 of the elongated strengthening rib 615 and the second lateral edge 611 of the shelf 580. Thus, the elongated strengthening rib 615 does not extend across the entirety of the length of the shelf 580 measured between the first and second lateral edges 610, 611 of the shelf 580. Rather, the elongated strengthening rib 615 terminates short of the first and second lateral edges 610, 611 of the shelf 580 to facilitate ease of installation as discussed below.

Figure 35:
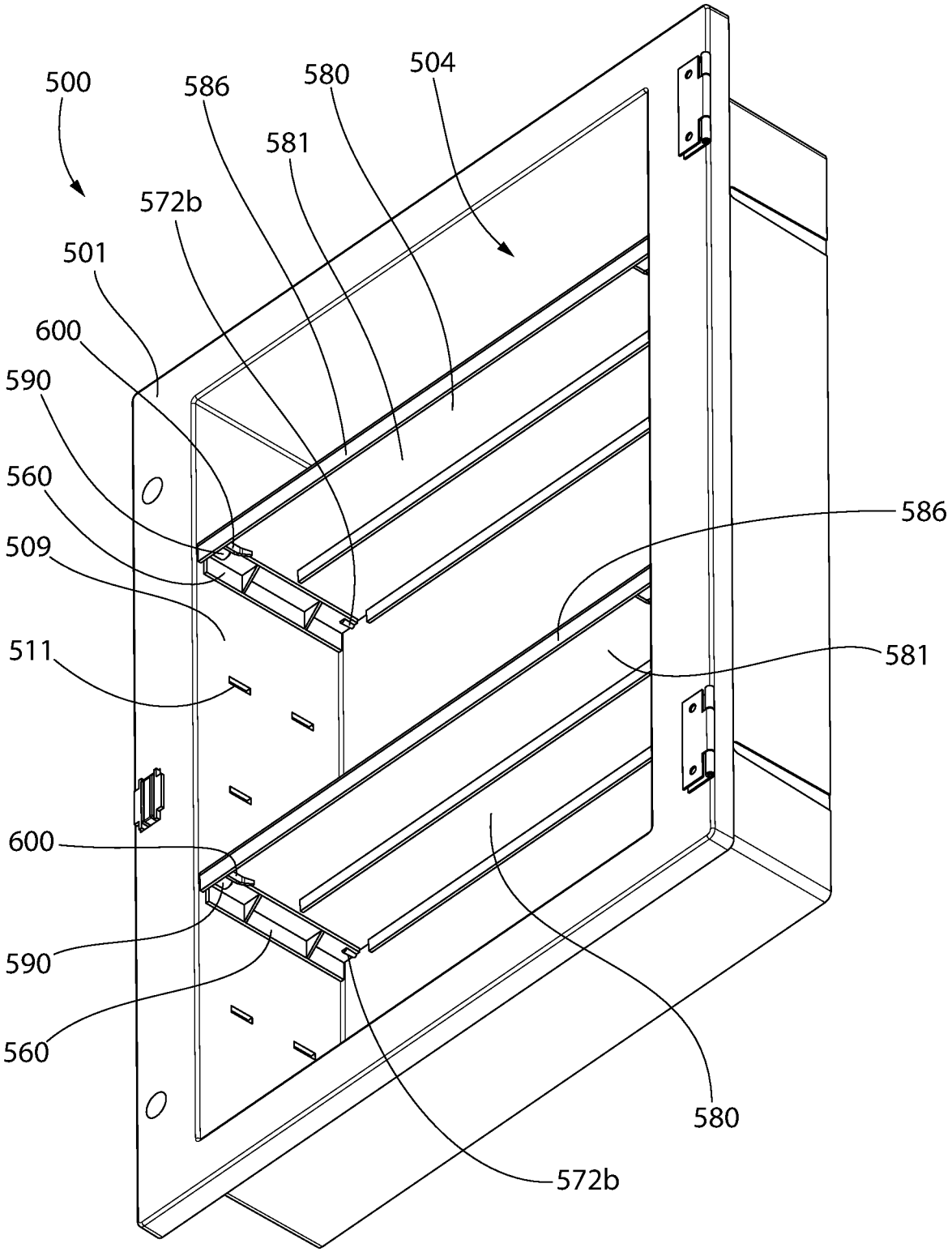
FIG. 35 is a front bottom perspective view of the cabinet of FIG. 27 with the door removed.
Figure 36:
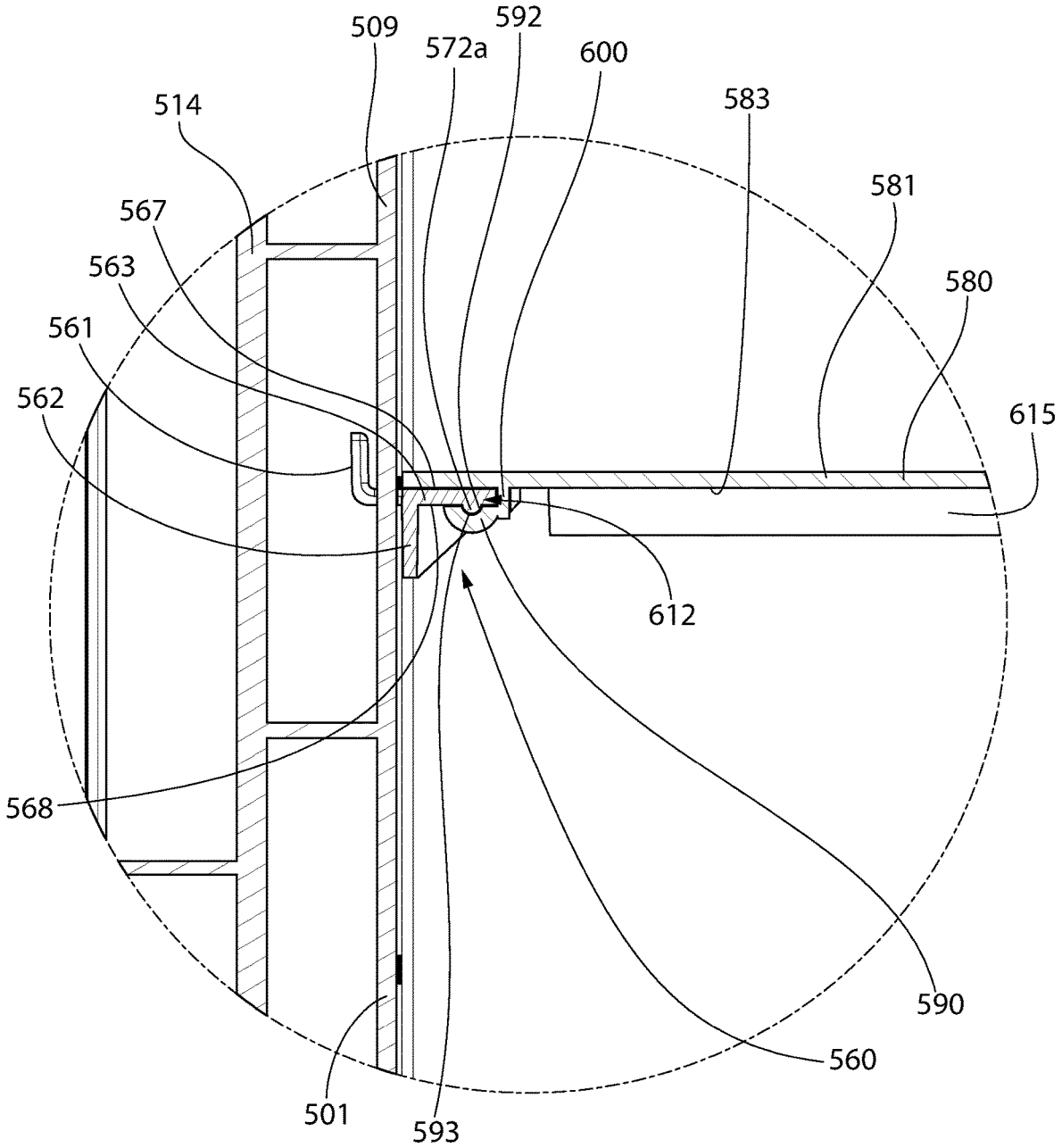
FIG. 36 is a cross-sectional view taken along line XXXVI-XXXVI of FIG. 32 with a shelf support coupled to a housing of the cabinet and a shelf supported by the shelf support.

FIGS. 35 and 36 illustrate the shelf supports 560 coupled to the housing 501 and the shelves 580 resting atop of the shelf supports 560 and the interaction between the protuberances 572*a*, 572*b* of the shelf supports 560 and the tabs 590, 591 of the shelves 580. To assemble the cabinet 500, first the shelf supports 560 are coupled to the housing 501 so that one shelf support 560 is coupled to each of the first and second inner sidewalls 508, 509 of the housing 501 at the same elevation. This is accomplished by inserting the connection elements 561 of the shelf supports 560 into the openings 510, 511 of the first and second inner sidewalls 508, 509. When the shelf supports 560 are coupled to the housing 501 as shown, the horizontal wall or ledge 563 of the shelf supports 560 extend from the sidewall 508, 509 of the housing 501 that they are attached to into the cavity 504.

Next, one of the shelves 580 is slidably inserted into the cavity 504 of the housing 501 by resting the bottom surface 583 of the horizontal support member 581 of the shelf 580 on the top surface 567 of the horizontal wall or ledge 563 of two of the shelf supports 560 on the opposing sidewalls 508, 509. Next, the shelf 580 is slid into the cavity 504 while the bottom surface 583 of the horizontal support member 581 remains in sliding contact with the top surface 567 of the horizontal wall or ledge 563. This is possible in part because the elongated strengthening rib 615 does not extend the full length of the shelf 580, thereby leaving space for the shelf supports 560 to pass between the elongated strengthening rib 615 and the opposing lateral side edges 610, 612 of the shelf 580 during installation of the shelf 580.

As the shelf 580 is slid into the cavity 504, portions of the horizontal wall or ledge 563 that comprises the engagement features 572 extend into the first and second receiving slots 612, 613 defined between the first and second tabs 590, 591 and the bottom surface 583 of the shelf 580. Simultaneously, the protuberances 572*a*, 572*b* of the shelf supports 560 are guided into the first and second notches 593, 595 of the tabs 590, 591. When the shelf 580 is fully installed in the cavity 504, one of the protuberances 572*a*, 572*b* of each shelf support 560 on which the shelf 580 is positioned is located within the notch 583, 585 of one of the tabs 590, 591 of the shelf 580. Furthermore, a portion of the horizontal wall or ledge 563 of the shelf support 560 is located within the gap between the tabs 590, 591 and the bottom surface 583 of the horizontal support member 581 of the shelf 580 (i.e., within one of the receiving slots 612, 613). This locks the shelf 580 in place within the cavity 504 so that it cannot be readily moved side-to-side or up-down within the cavity 504.

In the exemplified embodiment, the shelf 580 can be readily removed from the cavity 504 by sliding the shelf 580 in the opposite direction out of the cavity 504. However, in other embodiments the shelf 580 and shelf supports 560 may include additional locking features, such as an indent/detent that interact/mate with one another when the shelf 580 is fully installed in the cavity 504. For example, an indent protruding from the bottom surface 583 of the shelf 580 may interact with a detent in the shelf support 560 (or vice versa) so that an action in addition to mere sliding is needed to remove the shelf 580 from the cavity 504.

In the exemplified embodiment, the first and second tabs 590, 591 are C-shaped. Although described herein as being arcuate and C-shaped, the first and second tabs 590, 591 need not be arcuate in all embodiments. In other embodiments, the tabs 590, 591 may be flat plates that are spaced apart from the bottom surface 583 of the horizontal support member 581 of the shelf 580 so that during sliding of the shelf 580 onto the shelf support 560, the horizontal wall or ledge 563 of the shelf support 560 nests in the gap or space between the protrusions 590, 591 and the bottom surface 583 of the horizontal support member 581 of the shelf 580. Along the same lines, in some embodiments the shelf supports 560 may not have protuberances 572*a*, 572*b*, but simply trapping the horizontal wall or ledge 563 of the shelf supports 560 within the space between the protrusions 590, 591 and the bottom surface 583 of the horizontal support member 581 is sufficient to securely couple the shelves 580 to the shelf supports 560.

Figure 37:
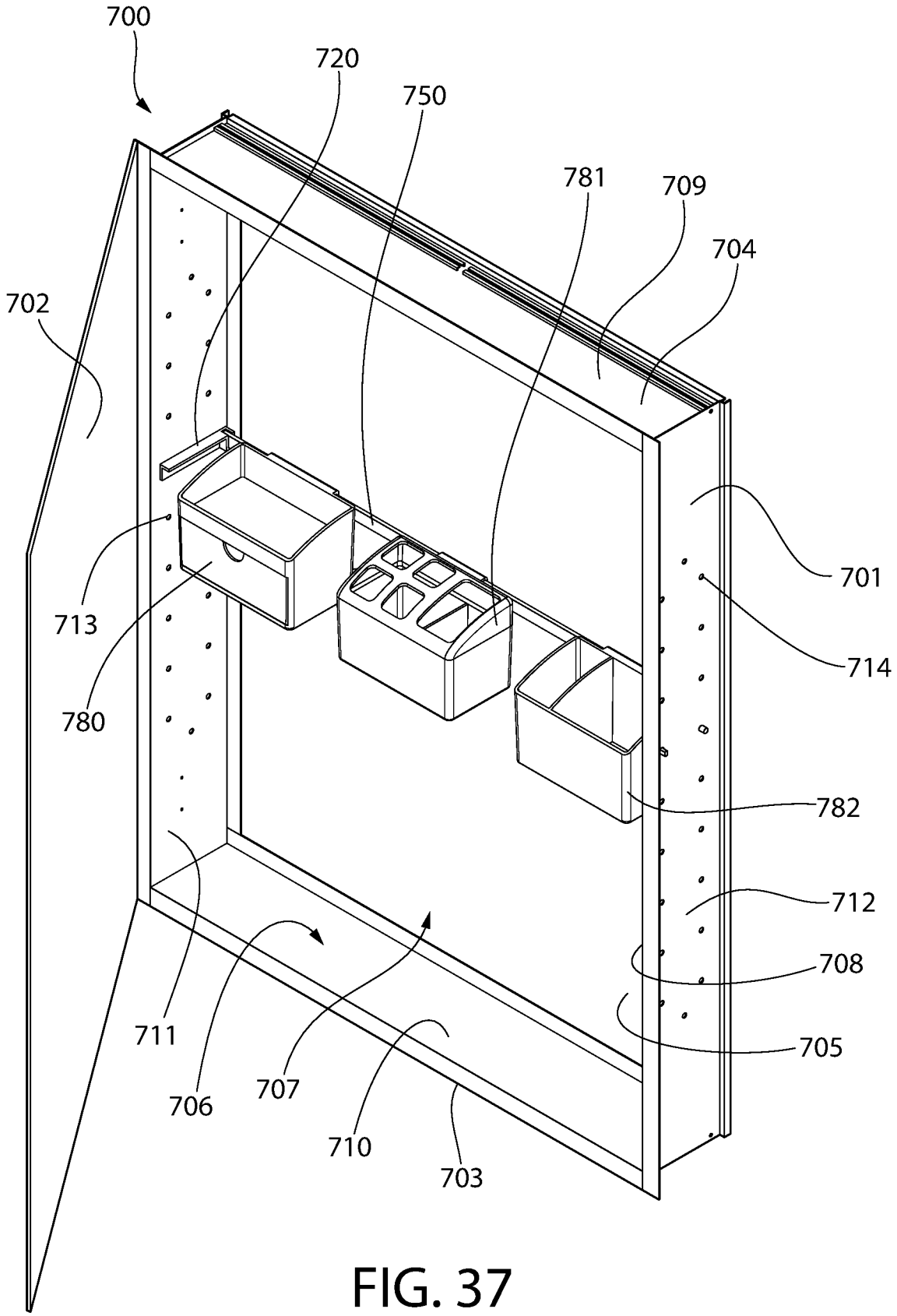
FIG. 37 is a front perspective view of a cabinet in accordance with yet another embodiment of the present invention.
Figure 38:
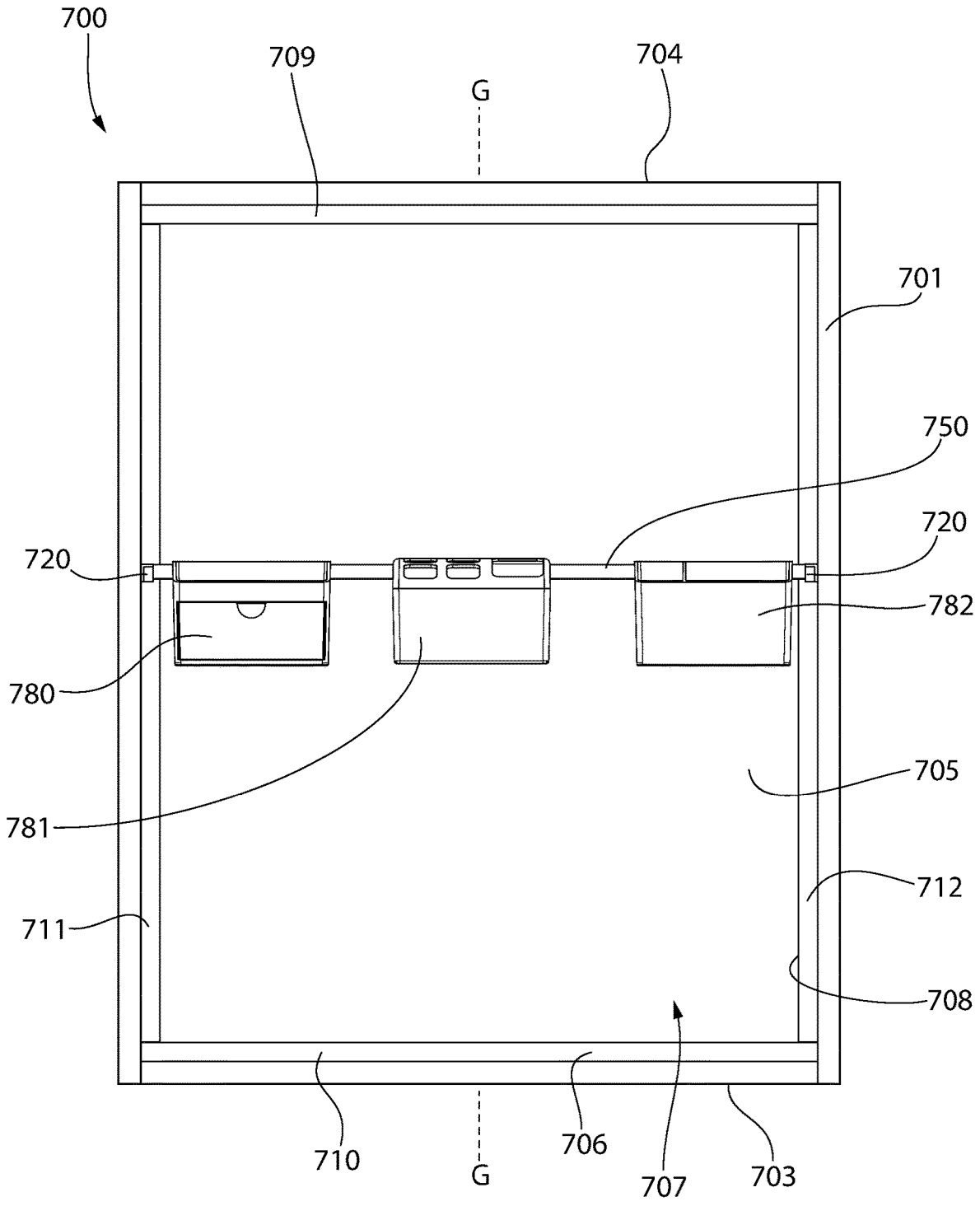
FIG. 38 is a front view of the cabinet of FIG. 37 with the door removed.
Figure 39:
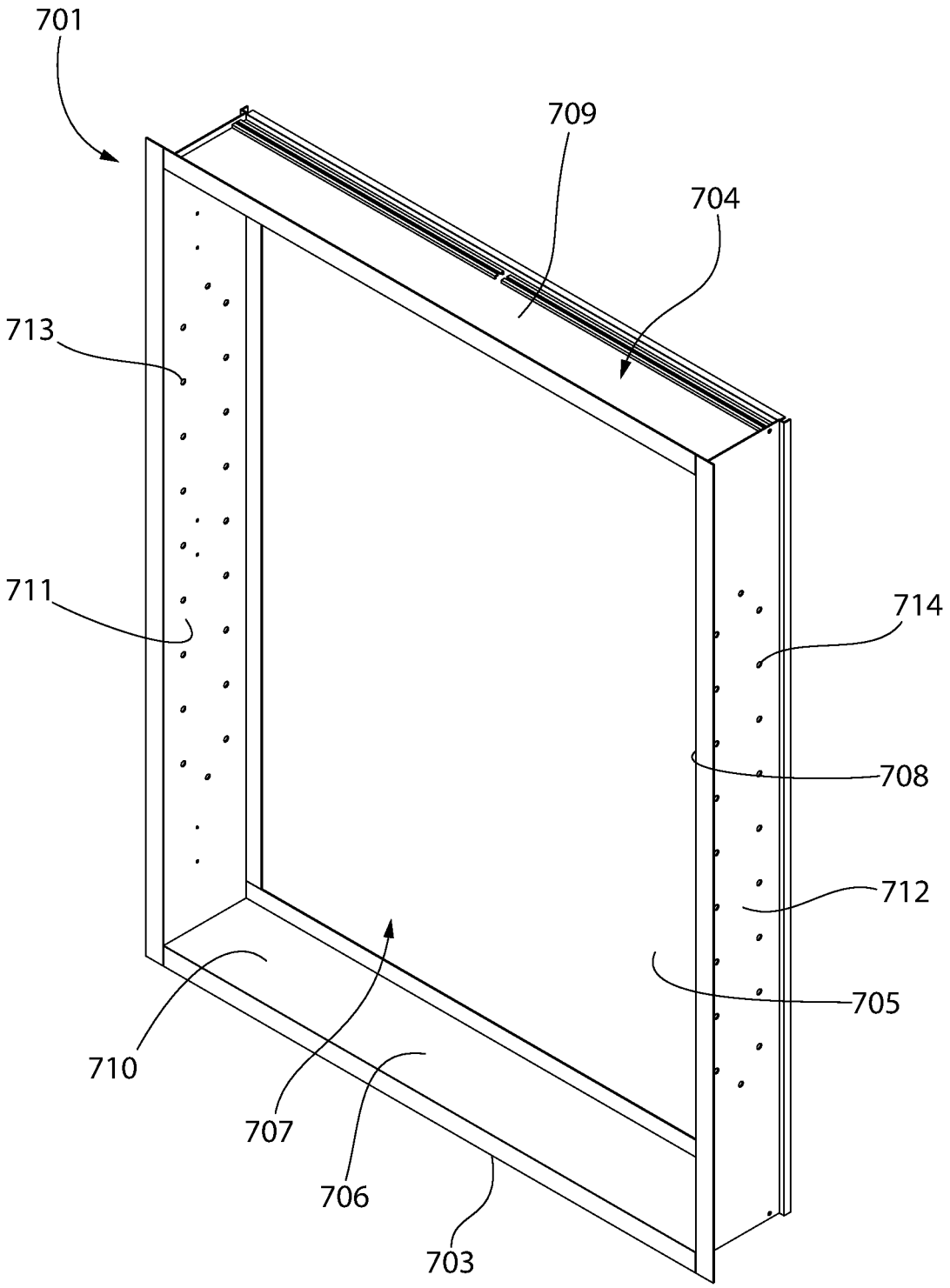
FIG. 39 is a front perspective view of a housing of the cabinet of FIG. 37.

Referring to FIGS. 37-39, a cabinet 700 will be described in accordance with another embodiment of the present invention. The cabinet 700 generally comprises a housing 701, a door 702 that is coupled to the housing 701, a plurality of support members 720 that are configured to be coupled to the housing 701, a support rod 750 that is configured to be supported by the support members 720, and at least one storage receptacle 780 that is configured to be slidably mounted to the support rod 750. In the exemplified embodiment, there are a plurality of storage receptacles 780, 781, 782, but one storage receptacle may be used in alternative embodiments. In some embodiments there may be a plurality of different storage receptacles such as those shown in FIGS. 37 and 38 mounted to the support rod 750 and in other embodiments there may be a plurality of the same storage receptacles mounted to the support rod 750. Thus, there is flexibility for the end user to determine the best storage receptacles for his/her needs based on the types of items that are being stored in the cabinet 700. The door 702 may be altered between an open state (shown in FIG. 37) and a closed state (not shown) as would be appreciated by persons skilled in the art.

The housing 701 extends from a bottom end 703 to a top end 704 along an axis G-G. The housing 701 comprises a rear wall 705 and a plurality of sidewalls 706 that collectively define a cavity 707 having an opening 708 that can be enclosed by the door 702 when the door 702 is in the closed state. In the exemplified embodiment the housing 701 has a square or rectangular shape and thus the plurality of sidewalls 706 comprises a top wall 709, a bottom wall 710, a first sidewall 711, and a second sidewall 712 opposite the first sidewall 711. However, the invention is not to be so limited in all embodiments and the housing 701 may take on any desired shape and thus the plurality of sidewalls 706 may include more or less sidewalls than indicated and shown in the drawings.

In the exemplified embodiment, the first sidewall 711 comprises a plurality of openings 713 and the second sidewall 712 comprises a plurality of openings 714 that are aligned with the openings 713 in the first sidewall 711. The openings 713, 714 are configured to receive portions of the support members 720 to facilitate coupling of the support members 720 to the first and second sidewalls 711, 712 of the housing 701.

As noted above, in the exemplified embodiment there are three different storage receptacles 780, 781, 782 slidably mounted to the support rod 750. Specifically, the first storage receptacle 780 comprises a drawer and a shelf, the second storage receptacle 781 has a plurality of distinct compartments accessible through openings in a lid, and the third storage receptacle 782 has two separate chambers for storing different items. Of course, the specific configuration and arrangement of the storage receptacles 780, 781, 782 is not to be limiting of the invention in all embodiments. The storage receptacles 780, 781, 782 may take on other structural forms different than that shown in the exemplified embodiment. The purpose of the storage receptacles 780, 781, 782 is to hold and store items within the cavity 704 of the cabinet 700. Thus, the storage receptacles 780, 781, 782 may be designed and specifically tailored to store different types and sizes of items. In the exemplified embodiment and by way of example only, the first storage receptacle 780 may be best suited for storing hair clips or other small items, the second storage receptacle 780 may be best suited for storing items with a handle, such as a toothbrush, make-up applicator, hairbrush, Q-tips, or the like, and the third storage receptacle 782 may be best suited for storing toothpaste tubes, deodorant, or the like. The storage receptacles 780, 781, 782 may be formed of a transparent plastic material, or they may be formed of a non-transparent plastic material, or they may be formed of a material other than plastic such as wood, metal, or the like.

Figure 40A:
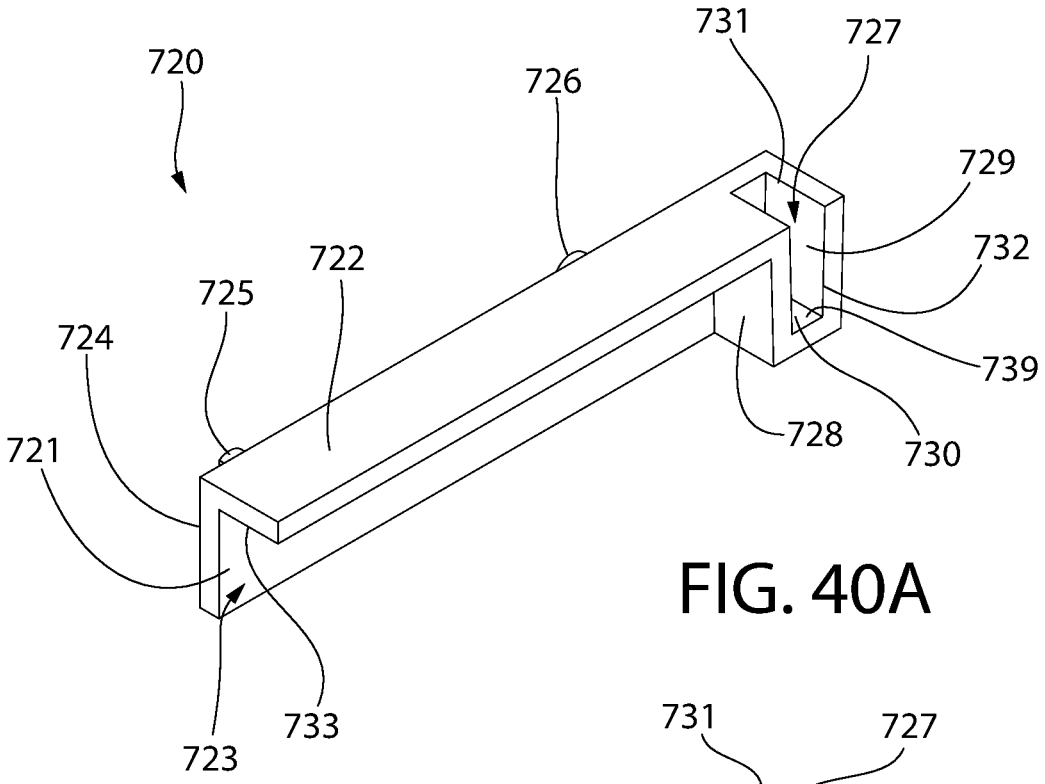
FIG. 40A is a front top perspective view of one of the support members of the cabinet of FIG. 37.
Figure 40B:
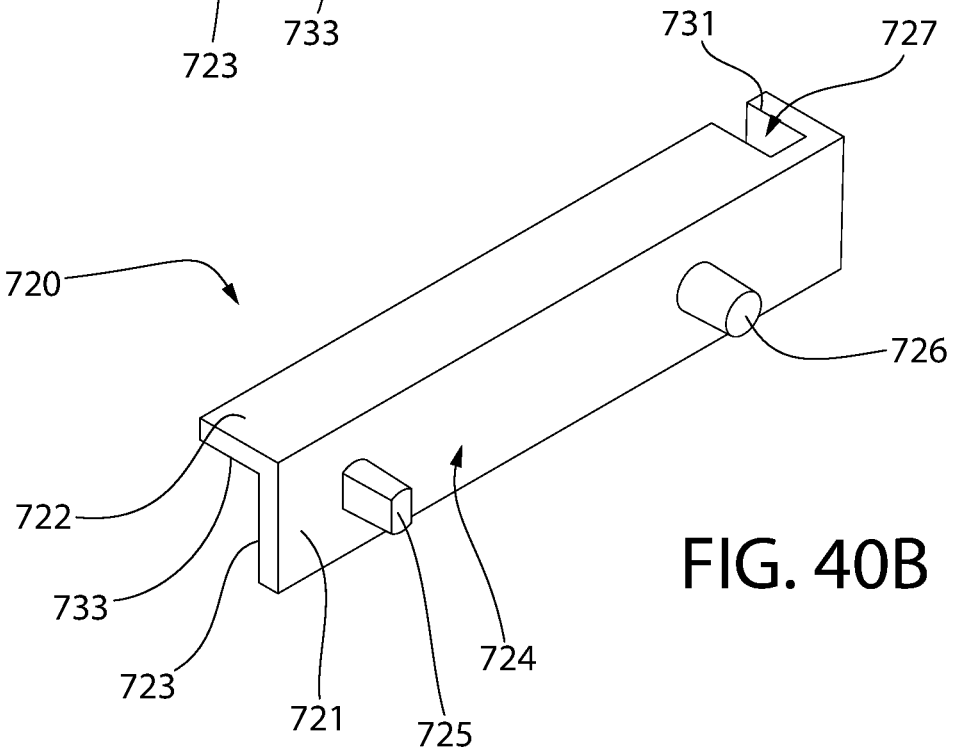
FIG. 40B is a rear top perspective view of the support member of FIG. 40A.

Referring to FIGS. 40A and 40B, the structural details of the support members 720 will be described in more detail. As noted above, at least one of the support members 720 is coupled to each of the first and second sidewalls 711, 712 of the housing 701 to retain the support rod 750 within the cavity 707 of the housing 701. It is possible that more than one support member 720 may be coupled to each of the first and second sidewalls 711, 712 in other embodiments thereby enabling multiple support rods 750 to be positioned within the cavity 707 of the housing 701 at different elevations.

In the exemplified embodiment, the support members 720 comprise a first wall 721 and a second wall 722 extending perpendicular from the first wall 721. Specifically, the first wall 721 comprises a first surface 723 and a second surface 724 opposite the first surface 723. In the exemplified embodiment, the second wall 722 protrudes from the first surface 723 of the first wall 721. When coupled to the housing 701, the first wall 721 is adjacent to (and possibly in contact with) one of the first and second sidewalls 711, 712 and the second wall 722 extends into the cavity 707 of the housing 701. Of course, it is possible in other embodiments for the first wall 721 to be omitted and for the support member 720 to still function in the manner described herein.

In the exemplified embodiment, the support member 720 comprises a first protrusion 725 and a second protrusion 726 extending from the second surface 724 of the first wall 721. In the exemplified embodiment, the first protrusion 725 has a square-shaped cross-sectional profile and the second protrusion 726 has a circular shaped cross-sectional profile. However, the invention is not intended to be limited by this and both of the first and second protrusions 725, 726 may have the same shape, such as both having square or both having circular (or other) cross-sectional profiles. The first and second protrusions 725, 726 are configured to be inserted into the openings 713, 714 in the sidewalls 711, 712 of the housing 701 to couple the support member 720 to the housing 701. Generally, the first and second protrusions 725, 726 mate/interact with the openings 713, 714 via a friction fit, but other types of coupling are possible (threaded engagement, use of nuts or bolts, or the like). In other embodiments, the first and second protuberances 725, 726 could be hooks or brackets such as the those that have been described above particularly with reference to FIGS. 33A and 33B.

The support member 720 also comprises a receiving slot 727. In some embodiments, the support member 720 need only have a structure that facilitates coupling of the support member 720 to the housing 701 and a receiving cavity that enables the support member 720 to support the support rod 750 as discussed further herein below. Thus, the support member 720 can be significantly reduced in size without affecting its functionality as described herein.

In the exemplified embodiment, the receiving slot 727 is defined by a first slot wall 728, a second slot wall 729 that is spaced apart from the first slot wall 728, a bottom slot wall 730 that extends between the first and second slot walls 728, 729 and forms a floor 739 of the receiving slot 727, and a portion of the first wall 721 that extends between the first and second slot walls 728, 729. Each of the first and second slot walls 728, 729 extends from the first surface 723 of the first wall 721 as well as from a bottom surface 733 of the second wall 722. The bottom slot wall 730 extends from the front surface 723 of the first wall 721 and is spaced apart from the second wall 722. The receiving slot 727 comprises an open top end 731 and an open side 732.

The first slot wall 728, the second slot wall 729, and the bottom slot wall 730 collectively define a U-shaped structure designed to receive the support rod 750 therein. In some embodiments the support member 720 may comprise only the first slot wall 728, the second slot wall 729, the bottom slot wall 730, and the portion of the first wall 721 that extends between the first and second slot walls 728, 729. In such an embodiment, one of the connection protrusions 725, 726 may extend from the rear surface 724 of the portion of the first wall 721 to couple the support member 720 to the housing 701. Thus, in some embodiments the full structure of the support member 720 is not needed to achieve the function described herein.

Figure 41:
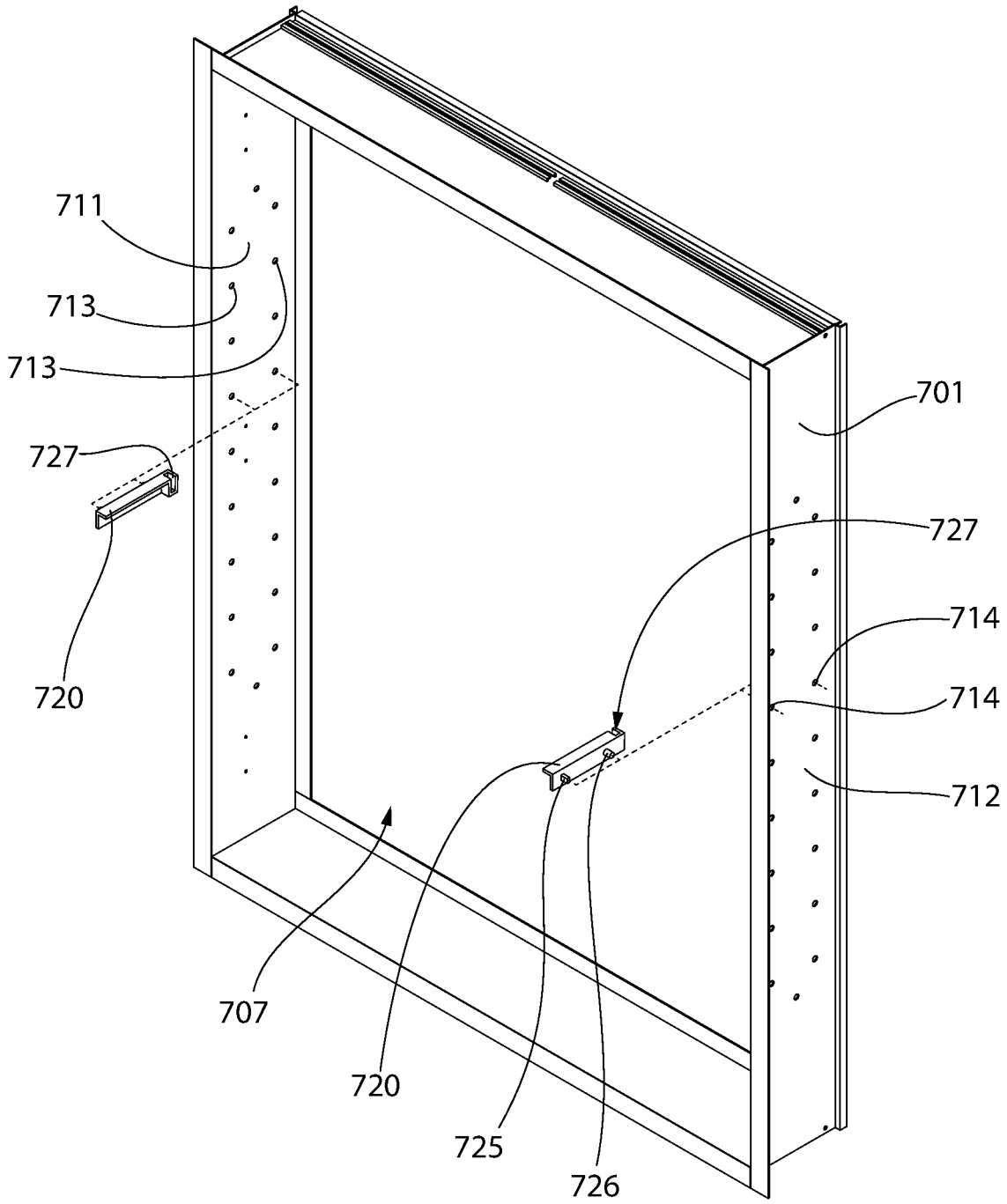
FIG. 41 is a front perspective view of the housing of the cabinet of FIG. 39, illustrating the manner of coupling the support members to the housing.

Referring to FIG. 41, the housing 701 is illustrated with two of the support members 720 in preparation for coupling to the housing 701. Specifically, the dashed lines leading from the first and second protrusions 725, 726 of the support members 720 to the openings 713, 714 in the first and second sidewalls 711, 712 illustrate how the support members 720 are coupled to the housing 701 via engagement between the protrusions 725, 726 and the openings 713, 714.

Figure 42:
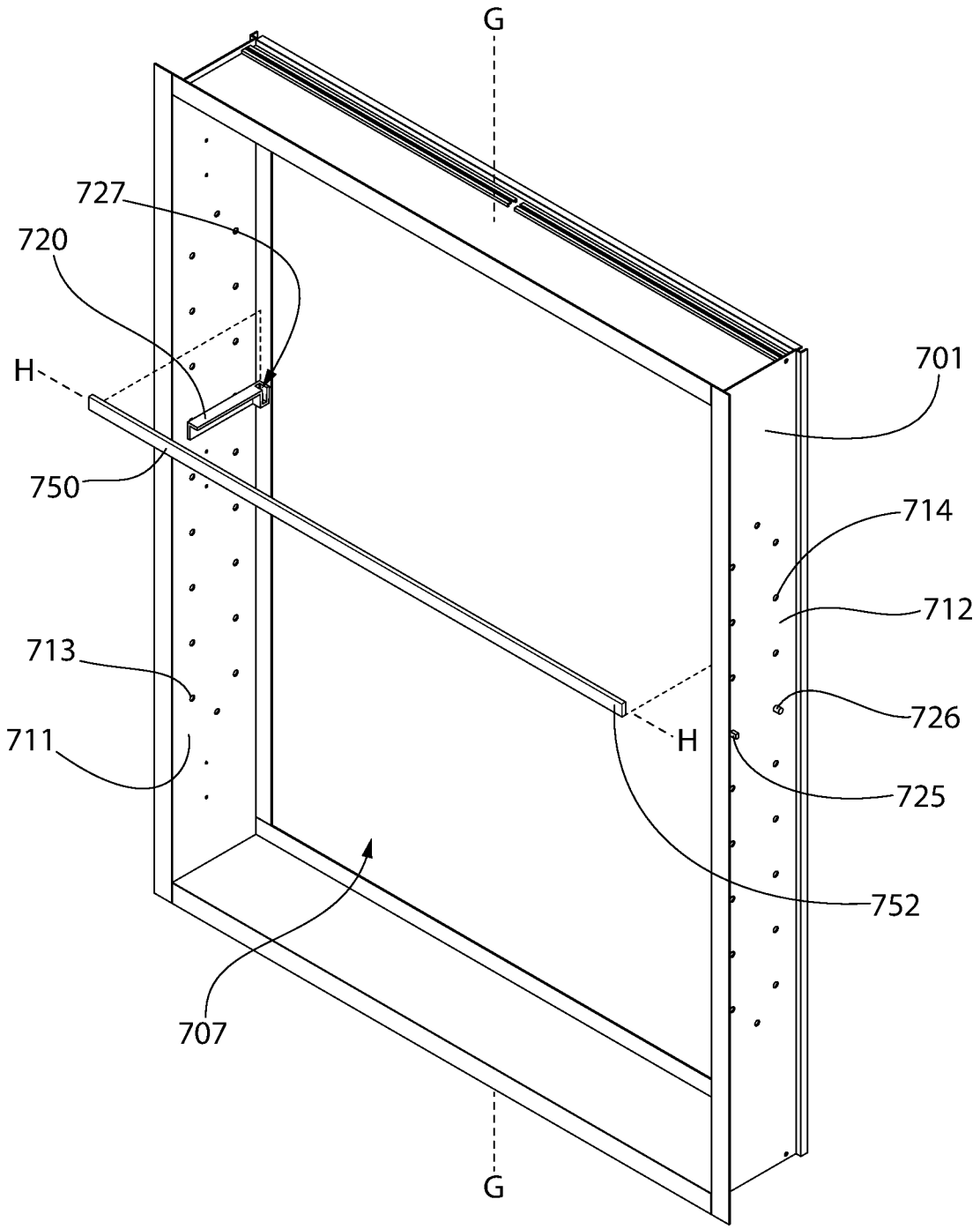
FIG. 42 is a front perspective view of the housing of the cabinet with two of the support members coupled to the housing, illustrating the manner of coupling a support rod to the support members.
Figure 43:
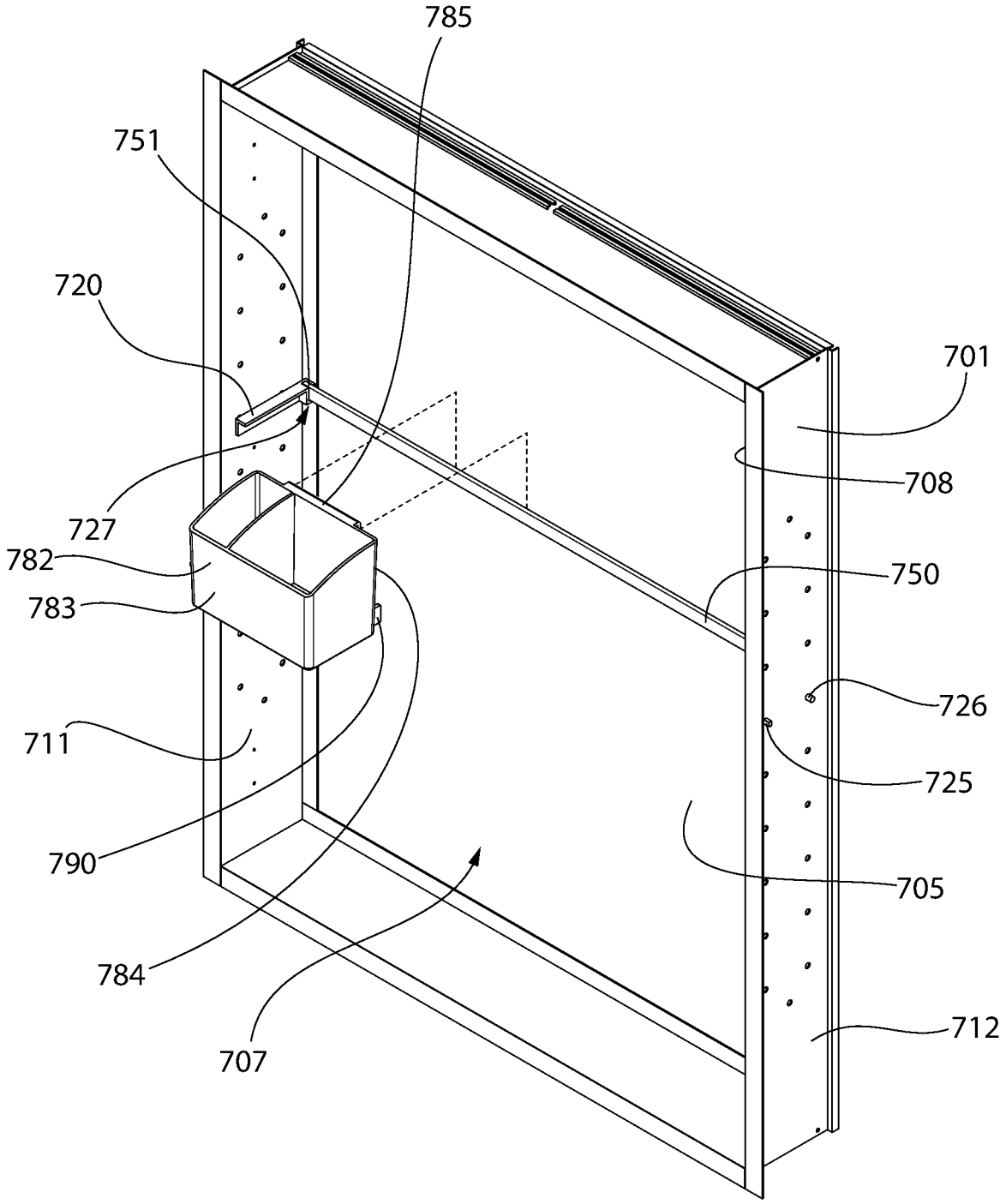
FIG. 43 is a front perspective view of the housing of the cabinet with the support members and the support rod installed, illustrating the manner of mounting a storage receptacle to the support rod.

FIG. 42 illustrates the housing 701 with one of the support members 720 coupled to the first sidewall 711 and one of the support members 720 coupled to the second sidewall 712 and with the support rod 750 prepared to be inserted into the cavity 707 and supported by the support members 720. The support members 720 on the opposite first and second sidewalls 711, 712 are aligned with one another along a horizontal axis that is perpendicular to the axis G-G of the housing 701. This ensures that the support rod 750 is level when supported in the cavity 707 of the housing 701. When the support members 720 are coupled to the housing 701, the receiving slots 727 of the support members 720 are adjacent to the rear wall 705 of the housing 701. This ensures that when the support rod 750 is mounted to the support members 720, the support rod 750 is located in a rear portion of the cavity 707 so that there is sufficient space for the storage receptacles 780, 781, 782.

In the exemplified embodiment, the support rod 750 is a metal rod. However, the invention is not to be so limited and the support rod 750 may be formed of any material, preferably rigid material, such as hard plastic, wood, or the like. The support rod 750 should be rigid so that it can support the weight of the storage receptacles 780, 781, 782 and any items stored therein without significant bending of the support rod 750. The support rod 750 extends from a first end 751 to a second end 752 along an axis H-H. When supported in the cavity 707 the axis H-H of the support rod 750 is perpendicular to the axis G-G of the housing 701. In the exemplified embodiment, the support rod 750 has a rectangular transverse cross-sectional shape. However, the invention is not to be so limited and the support rod 750 may have a circular, triangular, or other shaped transverse cross-sectional profile without affecting its functionality. Thus, the exact transverse cross-sectional shape of the support rod 750 is not to be limiting of the present invention. The support rod 750 must merely be elongated and configured to slidably support the storage receptacles 780, 781, 782 as described herein.

Referring to FIGS. 42, 43, 45, and 46 concurrently, the support rod 750 is supported within the cavity 707 of the housing 701 by placing the first end 751 of the support rod 750 into the receiving slot 727 of the support member 720 that is coupled to the first sidewall 711 and placing the second end 752 of the support rod 750 into the receiving slot 727 of the support member 720 that is coupled to the second sidewall 712. Thus, the first end 751 of the support rod 750 passes through the open top end 731 of the receiving slot 727 of the support member 720 on the first sidewall 711 while the second end 752 of the support rod 750 passes through the open top end 731 of the receiving slot 727 of the support member 720 on the second sidewall 712. The first and second ends 751, 752 of the support rod 750 are supported by the floor 739 of the support members 720 formed by the bottom slot wall 730. The support rod 750 extends through the open sides 732 of the receiving slot 727 of the support members 720. The support rod 750 is illustrated in this supported state in FIG. 43.

Although in the exemplified embodiment the support rod 750 is a separate component from the first and second support members 720, the invention is not to be so limited. In other embodiments, the support rod 750 may be integral with the first and second support members 720. Alternatively, the support rod 750 may include connection elements that facilitate coupling of the support rod 750 to the first and second sidewalls 711, 712 of the housing 701 directly so that the first and second support members 720 may be omitted.

Figure 46:
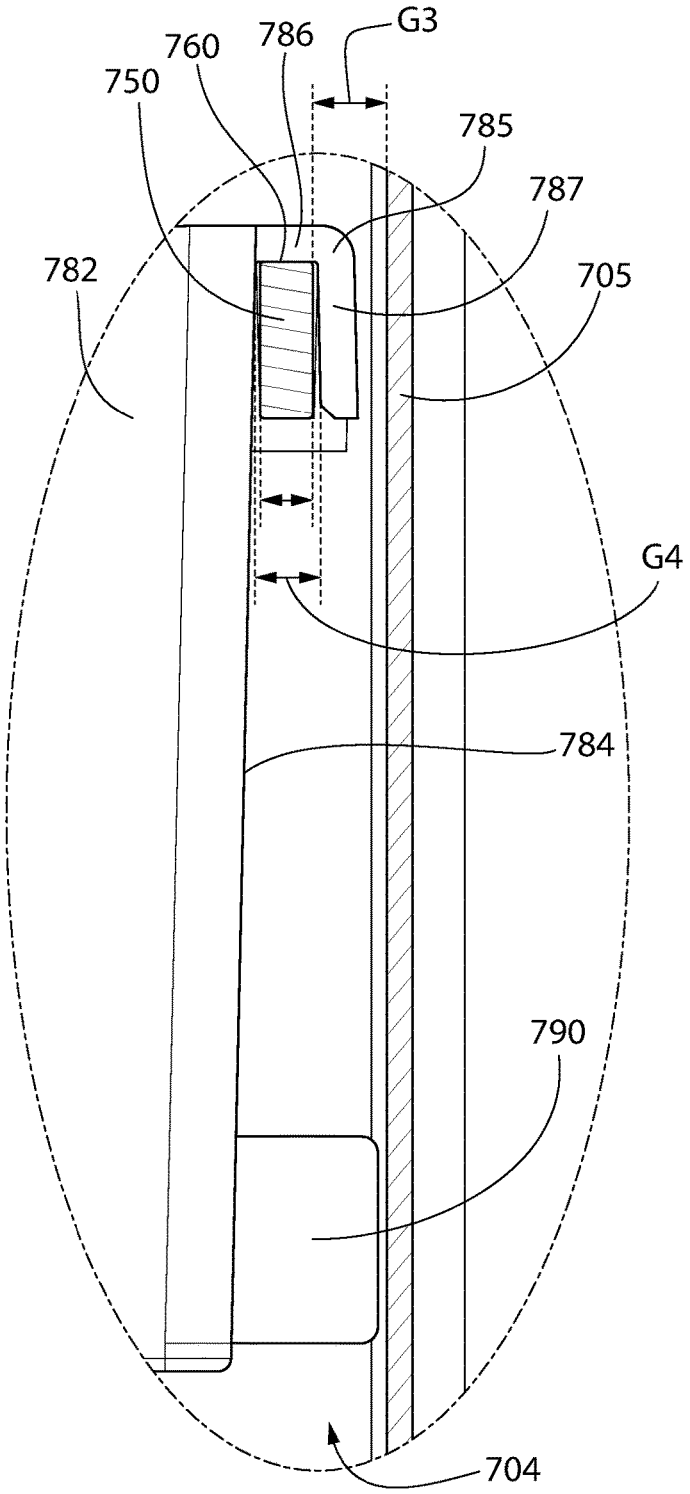
FIG. 46 is a close-up view of area XLVI of FIG. 45.

Returning to the exemplified embodiment, when the support rod 750 is coupled to the support members 720 on the opposing sidewalls 711, 712, the support rod 750 extends transversely across the cavity 707 from the first sidewall 711 to the second sidewall 712. Due to the receiving slots 727 of the support members 720 being located adjacent the rear wall 705 of the housing 701 as discussed above, the support rod 750 is located in a rear portion of the cavity 707 adjacent to the rear wall 705. However, as best seen in FIG. 46, the support rod 750 is spaced apart from the rear wall 705 of the housing 701 by a gap G3. The gap G3 provides a space for a mounting element of the storage receptacles 780, 781, 782 to be positioned to couple the storage receptacles 780, 781, 782 to the support rod 750 as discussed further below. A ratio of a depth of the cavity 707 (measured from the rear wall 705 to the open front end 708) to a depth of the gap G3 may be between 25:1 and 15:1, more specifically between 23:1 and 17:1, and still more specifically between 21:1 and 19:1. Thus, the support rod 750 is located in a rear 10%, or even a rear 5% of the depth of the cavity 707.

Referring to FIGS. 43-46 concurrently, the coupling of the storage receptacle 782 to the support rod 750 will be described. The description that follows is with reference to the storage receptacle 782, but the coupling of any of the storage receptacles 780, 781 or any other storage receptacle with a design different than the ones shown will be the same as that described herein. The storage receptacle 782 comprises a front surface 783 that is adjacent to the open front end 708 of the cavity 707 when installed and an opposite rear surface 784. Furthermore, the storage receptacle 782 comprises a mounting element 785 on the rear surface 784. Of course, the mounting element 785 need not be located on the rear surface 784 in all embodiments and it could be at other locations on the storage receptacle 782 without affecting its ability to couple the storage receptacle 782 to the support rod 750. In the exemplified embodiment, the mounting element 785 is a hook-like element protruding from the rear surface 784 of the storage receptacle 782. Thus, the mounting element 785 comprises a first portion 786 protruding from the rear surface 784 and a second portion 787 protruding downwardly from the first portion 786. The second portion 787 of the mounting element 785 is spaced apart from the rear surface 784 of the storage receptacle 782 by a gap G4. The gap G4 is configured to receive the support rod 750 to thereby couple the storage receptacle 782 to the support rod 750. In the exemplified embodiment, the mounting element 785 is located at or near a top portion of the rear surface 784.

Although the hook-like mounting element is described in the exemplified embodiment, the mounting element 785 could take on other structural forms while still facilitating a sliding coupling between the storage receptacle 782 and the support rod 750. For example, the support rod 750 could have an elongated channel on its major surface that faces away from the rear wall 705 and the mounting element 785 could be a structure that fits within the elongated channel to couple the mounting element 785 to the support rod 750 while permitting sliding of the mounting element 785 and the storage receptacle 782 relative to the support rod 750. The mounting element 785 could also be a clamp or the like that is capable of mating, preferably in a slidable manner, with the support rod 750. Thus, variations in the manner of coupling the storage receptacle 782 to the support rod 750 are possible within the scope of the invention described herein. Generally, the storage receptacle 782 should be detachably mountable to the support rod 750 so that when the storage receptacle 782 is mounted to (or coupled to) the support rod 750, the storage receptacle 782 can slide along the storage rod 750 while remaining mounted to the support rod 750.

In the exemplified embodiment, the storage receptacle 782 is coupled to the support rod 750 by moving the storage receptacle 782 into the cavity 707 and then lowering the storage receptacle 782 so that the mounting element 785 engages the support rod 750. More specifically, as the storage receptacle 782 is lowered, the support rod 750 enters into the gap G4 between the second portion 787 of the mounting element 785 and the rear surface 784 of the storage receptacle 782. The thickness of the support rod 750 is less than the width of the gap G4 so that the support rod 750 can fit entirely within the gap G4. When the mounting element 785 is coupled to the support rod 750, the first portion 786 of the mounting element 785 rests atop of a top surface 760 of the support rod 750 and the second portion 787 of the mounting element 785 is positioned within the gap G3 between the support rod 750 and the rear wall 705 of the housing 701.

Figure 44:
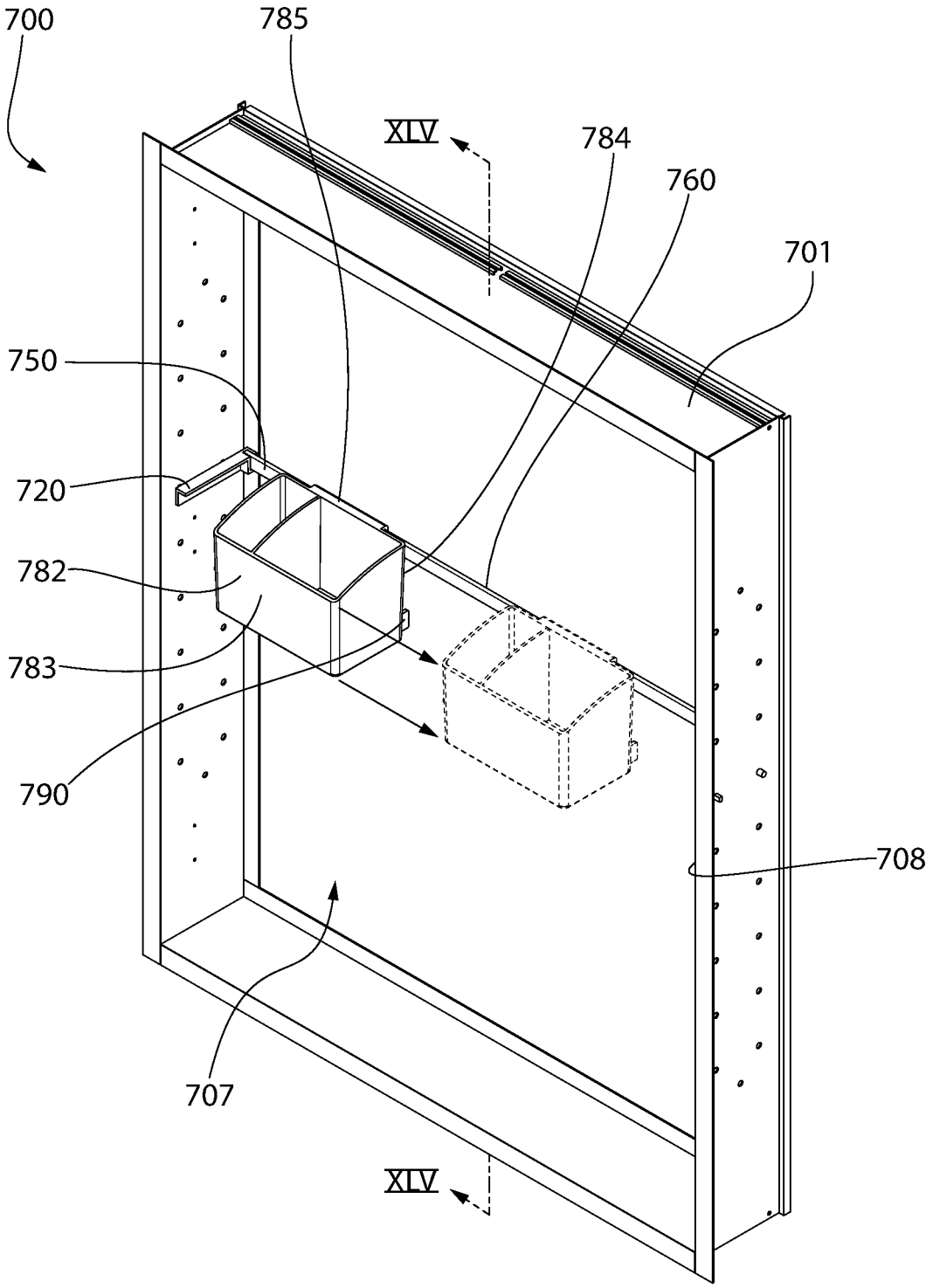
FIG. 44 is a front view of the cabinet of FIG. 37 with the door removed illustrating the storage receptacle sliding along the support rod.
Figure 45:
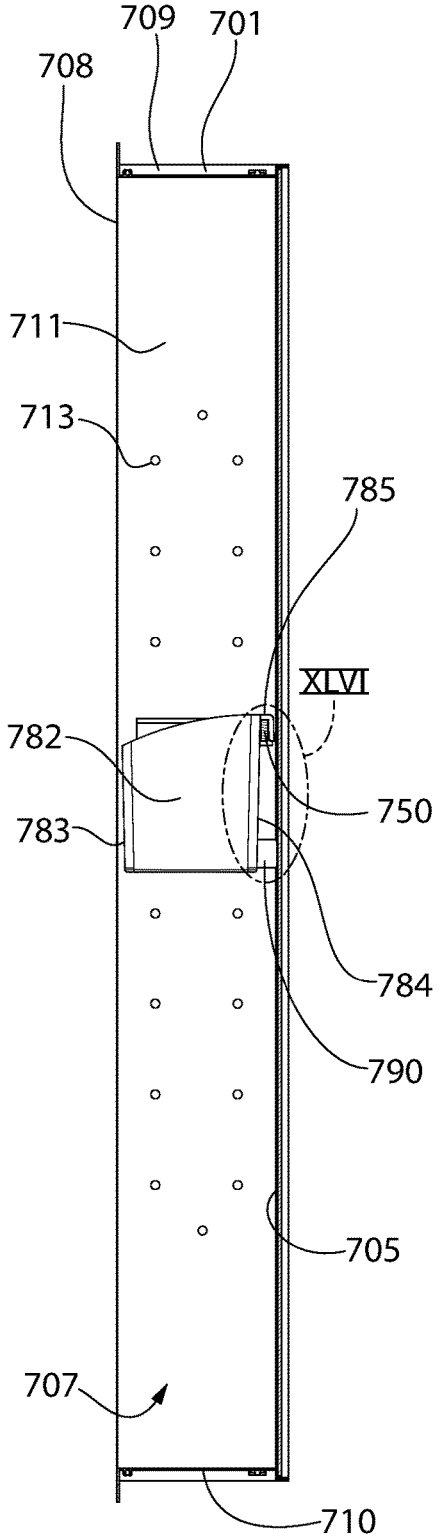
FIG. 45 is a cross-sectional view taken along line XLV-XLV of FIG. 44.

As shown in FIG. 44, the storage receptacle 782 can slide along the support rod 750 in the direction of the axis H-H of the support rod 750 (in both directions along the axis H-H) while the storage receptacle 782 remains mounted to the support rod 750. The storage receptacle 782 may be slid side-to-side within the cavity 707 for any reason, such as to make space for another storage receptacle 782 to be mounted to the support rod 750 or simply to relocate the storage receptacle 782 within the cavity 707 of the housing 701. The storage receptacle 782 can slide along and relative to the support rod 750 while the storage receptacle 782 remains coupled to the support rod 750. Thus, the storage receptacle 782 does not need to be separated from the support rod 750 before it is slid or otherwise relocated within the cavity 707. Thus, the storage receptacle 782 (and any other storage receptacles 780, 781) is detachably mounted to the support rod 750 and is slidable along the support rod 750 when mounted thereto. Thus, the storage receptacles 780, 781, 782 may be swapped out, moved, interchanged, or the like as may be desired.

As noted above, in the exemplified embodiment the mounting element 785 is located at a top end of the rear surface 784 of the storage receptacle 782. As a result, when the storage receptacle 782 is mounted to the support rod 750 as described herein, the storage receptacle 782 will have a tendency for its bottom end to pull/angle towards the rear wall 705 of the housing. In that regard, the storage receptacle 782 may also comprise a leveling protrusion 790 extending from the rear surface 784 of the storage receptacle 782 at or adjacent to a bottom end or portion of the rear surface 784. Of course, the leveling protrusion 790 may be located higher up along the rear surface 784 closer to the top end while still performing its function. Thus, the exact location on the leveling protrusion 790 on the rear surface 784 is not to be limiting of the present invention in all embodiments. Furthermore, in some embodiments the leveling protrusion 790 may be altogether omitted.

When included, the leveling protrusion 790 ensures that the storage receptacle 782 remains level as it is coupled to and slides along the support rod 750. Specifically, because the storage receptacle 782 is only coupled to the support rod 750 at its top end via the mounting element 785, the storage receptacle 782 might tend to pivot so that its bottom end moves closer to the rear wall 705 of the housing 701 when items are stored in the storage receptacle 782. The leveling protrusion 790 prevents this pivoting of the storage receptacle 782 and maintains the desired orientation of the storage receptacle 782 within the cavity 707 of the housing 701. Specifically, the leveling protrusion 790 will contact the rear wall 705 of the housing 701, thereby keeping the rear wall 784 of the storage receptacle 782 spaced apart from the rear wall 705 of the housing 701 and keeping the storage receptacle 782 level within the cavity 707.

It should be appreciated that although there are several different embodiments shown and described herein, features of the various components may be combined. For example, the hanging system described with reference to FIGS. 1-22 may be applied to any article or cabinet described herein. Furthermore, the dual-walled structure described with reference to FIGS. 27-32 may be applied to any article or cabinet described herein. Moreover, the shelf supports and shelves described with reference to FIGS. 33A-36 may be used with any of the cabinets described herein. And finally, the sliding storage receptacle system described with reference to FIGS. 37-46 may be used with any of the cabinets described herein.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A system comprising:

an article comprising a top end having a mounting channel that is elongated along a channel axis, the article and the mounting channel having a fixed length measured along the channel axis, wherein the article is a cabinet comprising a housing defining a cavity having an opening and a door that is alterable between a closed state in which the door encloses the opening and an open state in which the opening is exposed and forms a passageway into the cavity of the housing;

at least one surface mounting element comprising a first portion and a second portion, the at least one surface mounting element configured to be coupled to a support surface so that the second portion of the at least one surface mounting element protrudes from the support surface;

at least one cam lock comprising a first portion that is slidably mounted to the mounting channel and a second portion, the at least one cam lock alterable between: (1) a receiving state in which the second portion of the at least one surface mounting element can be inserted into and removed from the second portion of the at least one cam lock; and (2) a locked state in which the second portion of the at least one surface mounting element is prohibited from being removed from the second portion of the at least one cam lock; and wherein the system is adapted for hanging the article from the support surface.

2. The system according to claim 1 wherein when the at least one surface mounting element is coupled to the support surface, the second portion of the at least one surface mounting element is positioned within the second portion of the at least one cam lock, and the at least one cam lock is in the receiving state, the article can slide horizontally along the support surface while hanging from the support surface, the at least one cam lock being in a fixed position relative to the support surface and the first portion of the at least one cam lock sliding along the mounting channel while the article slides horizontally along the support surface.

3. The system according to claim 1 wherein the at least one cam lock extends from a first end to a second end along a longitudinal axis, the at least one cam lock comprising a stem extending between the first and second portions of the at least one cam lock, the first and second portions of the at least one cam lock spaced apart from one another by an annular gap that circumferentially surrounds the stem.

4. The system according to claim 3 wherein the mounting channel comprises an open top end, and wherein the first portion of the at least one cam lock is positioned within the mounting channel and the stem of the at least one cam lock extends through the open top end of the mounting channel, and wherein the at least one cam lock is configured to rotate about the longitudinal axis while the first portion of the at least one cam lock is located within the mounting channel of the article.

5. The system according to claim 1 wherein the article comprises a front surface, a rear surface opposite the front surface, a first side surface, and a second side surface opposite the first side surface, the first and second side surfaces extending between the front and rear surfaces, the top end of the article comprising a top surface extending between the first and second side surfaces of the article along a first axis that is equidistant from the front and rear surfaces of the article, and wherein the mounting channel extends along the channel axis that is parallel to the first axis and the mounting channel is located between the first axis and the rear surface of the article.

6. The system according to claim 1 further comprising the top end of the article comprising a top surface; and a bracket protruding from the top surface of the article and being elongated in a direction parallel to the channel axis, the bracket comprising a first bracket member and a second bracket member that are spaced apart from one another, the mounting channel being defined between the first and second bracket members.

7. The system according to claim 6 further comprising:

the first bracket member comprising a first wall extending from the top surface of the article and a second wall extending from the first wall;

the second bracket member comprising a third wall extending from the top surface of the article and a fourth wall extending from the third wall; and wherein the second and fourth walls extend from the first and third walls, respectively, in a direction towards one another.

8. The system according to claim 7 wherein the mounting channel comprises a lower portion defined between the first and third walls of the first and second bracket members and an upper portion defined between the second and fourth walls of the first and second bracket members, the lower portion having a greater width than the upper portion such that the first portion of the at least one cam lock fits within the lower portion of the mounting channel but not within the upper portion of the mounting channel, wherein the first portion of the at least one cam lock is located within the lower portion of the mounting channel and a stem of the at least one cam lock that extends between the first and second portions of the at least one cam lock is located within the upper portion of the mounting channel, a lower surface of the second and fourth walls resting on a top surface of the first portion of the at least one cam lock.

9. The system according to claim 1 wherein the first portion of the at least one cam lock is located within the mounting channel and the article is supported by and hangs from a top surface of the first portion of the at least one cam lock.

10. The system according to claim 1 further comprising:

the article extending from a bottom end to the top end along a longitudinal axis;

the at least one surface mounting element comprising a first cam screw and a second cam screw, the first and second cam screws configured to be coupled to the support surface in a horizontally spaced apart manner;

the at least one cam lock comprising a first cam lock and a second cam lock, the first and second cam locks slidably coupled to the article on opposite sides of the longitudinal axis of the article; and wherein the first cam lock is configured to be coupled to the first cam screw and the second cam lock is configured to be coupled to the second cam screw to hang the article from the support surface.

11. The system according to claim 1 wherein the first portion of the at least one cam lock is freely slidable within the mounting channel in a direction parallel to the channel axis while being substantially prevented from movement in a direction perpendicular to the channel axis.

12. The system according claim 1 further comprising:

the article comprising a bottom end opposite the top end, the bottom end having a second mounting channel; and a support bracket comprising a first portion and a second portion, wherein the first portion of the support bracket is configured to be mounted to the support surface while the second portion of the support bracket extends into the second mounting channel on the bottom end of the article.

* * * * *